US011910840B2

(12) United States Patent
Milandri et al.

(10) Patent No.: US 11,910,840 B2
(45) Date of Patent: Feb. 27, 2024

(54) MANUFACTURING MACHINE FOR THE PRODUCTION OF DISPOSABLE CARTRIDGES FOR ELECTRONIC CIGARETTES

(71) Applicant: G.D SOCIETA' PER AZIONI, Bologna (IT)

(72) Inventors: Francesco Milandri, Cesena (IT); Andrea Dondini, Bologna (IT); Enrico Medina, Bologna (IT); Luca Lanzarini, Crespellano (IT); Luca Federici, Bologna (IT); Stefano Serafini, Crevalcore (IT); Daniele Grosso, Bologna (IT)

(73) Assignee: G.D SOCIETA' PER AZIONI, Bologna (IT)

( * ) Notice: Subject to any disclaimer, the term of this patent is extended or adjusted under 35 U.S.C. 154(b) by 570 days.

(21) Appl. No.: 17/264,678

(22) PCT Filed: Aug. 8, 2019

(86) PCT No.: PCT/IB2019/056772
§ 371 (c)(1),
(2) Date: Jan. 29, 2021

(87) PCT Pub. No.: WO2020/031138
PCT Pub. Date: Feb. 13, 2020

(65) Prior Publication Data

US 2021/0298366 A1 Sep. 30, 2021

(30) Foreign Application Priority Data

Aug. 8, 2018 (IT) ..... 102018000007950
Jun. 18, 2019 (IT) ..... 102019000009288

(51) Int. Cl.
*A24F 40/70* (2020.01)
*A24F 40/42* (2020.01)

(52) U.S. Cl.
CPC ..... *A24F 40/70* (2020.01); *A24F 40/42* (2020.01)

(58) Field of Classification Search
CPC ..... A24F 40/70; A24F 40/42; A24F 47/008; A24C 5/395; A24C 5/397; A24D 1/14;
(Continued)

(56) References Cited

U.S. PATENT DOCUMENTS 4,782,644 A 11/1988 Haarer et al.
10,946,987 B2 * 3/2021 Ghiotti ..... B65B 1/32
(Continued)

FOREIGN PATENT DOCUMENTS

WO WO-2017/051348 A1 3/2017
WO WO-2017/051349 A1 3/2017
WO WO-2017/051350 A2 3/2017

OTHER PUBLICATIONS

International Search Report and Written Opinion, corresponding International Application No. PCT/IB2019/056772, dated Dec. 17, 2019.

*Primary Examiner* — Gary F Paumen
(74) *Attorney, Agent, or Firm* — MARSHALL, GERSTEIN & BORUN LLP

(57) ABSTRACT

A manufacturing machine for producing disposable cartridges for electronic cigarettes can have a manufacturing drum supporting at least one group of seats, each adapted to receive a component of the disposable cartridge; and a feeding unit which feeds the components of the disposable cartridges to the seats. Each seat has a housing through channel crossing the manufacturing drum from side-to-side to contain a component and a pair of opposite jaws mounted in the housing channel and movable between a gripping
(Continued)

position, in which they engage a component arranged in the housing channel and a transfer position, in which they do not engage the component. Each pair of jaws has two teeth arranged at the top and projecting from the corresponding jaws towards the center of the seat, so that the two teeth hold the component inside the seat at the top when the two jaws are in the gripping position.

23 Claims, 41 Drawing Sheets

(58) Field of Classification Search
CPC .. B65B 1/10; B65B 1/36; B65B 1/363; B65B 1/06; B65B 1/32; B65B 1/38; B65B 1/385; B65B 29/00; B65B 3/30; B65B 3/305; B65B 9/04; B65B 37/20; B65B 63/02; B65B 63/022
USPC ..... 131/328; 53/247, 253, 900; 141/71, 81, 141/144, 146, 102, 238
See application file for complete search history.

(56) References Cited

U.S. PATENT DOCUMENTS

| | | | | |
|---|---|---|---|---|
| 11,085,550 | B2 * | 8/2021 | Marsh | H02J 7/0044 |
| 2016/0143362 | A1 * | 5/2016 | Boldrini | B23P 21/004 29/742 |
| 2016/0143363 | A1 * | 5/2016 | Boldrini | B23P 21/004 29/874 |
| 2016/0144458 | A1 * | 5/2016 | Boldrini | B23K 31/02 228/176 |
| 2017/0095000 | A1 * | 4/2017 | Spirito | A24F 40/70 |
| 2018/0170588 | A1 * | 6/2018 | Boldrini | A24F 40/70 |
| 2019/0071198 | A1 * | 3/2019 | Ghiotti | B65B 65/003 |

* cited by examiner

MANUFACTURING MACHINE FOR THE PRODUCTION OF DISPOSABLE CARTRIDGES FOR ELECTRONIC CIGARETTES

CROSS-REFERENCE TO RELATED APPLICATIONS

This patent application is a U.S. national phase of International Patent Application No. PCT/IB2019/056772 filed Aug. 8, 2019, which claims the benefit of priority from Italian patent applications no. 102018000007950 filed on Aug. 8, 2018, and Italian patent applications no. 102019000009288 filed on Jun. 18, 2019, the entire disclosures of which are each incorporated herein by reference in their entireties.

TECHNICAL FIELD

The present invention relates to a manufacturing machine for the production of disposable cartridges for electronic cigarettes.

PRIOR ART

Recently, disposable (i.e. single use) cartridges have been proposed for electronic cigarettes comprising a tubular-shaped casing made of a plastic material with a micro-perforated bottom wall and a quantity of powdered tobacco is contained therein with a tab made of filtering material on top; the casing is closed at an upper end (i.e. opposite to the micro-perforated bottom wall) by means of a sealing ring which is welded to the casing.

The production of said cartridges provides for filling each casing with a calibrated quantity of powdered tobacco, slightly compressing the quantity of powdered tobacco inside the casing so as to obtain the desired density and then capping the casing by applying both the tab of filtering material and the sealing ring to the open upper end. The cartridges are subsequently individually weighed in order to allow discarding of non-compliant ones which contain an insufficient or excessive amount of powdered tobacco therein.

Once the production of the cartridges is finished, the latter are inserted inside sealed packages, typically blister packets.

Patent applications WO2017051348A1, WO2017051349A1 and WO2017051350A1 provide an example of a manufacturing machine for the production of disposable cartridges for electronic cigarettes of the type described above. This manufacturing machine is able to operate efficiently (i.e. with a high hourly production rate, in terms of the number of cartridges produced per time unit) and effectively (i.e. with a small number of discarded pieces and with a high final quality); however, electronic cigarettes that use the above-described cartridge are experiencing considerable market success and therefore the manufacturers of the above-described cartridges require an even more performing manufacturing machine, i.e. with a higher hourly production rate, compared to the known manufacturing machine described in the patent applications WO2017051348A1, WO2017051349A1 and WO2017051350A1.

The U.S. Pat. No. 4,782,644A provides a further example of a manufacturing machine for the production of disposable cartridges for electronic cigarettes; however, this manufacturing machine is not capable of operating efficiently (i.e. with a high hourly production rate, in terms of the number of cartridges produced per time unit)

DESCRIPTION OF THE INVENTION

The object of the present invention is to provide a manufacturing machine for the production of disposable cartridges for electronic cigarettes, the which filling unit allows to achieve increased productivity while ensuring high quality standards and, at the same time, being easy and inexpensive to produce.

According to the present invention, a manufacturing machine is provided for the production of disposable cartridges for electronic cigarettes, according to what is claimed in the appended claims.

The claims describe preferred embodiments of the present invention forming an integral part of the present disclosure.

BRIEF DESCRIPTION OF THE DRAWINGS

The present invention will now be described with reference to the attached drawings, which illustrate some non-limiting embodiments thereof, wherein.

PREFERRED EMBODIMENTS OF THE INVENTION

Figure 1:
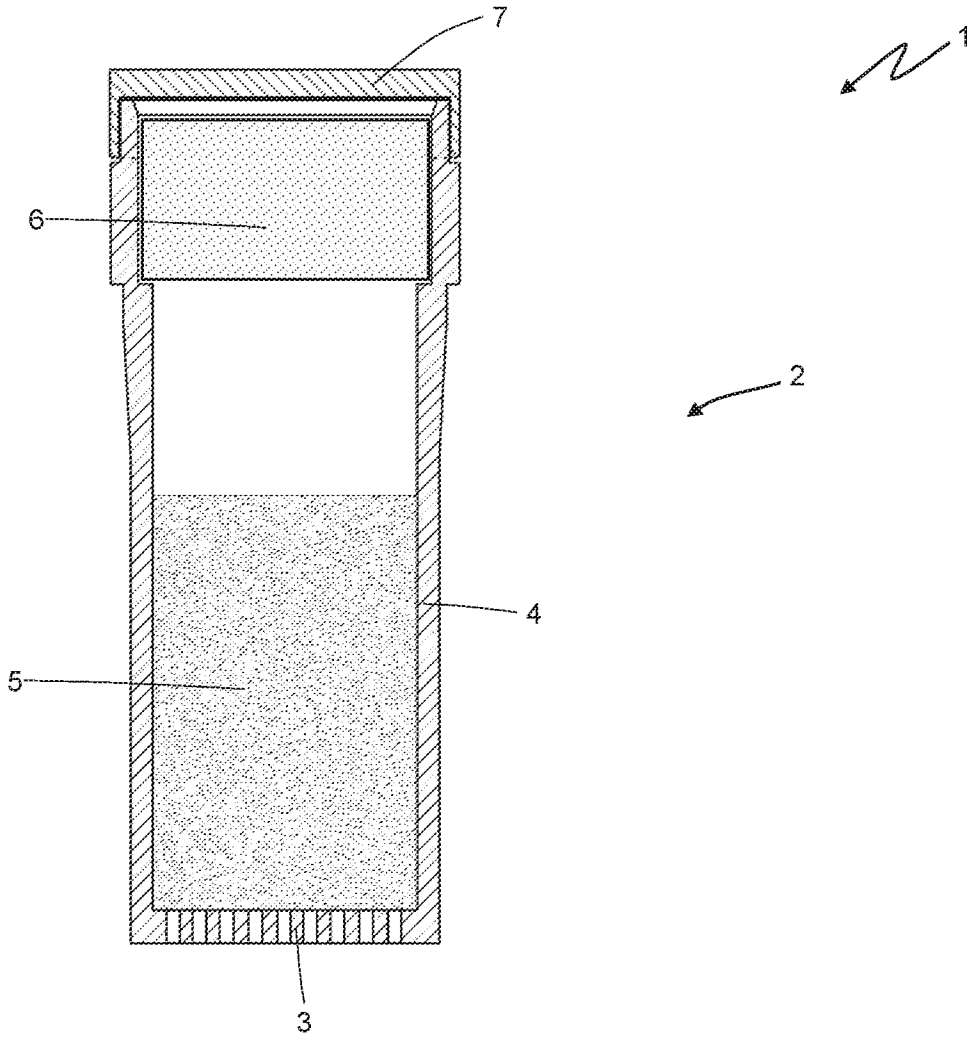
FIG. 1 is a longitudinal section view of a cartridge for an electronic cigarette.

In FIG. 1, the number 1 denotes, as a whole, a disposable cartridge for electronic cigarettes. The disposable cartridge 1 comprises a tubular casing 2 made of plastic material having a micro-perforated bottom wall 3 and a substantially cylindrical-shaped side wall 4; inside the tubular casing 2 a quantity 5 of powdered tobacco (in contact with the bottom wall 3) is contained therein with a tab 6 of filtering material on top. Finally, the disposable cartridge 1 comprises a sealing ring 7 (i.e. a sealing washer 7) which is inserted around an upper end (otherwise completely open) of the tubular casing 2 so as to prevent the tab 6 of filtering material from escaping; preferably, the sealing ring 7 is welded to the tubular casing 2. According to a preferred but non-binding embodiment illustrated in the attached figures, the tubular casing 2 has a bulge (i.e. a transversely larger portion) near the upper end (i.e. of the end opposite to the bottom wall 3 and near the sealing ring 7); this bulge determines the presence of an undercut near the upper end.

Figure 2:
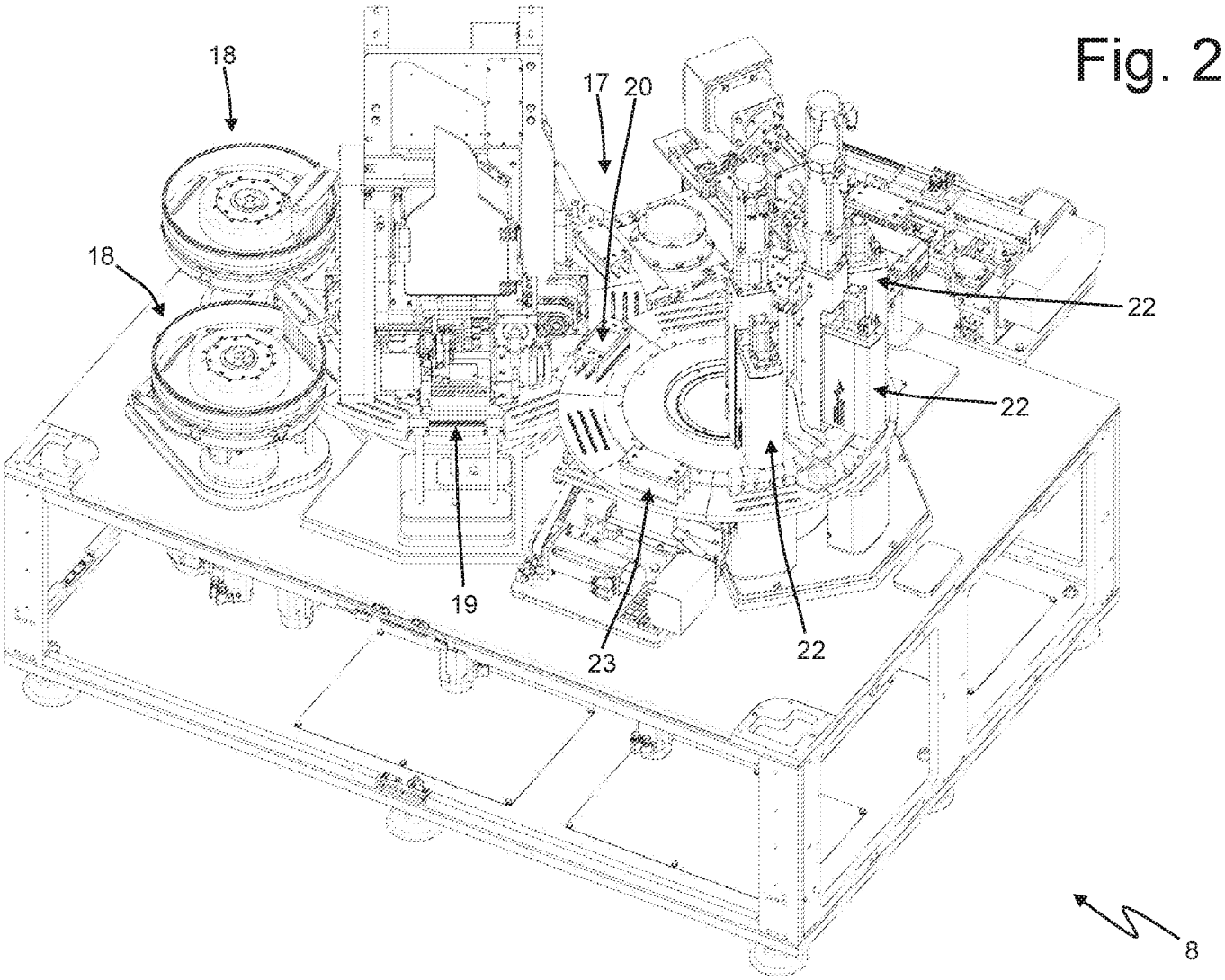
FIG. 2 is a perspective view of a manufacturing machine which produces the cartridge for the electronic cigarette of FIG. 1.
Figure 3:
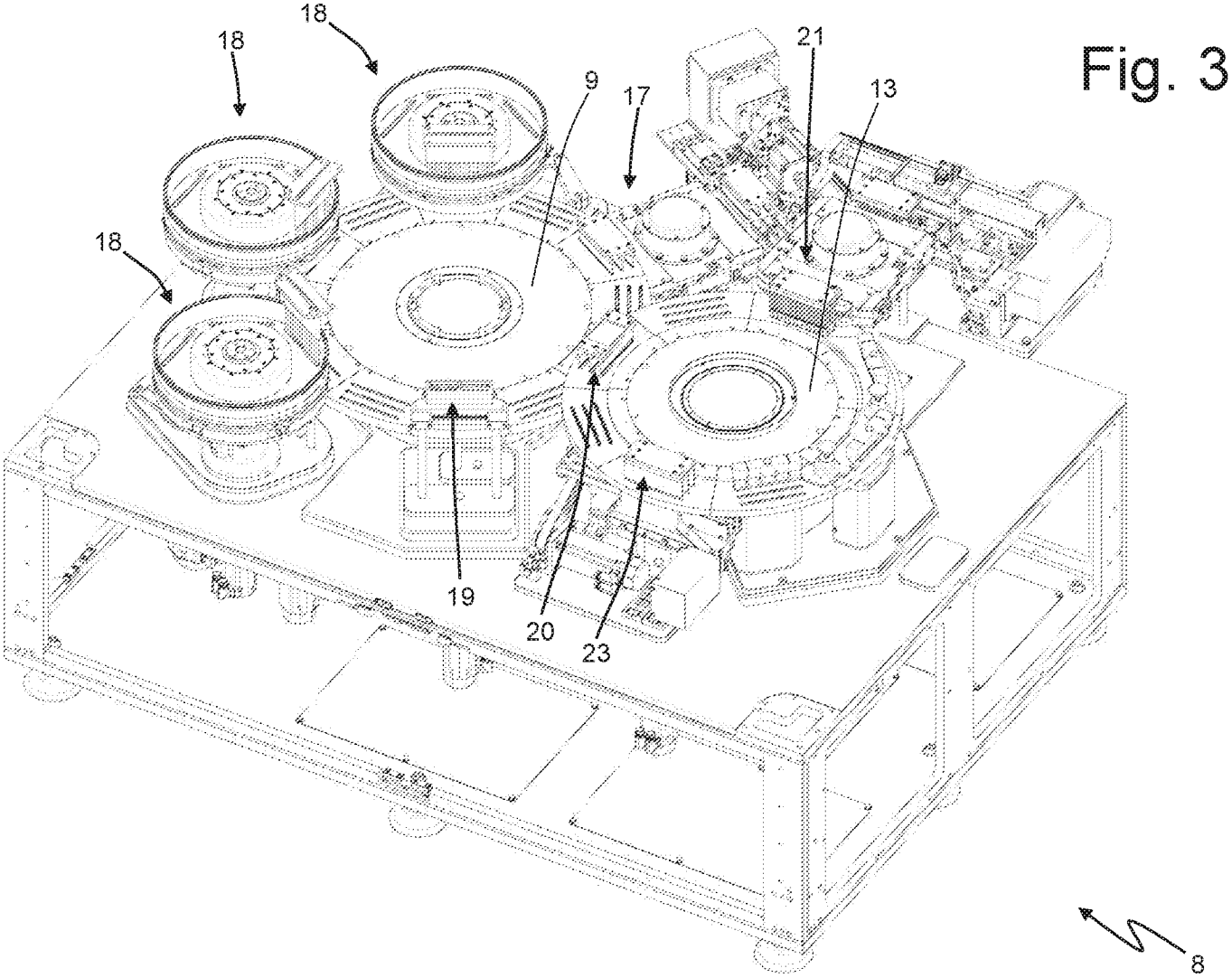
FIG. 3 is a perspective view of the manufacturing machine of FIG. 2 with some parts removed for clarity.

In FIGS. 2 and 3, the number 8 denotes, as a whole, a manufacturing machine for the production of the disposable cartridges 1 described above. The manufacturing machine 8 performs an intermittent movement, i.e. its conveyors cyclically alternate motion steps and still steps.

Figure 4:
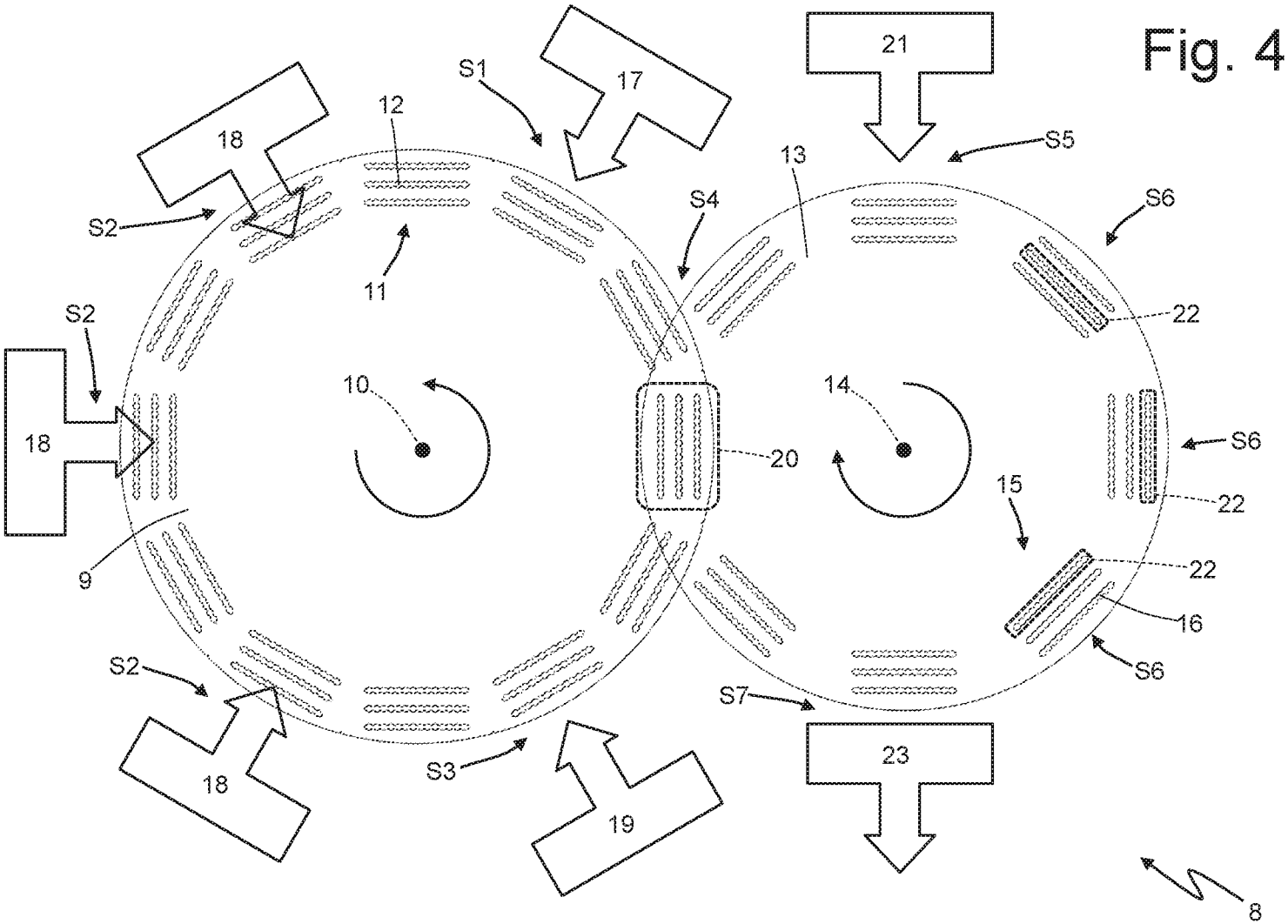
FIG. 4 is a schematic plan view of the manufacturing machine of FIG. 2.

As illustrated in FIG. 4, the manufacturing machine 8 comprises a manufacturing drum 9 which is arranged horizontally and is mounted in a rotatable stepwise manner around a vertical rotation axis 10; in other words, the manufacturing drum 9 is set into rotation with an intermittent motion, i.e. a non-continuous motion which provides a cyclical alternation of motion steps, wherein the manufacturing drum 9 is moving, and of still steps, in which the manufacturing drum 9 stops. The manufacturing drum 9 supports twelve groups 11 of seats 12, each of which is adapted to receive and contain a corresponding tubular casing 2; in particular, each group 11 comprises forty-two seats 12 aligned along three straight lines parallel to each other (each of the three straight lines has fourteen seats 12) and the twelve groups 11 are arranged to define, in plan, a regular polygon (i.e. a dodecahedron) on the surface of the manufacturing drum 9.

The manufacturing machine 8 comprises a further manufacturing drum 13 which is arranged horizontally beside the manufacturing drum 9 and is mounted in a rotatable stepwise manner around a vertical rotation axis 14 parallel to the rotation axis 10; in other words, the manufacturing drum 13 is set into rotation with an intermittent motion, i.e. a non-continuous motion which provides a cyclical alternation of motion steps, wherein the manufacturing drum 13 is moving, and still steps, wherein the manufacturing drum 13 stops. The manufacturing drum 13 supports twelve groups 15 of seats 16, each of which is adapted to receive and contain a corresponding tubular casing 2; in particular, each group 15 comprises forty-two seats 16 aligned along three straight lines parallel to each other (each of the three straight lines has fourteen seats 16) and the twelve groups 15 are arranged to define, in plan, a regular polygon (i.e. a dodecahedron) on the surface of the manufacturing drum 13.

The manufacturing machine 8 comprises a feeding station S1, in which a feeding unit 17 inserts a corresponding empty tubular casing 2 in each seat 12 of a group 11, that is standing still; in particular, the feeding unit 17 simultaneously inserts forty-two empty tubular casings 2 into as many seats 12 of a group 11 that is standing still in the feeding station S1. Downstream of the feeding station S1, relative to the rotation direction of the manufacturing drum 9, three filling stations S2 are arranged in succession, in each of which a filling unit 18 is arranged, which feeds a corresponding quantity 5 of tobacco into each tubular casing 2 carried by a seat 12 of a group 11, that is standing still; in particular, each filling unit 18 simultaneously feeds fourteen quantities of tobacco into as many seats 12 of a group 11 that is standing still in the feeding station S2. The filling unit 18 of the first feeding station S2 feeds fourteen quantities 5 of tobacco into as many seats 12 of the innermost row of the group 11 that is standing still in the first feeding station S2, the filling unit 18 of the second feeding station S2 feeds fourteen quantities 5 of tobacco into as many seats 12 of the intermediate row of the group 11 that is standing still in the second feeding station S2, and the filling unit 18 of the third feeding station S2 feeds fourteen quantities 5 of tobacco into as many seats 12 of the outermost row of the group 11 that is standing still in the third feeding station S2.

Downstream of the filling stations S2 (i.e. downstream of the last filling station S2), relative to the rotation direction of the manufacturing drum 9, a feeding station S3 is arranged, in which a feeding unit 19 feeds a corresponding tab 6 of filtering material into each tubular casing 2 carried by a seat 12 of a group 11, that is standing still; in particular, the filling unit 19 simultaneously feeds forty-two tabs 6 of filtering material into as many seats 12 of a group 11 that is standing still in the feeding station S3.

Downstream of the feeding station S3, relative to the rotation direction of the manufacturing drum 9, a transfer station S4 is arranged, in which a transfer unit 20 transfers the tubular casings 2 (each containing a quantity 5 of tobacco and a tab 6 of filtering material) from the seats 12 of a group 11 of the manufacturing drum 9 to the seats 16 of a group 15 of the manufacturing drum 13; in particular, the transfer unit 20 simultaneously transfers forty-two tubular casings 2 from as many seats 12 of a group 11 that is standing still in the transfer station S4 to as many seats 16 of a group 15 that is standing still in the transfer station S4. In the transfer station S4, the two manufacturing drums 9 and 13 are partially overlapped so that the seats 12 of a group 11 of the manufacturing drum 9 are vertically aligned with the seats 16 of a group 15 of the manufacturing drum 13; consequently, in the transfer station S4 the transfer of the tubular casings 2 takes place by means of a linear and vertical movement (i.e. a rise of the casings 2 if the manufacturing drum 9 is arranged below the manufacturing drum 13 or a lowering of the casings 2 if the manufacturing drum 9 is arranged above the manufacturing drum 13).

Downstream of the insertion station S4, relative to the rotation direction of the manufacturing drum 13, a feeding station S5 is arranged, in which a feeding unit 21 feeds a corresponding sealing ring 7 into each tubular casing 2 carried by a seat 16 of a group 15, that is standing still; in particular, the filling unit 21 simultaneously feeds forty-two sealing rings 7 into as many seats 16 of a group 15 that is standing still in the feeding station S5. Downstream of the feeding station S5, relative to the rotation direction of the manufacturing drum 13, three welding stations S6 are arranged in succession, in each of which a welding unit 22 performs (preferably by ultrasonic welding) the welding of each sealing ring 7 to the corresponding tubular casing 2 carried by a seat 16 of a group 15 that is standing still; in particular, each welding unit 22 simultaneously welds fourteen sealing rings 7 to as many tubular casings 2 carried by the seats 16 of a group 15 that is standing still in the welding station S6. The welding unit 22 of the first welding station S6 welds fourteen sealing rings 7 in as many seats 16 of the intermediate row of the group 15 that is standing still in the first welding station S6, the welding unit 22 of the second welding station S6 welds fourteen sealing rings 7 in as many seats 16 of the outermost row of the group 15 that is standing still in the second welding station S6, and the welding unit 22 of the third welding station S6 welds fourteen sealing rings 7 in as many seats 16 of the innermost row of the group 15 that is standing still in the third welding station S6.

In the welding stations S6, the manufacturing of the disposable cartridges 1 is completed, i.e. downstream of the welding stations S6 the disposable cartridges 1 are finished and ready for use. Downstream of the welding stations S6 (i.e. downstream of the last welding station S6), relative to the rotation direction of the manufacturing drum 13, an output station S7 is arranged, in which an extraction unit 23 extracts a corresponding disposable cartridge 1 out of each seat 16 of a group 15 that is standing still; in particular, the extraction unit 23 simultaneously extracts forty-two disposable cartridges 1 out of as many seats 16 of a group 15 that is standing still in the output station S7.

From the foregoing it is clear that all the steps of the production process of the disposable cartridges 1 (such as for example the filling of the quantities 5 of tobacco, the feeding of the tabs 6 of filtering material, the feeding of the sealing rings 7, the welding of the sealing rings 7) contained in the seats 12/16 of a same group 11/15 are carried out in parallel, i.e. they are carried out simultaneously for a plurality (fourteen or forty-two) of disposable cartridges 1 contained in the seats 12/16 of a same group 11/15.

Figure 5:
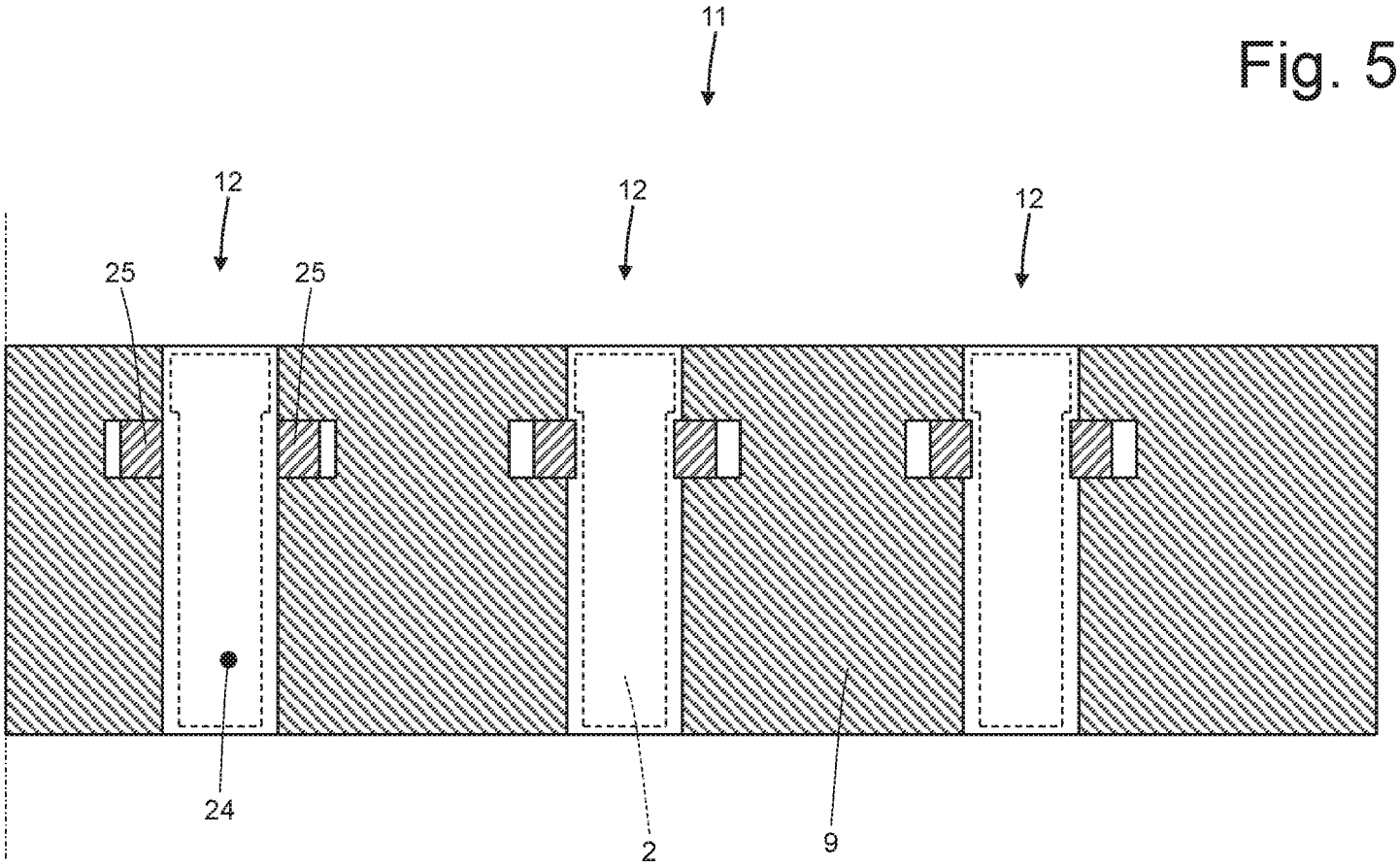
FIG. 5 is a schematic and longitudinal section view of part of a first manufacturing drum of the manufacturing machine of FIG. 2.

As illustrated in FIG. 5, each seat 12 of the manufacturing drum 13 comprises a housing through channel 24 which crosses the manufacturing drum 9 from side-to-side and is adapted to contain a tubular casing 2; in particular, each housing channel 24 is transversely wider than a tubular casing 2 so as to allow the tubular casing 2 to pass through the inside of the housing channel 24 (as will be described in the following, each tubular casing 2 enters, from the bottom, the corresponding housing channel 24 in the feeding station S1 and exits, from the top, the corresponding housing channel 24 in the transfer station S4). Each seat 12 of the manufacturing drum 13 further comprises a pair of opposite jaws 25, which are mounted in the housing channel 24 and are movable between a gripping position (illustrated in the two seats 12 on the right in FIG. 5) in which they engage a tubular casing 2 arranged in the housing channel 24 (thus preventing the descent of the tubular casing 2 through the housing channel 24) and a transfer position (illustrated in the seat 12 on the left in FIG. 5) in which they do not engage a tubular casing 2 arranged in the housing channel 24 (thus allowing the free sliding of the tubular casing 2 along the housing channel 24). According to a preferred embodiment, the opposite jaws 25 are arranged immediately below the undercut formed by the transverse bulge of the upper part of the tubular casing 2 so that said undercut rests on the jaws 25 when the jaws 25 are arranged in the gripping position (illustrated in the two seats 12 on the right in FIG. 5). In the embodiment illustrated in the attached figures, the axial length of each housing channel 24 is (slightly) longer than the axial length of the tubular casings 2 and therefore the tubular casings 2 are completely contained (without any protrusion) in the housing channels 24; according to other embodiments not illustrated and perfectly equivalent, the axial length of each housing channel 24 is much longer than the axial length of the tubular casings 2 or the axial length of each housing channel 24 is (slightly or much) shorter than the axial length of the tubular casings 2 (in this last case the tubular casings 2 are not completely contained in the housing channels 24 and therefore protrude, at the top and/or at the bottom, from the housing channels 24).

In the embodiment illustrated in the attached figures, the two jaws 25 of each seat 12 have a limited axial extension, i.e. they are (much) shorter than the housing channel 24; in other words, in the embodiment illustrated in the attached figures, the two jaws 25 of each seat 12 engage a limited portion of the housing channel 24 which has fixed walls above and below the jaws 25. According to an alternative and perfectly equivalent embodiment not illustrated, the two jaws 25 of each seat 12 have a greater axial extension which can also coincide with the axial extension of the inside of the housing channel 24; in other words, the housing channel 24 may have fixed walls only above the two jaws 25, the housing channel 24 may have fixed walls only below the two jaws 25, or the housing channel 24 may not have fixed walls neither above nor below the two jaws 25 (i.e. the housing channel 24 may not have fixed walls, but only two jaws 25).

Figure 6:
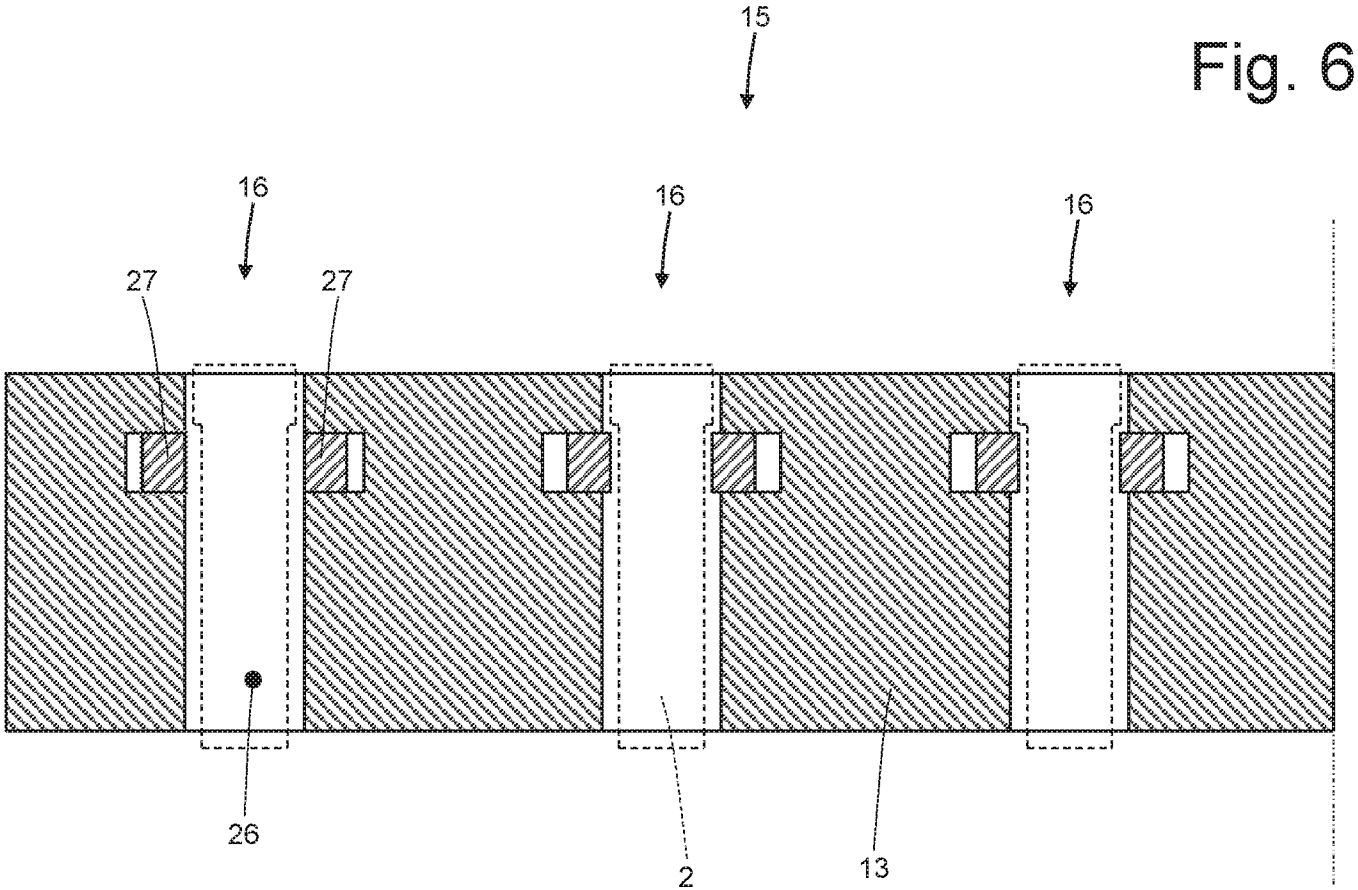
FIG. 6 is a schematic and longitudinal section view of part of a second manufacturing drum of the manufacturing machine of FIG. 2.

As illustrated in FIG. 6, each seat 16 of the manufacturing drum 13 comprises a housing through channel 26 which crosses the manufacturing drum 13 from side-to-side and is adapted to contain a tubular casing 2; in particular, each housing channel 26 is transversely wider than a tubular casing 2 so as to allow the tubular casing 2 to pass through the inside of the housing channel 26 (as will be described in the following, each tubular casing 2 enters, from the bottom, the corresponding housing channel 26 in the feeding station S1 and always comes out of the bottom of the corresponding housing channel 26 in the transfer station S4). Each seat 16 of the manufacturing drum 13 comprises, furthermore, a pair of opposite jaws 27, which are mounted in the housing channel 26 and are movable between a gripping position (illustrated in the two seats 16 on the right in FIG. 6) in which they engage a tubular casing 2 arranged in the housing channel 26 (thus preventing the descent of the tubular casing 2 through the housing channel 26) and a transfer position (illustrated in the seat 16 on the left in FIG. 6) in which they do not engage a tubular casing 2 arranged in the housing channel 26 (thus allowing the free sliding of the tubular casing 2 along the housing channel 26). According to a preferred embodiment, the opposite jaws 27 are arranged immediately below the undercut formed by the transverse bulge of the upper part of the tubular casing 2 so that said undercut rests on the jaws 27 when the jaws 27 are arranged in the gripping position (illustrated in the two seats 16 on the right in FIG. 6). In the preferred embodiment illustrated in the attached figures, the axial length of each housing channel 26 is (slightly) shorter than the axial length of the tubular casings 2 and therefore the tubular casings 2 protrude (slightly), both at the top and at the bottom, from the housing channels 26; according to other embodiments not illustrated and perfectly equivalent, the axial length of each housing channel 24 is (much or slightly) longer than the axial length of the tubular casings 2 (therefore the tubular casings 2 are completely contained, without any protrusion, in the housing channels 24) or the axial length of each housing channel 24 is greatly shorter than the axial length of the tubular casings 2 (in this latter case the tubular casings 2 widely protrude, both at the top and at the bottom, from the housing channels 26).

In the embodiment illustrated in the attached figures, the two jaws 27 of each seat 16 have a limited axial extension, i.e. they are (much) shorter than the housing channel 26; in other words, in the embodiment illustrated in the attached figures, the two jaws 27 of each seat 16 engage a limited portion of the housing channel 26 which has fixed walls above and below the jaws 27. According to an alternative and perfectly equivalent embodiment not illustrated, the two jaws 27 of each seat 16 have a greater axial extension which can also coincide with the axial extension of the inside of the housing channel 26; in other words, the housing channel 26 may have fixed walls only above the two jaws 27, the housing channel 26 may have fixed walls only under the two jaws 27, or the housing channel 26 may not have fixed walls neither above nor below the two jaws 27 (i.e. the housing channel 26 may not have fixed walls, but only two jaws 27).

Figure 7:
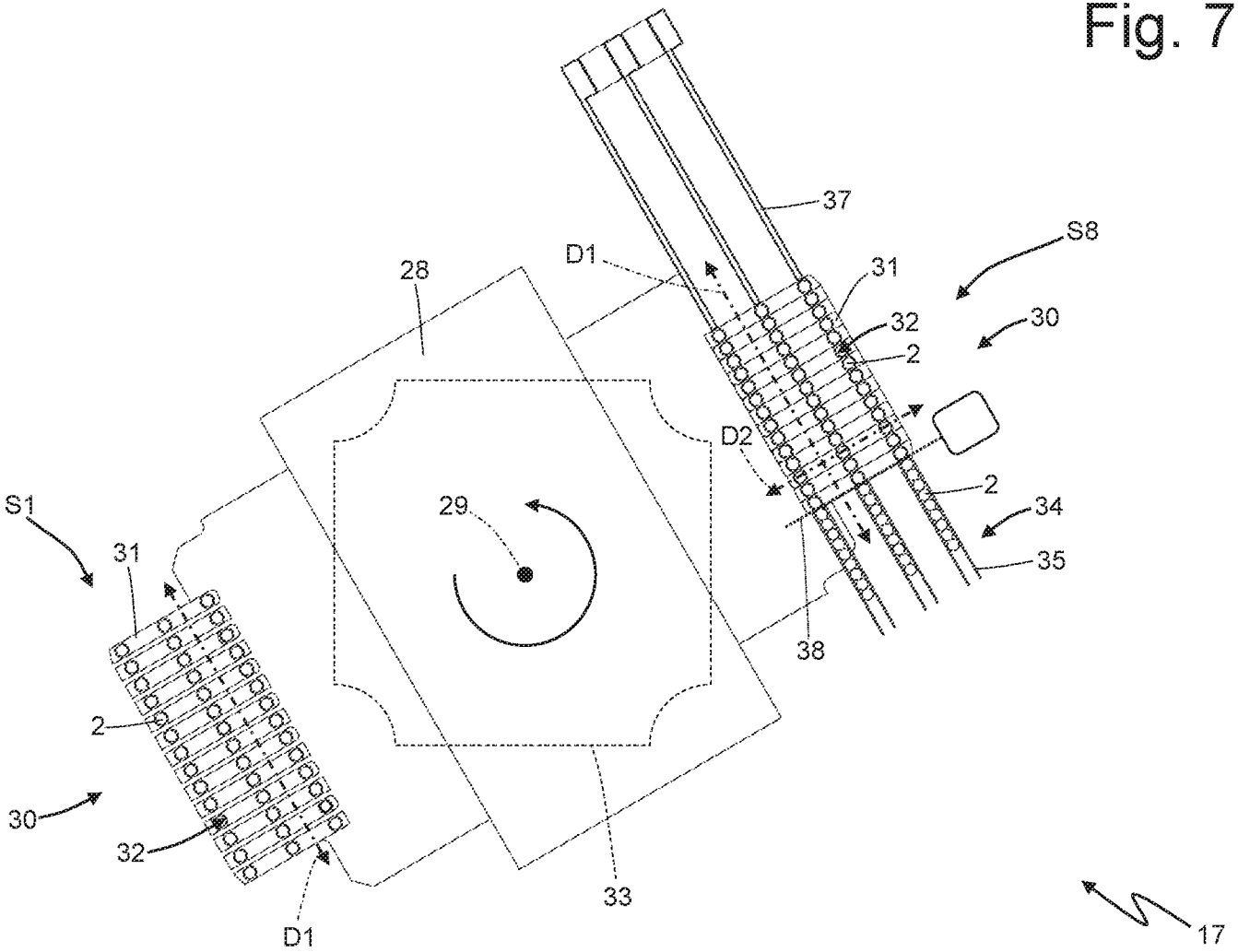
FIG. 7 is a schematic plan view of a feeding unit of the manufacturing machine of FIG. 2.
Figure 9:
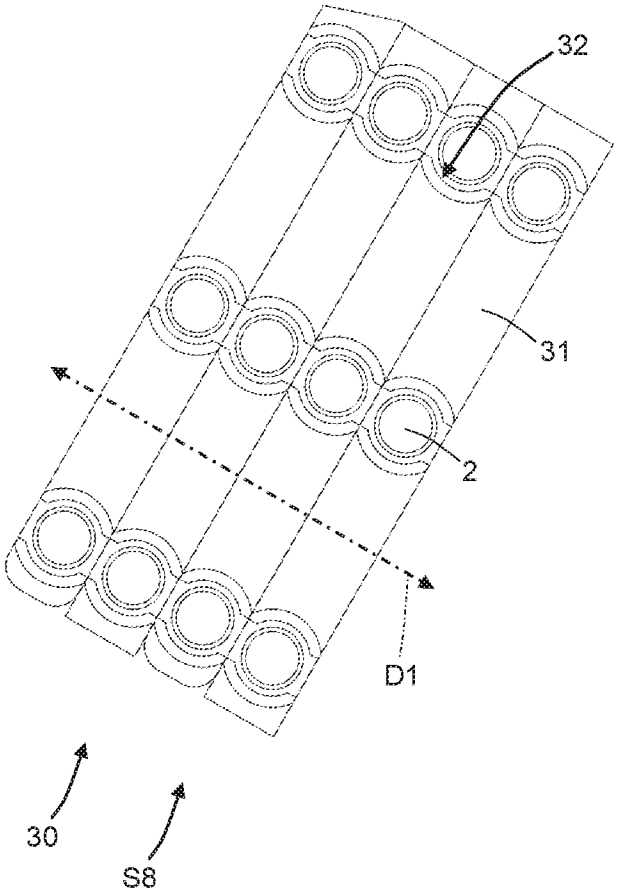
FIGS. 8 and 9 are two enlarged-scale views of some fingers of the feeding unit for the tubular casings of FIG. 7 in an expanded configuration and in a compressed configuration, respectively.
Figure 10:
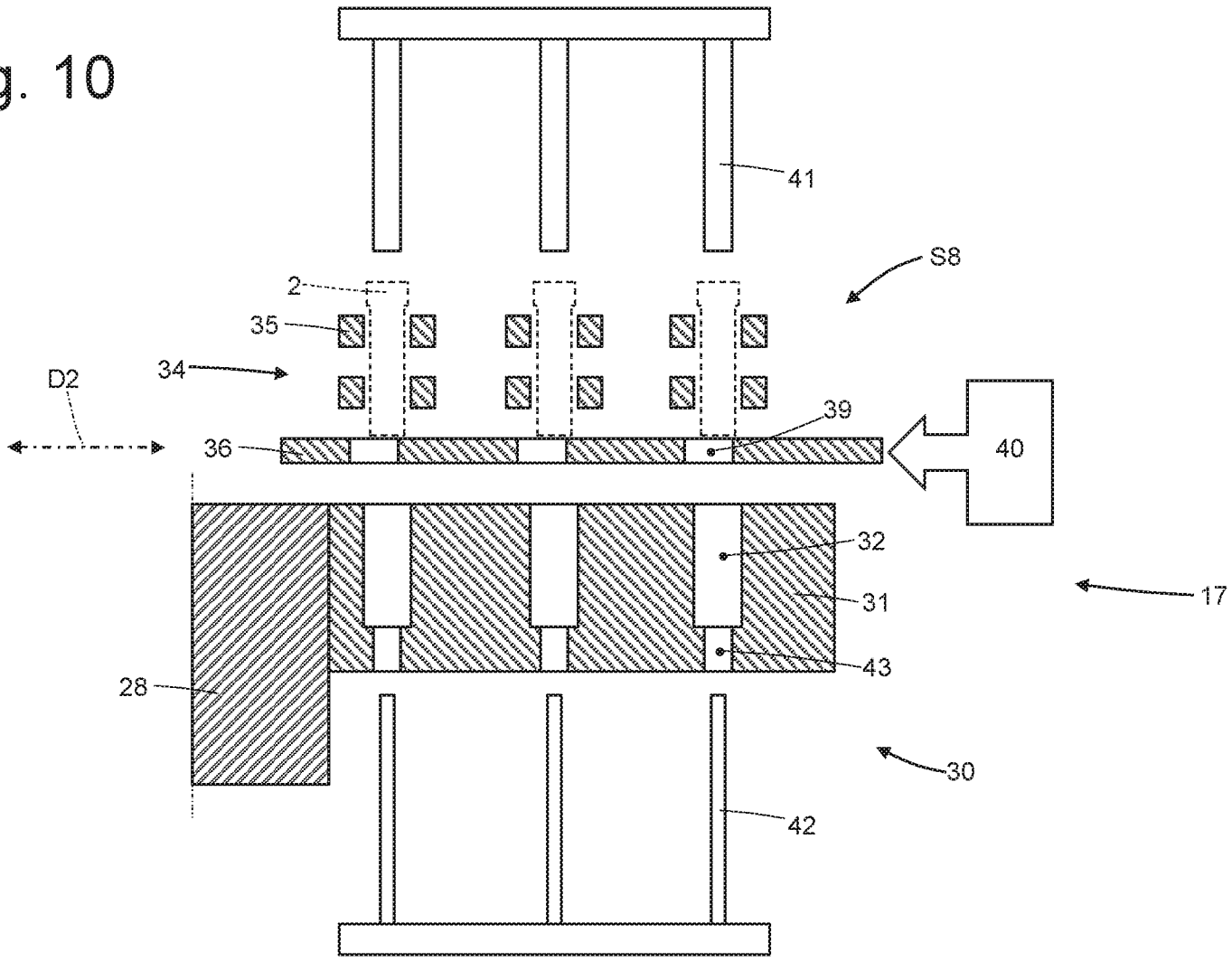
FIGS. 10 and 11 are two schematic and longitudinal section views of part of the feeding unit of FIG. 7 at an insertion station and at two different operating times.
Figure 11:
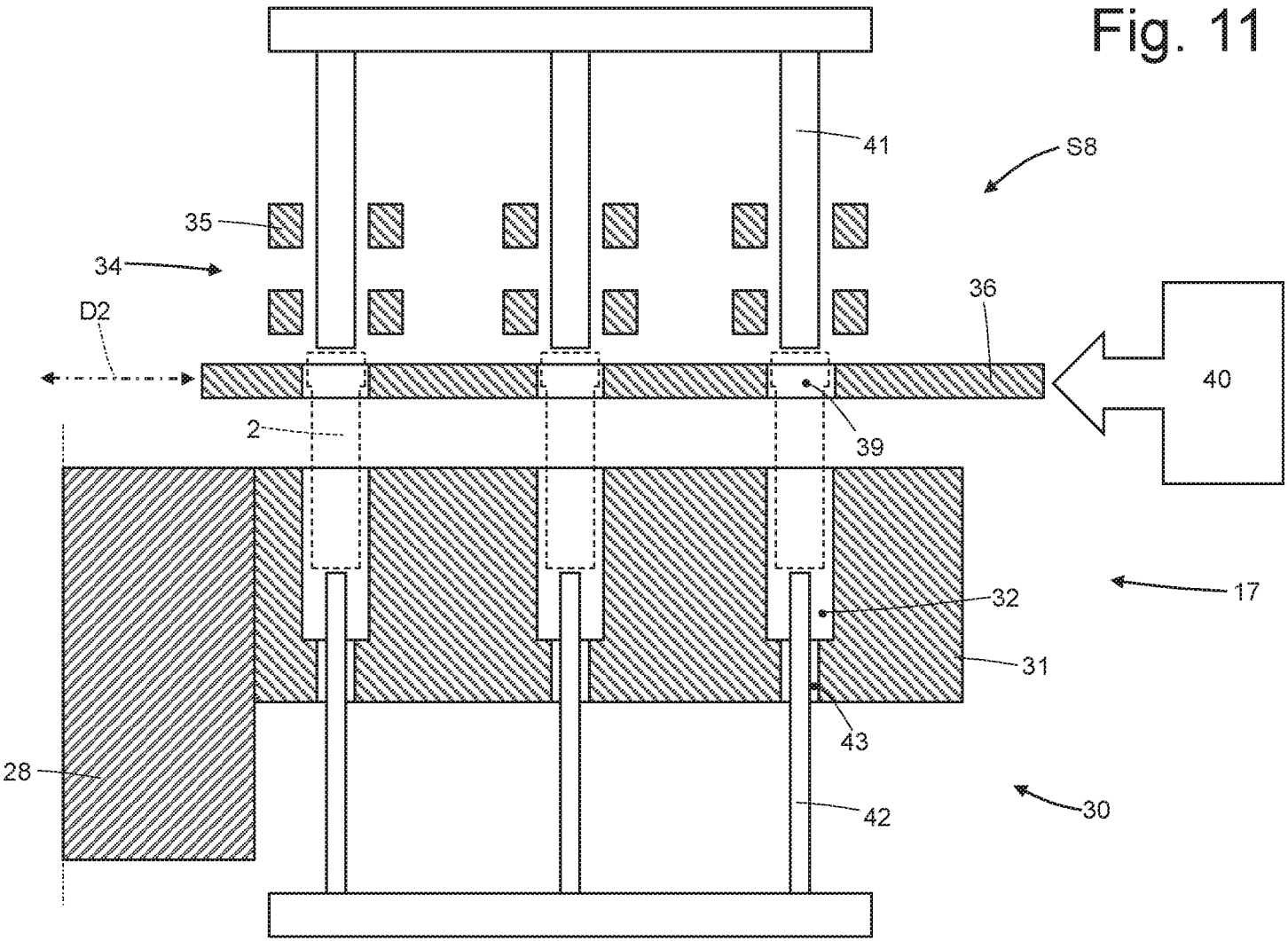
Figure 12:
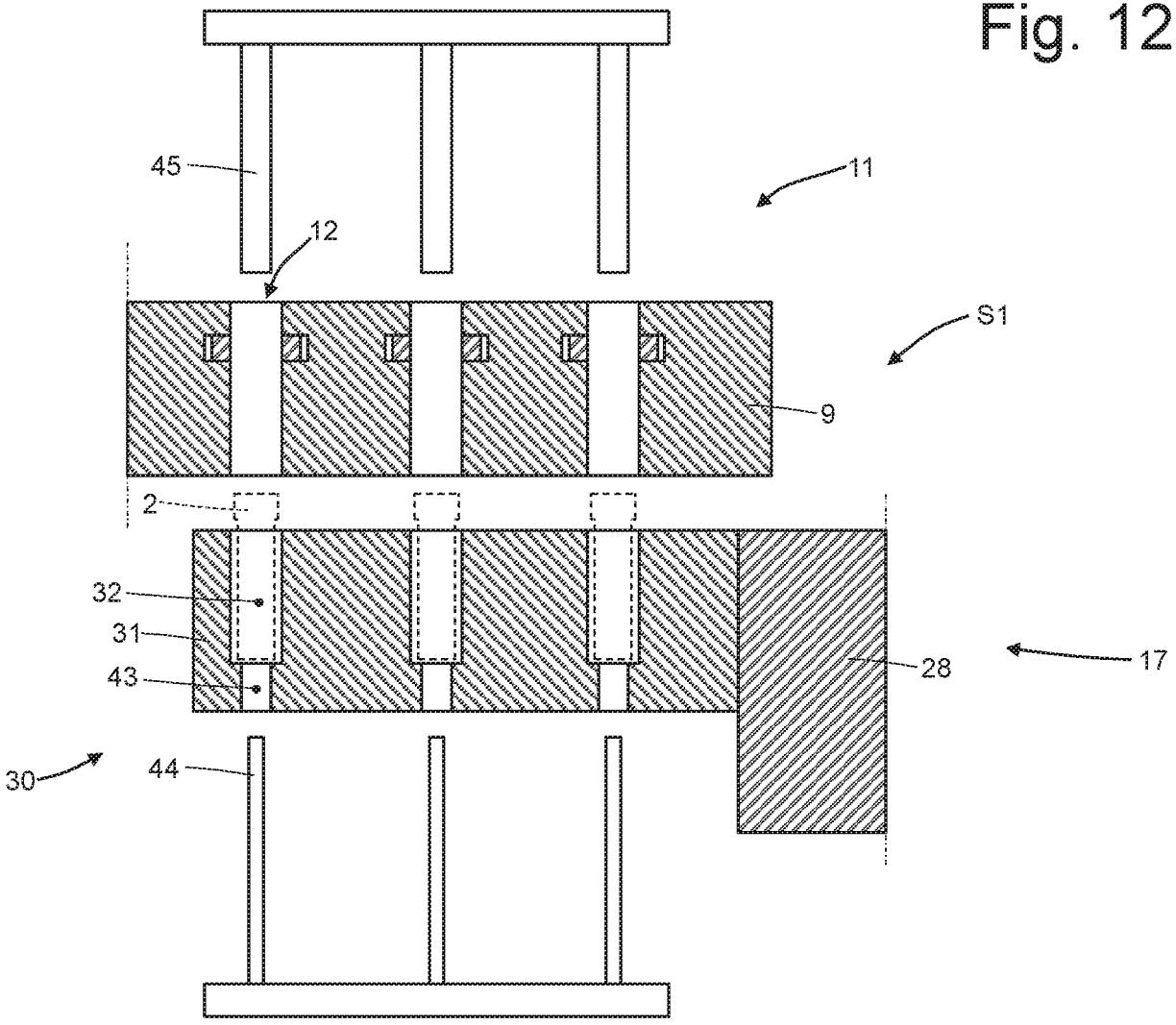
FIG. 12 is a schematic and longitudinal section view of part of the feeding unit of FIG. 7 at an insertion station.

The feeding unit 17 feeds the tubular casings 2 to the seats 12 of a group 11 of seats 12 that is standing still at the feeding unit 17 (i.e. that is standing still in the feeding station S1). As illustrated in FIG. 7, the feeding unit 17 comprises a feeding drum 28 (having a parallelepiped shape) which is mounted in a rotatable stepwise manner around a vertical rotation axis 29 parallel to the rotation axis 10 of the manufacturing drum 9; the feeding drum 28 supports two groups 30 of opposite fingers 31 (i.e. the two groups 30 are arranged on opposite sides of the rotation axis 28). Each group 30 comprises fourteen fingers 31 which are parallel and next to one another and each finger 31 has three seats 32, each adapted to receive a corresponding tubular casing 2 (as better illustrated in FIGS. 8 and 9); it is important to note that the number of seats 32 of each finger 31 is equal to the number of lines of each group 11 of seats 12 of the manufacturing drum 9. As illustrated in FIGS. 10, 11 and 12, each second seat 32 is formed by a blind hole (obtained inside the corresponding finger 31) having a bottom wall on which a corresponding tubular casing 2 rests.

As illustrated in FIG. 7, each group 30 of fingers 31 is adapted to receive corresponding tubular casings 2 (in particular forty-two tubular casings 2) in an insertion station S8 and is adapted to release the tubular casings 2 (in particular forty-two tubular casings 2) to the group 11 of seats 12 of the manufacturing drum 9 that is standing still in the feeding station S1. Furthermore, each finger 31 is mounted on the feeding drum 28 so as to translate relative to the feeding drum 28 along a spacing direction D1 perpendicular to the rotation axis 29 so as to move away from or closer to the adjacent fingers 31. The feeding drum 28 is provided with an actuator device 33 which translates the fingers 31 along the spacing direction D1 so as to arrange the fingers 31 at a first mutual distance in the insertion station S8 and at a second mutual distance, which is different from the first mutual distance, in the feeding station S1; in the embodiment illustrated in the attached figures, the second mutual distance is greater than the first mutual distance.

In the embodiment illustrated in the attached figures, the fingers 31 of each group 30 move relative to one another by means of a translation along the spacing direction D1; according to a different and perfectly equivalent embodiment not illustrated, the fingers 31 of each group 30 move relative to one another by means of a roto-translation or by means of a rotation which has a component along the spacing direction D1.

Figure 8:
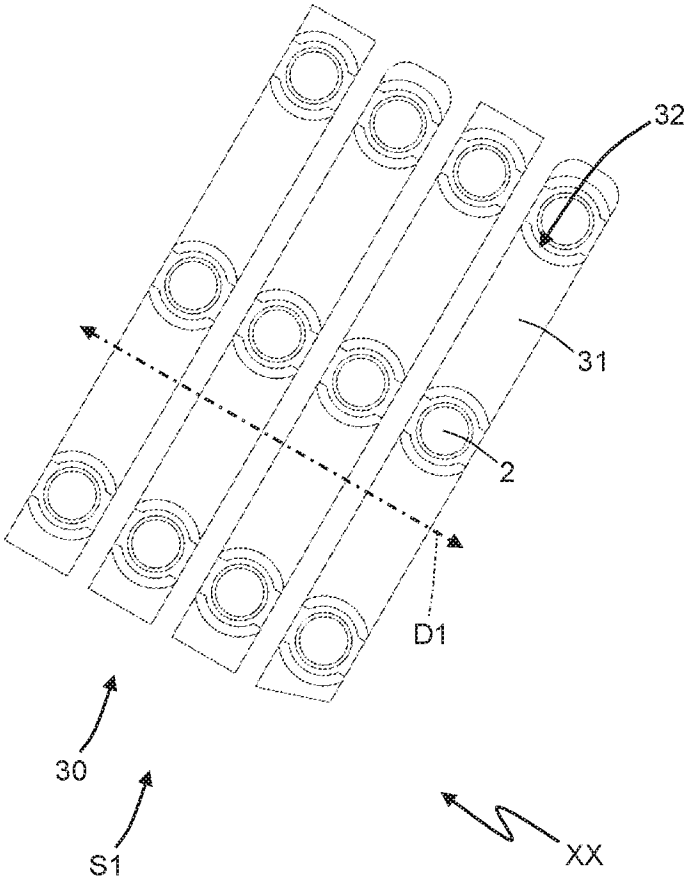

The function of the actuator device 33 is to modify the pitch (i.e. the mutual distance) between the tubular casings 2 which, in the embodiment illustrated in the attached figures, have a 9.5 mm pitch in the insertion station S8 and have a 12 mm pitch in the feeding station S1. The increase in the pitch (i.e. the mutual distance) between the tubular casings 2 is clearly visible in FIGS. 8 and 9 showing the fingers 31 (carrying the seats 32) in the feeding station S1 (FIG. 9, pitch equal to 12 mm) and in the insertion station S8 (FIG. 8, pitch equal to 9.5 mm). According to a preferred embodiment, the actuator device 33 is a passive one (i.e. it has no sources which autonomously generate a movement) and uses cams which move the fingers 31 by using the rotation movement of the feeding drum 28 around the rotation axis 29; according to a preferred, but non-binding, embodiment, the cam actuator device 33 is of the desmodromic type devoid of elastic elements, i.e. the translation movement of the fingers 31 is always impressed by cams which move the fingers 31 in both directions without using elastic thrust.

It is important to note that, according to different embodiments equivalent to one another, the actuator device 33 can translate the fingers 31 of each group 30 into the feeding station S1 (when the feeding drum 28 is standing still), in the insertion station S8 (when the feeding drum 28 is standing still) or in the path between the feeding station S1 and the insertion station S8 (when the feeding drum 28 is moving). Obviously, if the actuator device 33 comprises a motor (typically electric), then the actuator device 33 is able to translate the fingers 31 of each group 30 even when the feeding drum 28 is standing still; on the other hand, if the actuator device 33 comprises cams which exploit the rotary movement of the feeding drum 28, then the actuator device 33 is able to translate the fingers 31 of each group 30 only when the feeding drum 28 is moving.

As illustrated in FIG. 7, the feeding unit 17 comprises three conveying channels 34 which are inclined downwards (but may also be horizontal) and feed three respective rows of tubular casings 2 towards the insertion station S8; as is clear in FIG. 7, in the feeding station S8 each conveying channel 34 is coupled (aligned) to a corresponding seat 32 in each finger 31. As better illustrated in FIGS. 10 and 11, each conveying channel 34 is laterally delimited by corresponding sides 35 (which can be doubled as illustrated in the attached figures, single, or triple) and is delimited, at the bottom, by a support plane 36. The conveying channels 34 can feed the respective rows of tubular casings 2 solely by gravity (by exploiting the downward inclination) or by adding compressed air blowers (blower air conveyor) or vibrations (vibrating conveyor); alternatively, other configurations of the conveying channels 34 are also possible with the only constraint that the conveying channels 34 feed the respective rows of tubular casings 2 towards the insertion station S8.

As illustrated in FIG. 7, the feeding unit 17 also comprises an accompanying element 37 which has three parallel prongs, each of which is coupled to a corresponding conveying channel 34; in particular, the accompanying element 37 is movable within the conveying channels 34 and parallel to the conveying channels 34 to accompany the progressive descent of the tubular casings 2 inside the insertion station S8. Moreover, the feeding unit 17 comprises a gate 38 which is coupled to the conveying channels 34, is arranged immediately upstream of the insertion station S8 (i.e. delimits the beginning of the insertion station S8) and is movable between an opening position, in which it allows the tubular casings 2 to enter the insertion station S8 and a closing position which prevents the tubular casings 2 from entering the insertion station S8.

In use, when the insertion station S8 is full (i.e. when in the insertion station S8, there are forty-two tubular casings 2 arranged in three rows of fourteen tubular casings 2 in the three conveying channels 34 as illustrated in FIG. 7), the gate 38 it is closed (i.e. it is arranged in the closing position) so as to "isolate" the segments of the conveying channels 34 comprised in the insertion station S8 from the remaining parts of the conveying channels 34 and then the forty-two tubular casings 2 present in the insertion station S8 are transferred (with the methods described in the following) from the conveying channels 34 to the seats 32 of the fingers 31 of a group 30 that is standing still in the insertion station S8. When the forty-two tubular casings present in the insertion station S8 have been transferred from the conveying channels 34 to the seats 32 of the fingers 31 of a group 30 that is standing still in the insertion station S8, the insertion station S8 is empty (i.e. completely devoid of tubular casings 2); at this point, the prongs of the accompanying device 37 are fed along the conveying channels 34 until reaching the gate 38 and therefore the gate 38 is opened (i.e. is arranged in the opening position) so as to allow the tubular casings 2 to enter the insertion station S8 again sliding by gravity along the three conveying channels 34; the descent of the tubular casings 2 along the three conveying channels 34 and in the insertion station S8 is not free (i.e. uncontrolled) but is controlled by the three prongs of the accompanying element 37 which rest on the corresponding first three tubular casings 2 to accompany, at a controlled and predetermined rate, the descent of the first three tubular casings 2 (followed by the other tubular casings 2) along the three conveying channels 34. Due to the action of the accompanying element 37, the tubular casings 2 are never "abandoned" and therefore have no possibility of "tilting" inside the conveying channels 34.

According to a preferred embodiment, the gate 38 comprises, for each conveying channel 34, a corresponding wedge-shaped stopping element which is inserted (in the closing position) between two successive tubular casings 2 to prevent further advancement of the tubular casing 2 arranged upstream along the conveying channel 34.

As illustrated in FIGS. 10 and 11, in the insertion station S8 the seats 32 of the fingers 31 are aligned with the corresponding conveying channels 34 and are arranged under the corresponding conveying channels 34 so that each tubular casing 2 carried by a conveying channel 34 is vertically aligned with a corresponding seat 32 of the fingers 31. As previously said, the conveying channels 34 comprise a support plane 36 on which the tubular casings 2 rest. In the insertion station S8, the support plane 36 has a plurality of through-holes 39, each of which is adapted to allow the passage of a tubular casing 2; moreover, the support plane 36, at least in the insertion station S8, is movable (under the thrust of an actuator device 40) between a filling position (illustrated in FIG. 10) in which the through-holes 39 are not aligned with respect to the corresponding conveying channels 34 so as to prevent the passage of the tubular casings 2 through the through-holes 39 (i.e. so as to misalign the through-holes 39 relative to the tubular casings 2 contained in the conveying channels 34) and a transfer position (illustrated in FIG. 11) in which the through-holes 39 are aligned with the corresponding conveying channels 34 so as to allow the passage of the tubular casings 2 through the through-holes 39 (i.e. to align the through-holes 39 relative to the tubular casings 2 contained in the conveying channels 34). In particular, the actuator device 40 moves the support plane 36 between the filling position (illustrated in FIG. 10) and the transfer position (illustrated in FIG. 11) by translating the support plane 36 along a control direction D2 which is perpendicular to the spacing direction D1, is perpendicular to the rotation axis 29, and is perpendicular to the conveying channels 34.

According to a possible embodiment, the through-holes 39 are not separated from one another, and, together form a single slot (i.e. a single large through-hole 39 which has an elongated shape).

As illustrated in FIGS. 10 and 11, the feeding unit 17 comprises a group of (forty-two) pushers 41 which are arranged in the insertion station S8 and are movable in a vertical manner for pushing the tubular casings 2 from the conveying channel 34 to the seats 32 of the fingers 31 of a group 30 that is standing still in the insertion station S8; furthermore, the feeding unit 17 comprises a group of (forty-two) accompanying elements 42 which are opposite to the pushers 41 and are movable in a vertical manner so as to be inserted into the seats 32 of the fingers 31 of a group 30 that is standing still in the insertion station S8 and to accompany the descent of the tubular casings 2 from the conveying channel 34 to the seats 32 of the fingers 31. Each seat 32 of the fingers 31 has, at the bottom, a through-hole 43 (small enough to prevent the entry of a tubular casing) through which an accompanying element 42 can enter the seat 32 from below.

In other words, in the insertion station S8, each tubular casing 2 is transferred by a conveying channel 34 (passing through a through-hole 39 of the support plane 36) to the underlying seat 32 of a finger 31 of a group 30 that is standing still in the insertion station S8 thus performing a vertical downward movement during which the tubular casing 2 is engaged, at the top, by a pusher 41 and at the bottom by an accompanying device 42 (i.e. being "pinched" between a pusher 41 arranged at the top and by an accompanying element 42 arranged at the bottom). In this regard, it is important to note that pushers 41 and the accompanying elements 42 would not be strictly necessary, since the vertical downward movement would in any case be impressed onto the tubular casings 2 by the force of gravity; however, the presence of the pushers 41 and of the accompanying elements 42 allows to impart a controlled movement to the tubular casings 2 which prevents any incorrect positioning or bouncing of the tubular casings 2.

As illustrated in FIG. 12, the seats 32 of the fingers 31 of a group 30 that is standing still in the feeding station S1 are aligned with the corresponding seats 12 of a group 11 that is standing still in the feeding station S1 so that each tubular casing 2 carried by a seat 32 of the fingers 31 is vertically aligned with a corresponding seat 12 of the manufacturing drum 9. As illustrated in FIG. 12, the feeding unit 17 comprises a group of (forty-two) pushers 44 which are arranged in the feeding station S1 and are movable in a vertical manner to be inserted (by means of the through-holes 43) inside the seats 32 of the fingers 31 of a group 30 that is standing still in the feeding station S1 thus pushing the tubular casings 2 from the seats 32 of the fingers 31 to the seats 12 of a group 11 that is standing still in the feeding station S1; moreover, the feeding unit 17 comprises a group of (forty-two) accompanying elements 45 which are opposite to the pushers 44 and are movable in a vertical manner to accompany the ascent of the tubular casings 2 from the seats 32 of the fingers 31 to the seats 12 of the manufacturing drum 9. As previously stated, each seat 32 of the fingers 31 has a through-hole 43 (small enough to prevent the entry of a tubular casing 2) in the lower part, through which a pusher 44 can enter into the seat 32 from below.

In other words, in the feeding station S1 each tubular casing 2 is transferred from a seat 32 of a finger 31 of a group 30 that is standing still in the feeding station S1 to the overlying seat 12 of a group 11 that is standing still in the feeding station S1 by performing a vertical upward movement during which the tubular casing 2 is engaged at the bottom by a pusher 44 and, at the top, by an accompanying element 45 (i.e. being "pinched" between a pusher 44 arranged at the bottom and by an accompanying element 45 arranged at the top). In this regard it is important to note that accompanying elements 45 would not be strictly necessary; however, the presence of the accompanying elements 45 allows to impart a controlled movement to the tubular casings 2 which prevents any incorrect positioning or bouncing of the tubular casings 2.

As previously stated, each seat 12 of the manufacturing drum 9 comprises a housing through channel 24 which crosses the manufacturing drum 9 from side-to-side and is adapted to contain a tubular casing 2 and a pair of opposite jaws 25, which are fitted into the housing channel 24 and are movable between a gripping position, in which they engage a tubular casing 2 arranged in the housing channel 24 and a transfer position, in which they do not engage a tubular casing 2 arranged in the housing channel 24. During the entering of a tubular casing 2 into a corresponding seat 12 of the manufacturing drum 9, the two jaws 25 are kept in the transfer position and then, only when the entering of tubular casing 2 into the seat 12 has been completed, the two jaws 25 are brought into the gripping position.

Each filling unit 18 is similar, in its general structure, to the filling unit described and illustrated in the patent applications WO2017051348A1, WO2017051349A1 and WO2017051350A1 to which we refer for a more detailed description of the filling unit 18.

Figure 13:
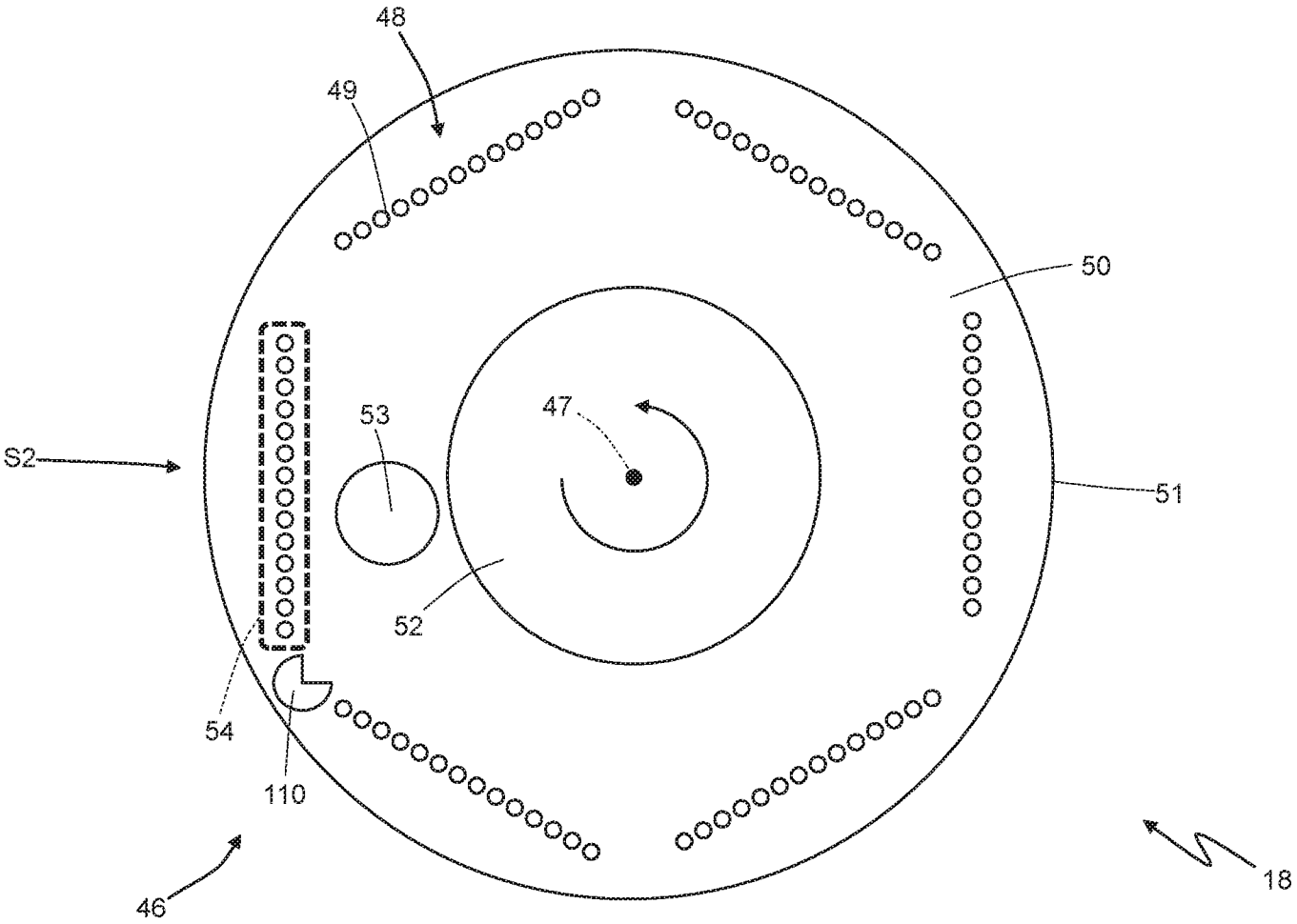
FIG. 13 is a schematic plan view of a filling unit of the manufacturing machine of FIG. 2.
Figure 14:
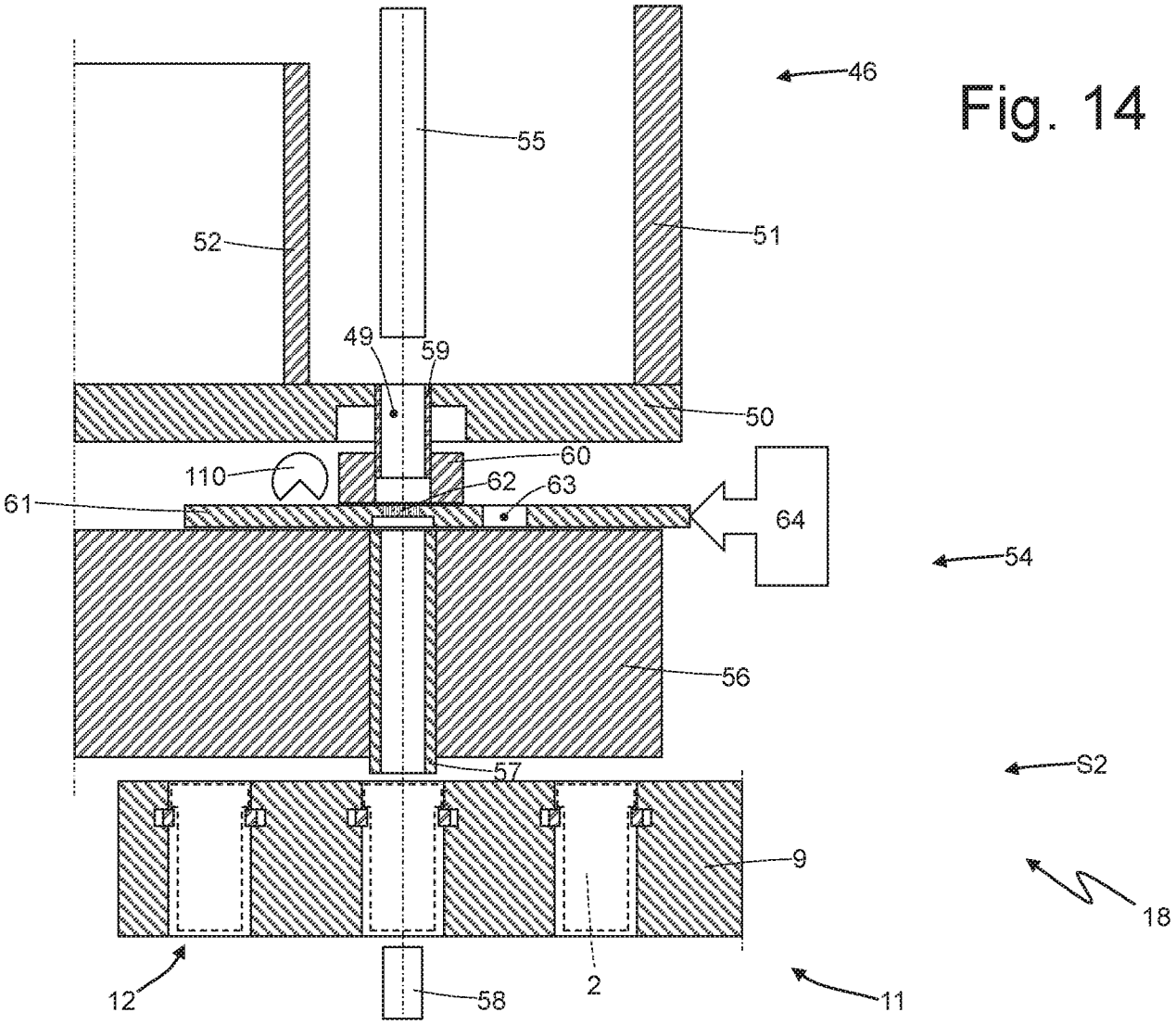
FIG. 14 is a schematic and longitudinal section view of part of the filling unit of FIG. 13.

As illustrated in FIG. 13, each filling unit 18 comprises a cylindrical-shaped tank 46 which is arranged horizontally and is mounted in a rotatable stepwise manner around a vertical rotation axis 47 parallel to the rotation axis 10; in other words, the tank 46 is set into rotation with an intermittent motion, i.e. a non-continuous motion which provides a cyclical alternation of steps of motion, wherein the tank 46 is moving, and still steps, wherein the tank 46 stops. Each tank 46 is arranged beside the manufacturing drum 9 and partially overlapping the manufacturing drum 9 at the filling station S2; in particular, the tank 46 is arranged higher than the manufacturing drum 9 so as to be on top of the manufacturing drum 9 at the filling station S2 (as illustrated in FIG. 14). Each tank 46 supports six groups 48 of seats 49, each of which is adapted to receive and contain a corresponding quantity 5 of tobacco; in particular, each group 48 comprises fourteen seats 49 aligned along a straight line and the six groups 48 are arranged to define, in plan, a regular polygon (i.e. a hexagon) on the surface of the annular tank 46.

Each tank 46 is delimited at the bottom by a base disc 50 having a circular shape and is delimited, on the sides, by a cylindrical side wall 51 which projects perpendicular from the base disc 50; the seats 49 are obtained in the base disc 50, i.e. they are (partially) formed by circular through-holes made through the base disc 50. Centrally, from the base disc 50, a cylindrical central element 52 rises, which gives an annular shape (i.e. a "donut" shape) to the inner volume of the tank 46.

Each tank 46 is coupled to a cylindrical feeding duct 53 which is oriented in a vertical manner (at least in its end portion) and has an outlet opening arranged inside the tank 46; the feeding duct 53 continuously feeds, inside the tank 46, a flow of tobacco which forms a bed resting on the base disc 50 of the tank 46.

Each filling unit 18 comprises a transfer device 54 which is arranged in a fixed position (i.e. without rotating together with the tank 46) at the filling station S2 and cyclically transfers the quantities 5 of tobacco contained in the seats 49 of a group 48 that is standing still in the filling station S2 into corresponding seats 12 of a group 11 that is standing still in the filling station S2 of the manufacturing drum 9. As illustrated in FIG. 14, in each filling station S2, the tank 46 (i.e. the base disc 50 of the tank 46) is partially overlapping the manufacturing drum 9 so that the seats 49 of a group 48 of the tank 46 are vertically aligned and arranged above the seats 12 of a group 11 of the manufacturing drum 9; consequently, in each filling station S2 the transfer of the quantities 5 of tobacco takes place by means of a linear and vertical downward movement (i.e. a descent of the quantities 5 of tobacco). Each transfer device 54 comprises a plurality of pushers 55, each of which is coupled to a corresponding seat 49 of a group 48 that is standing still in the filling station S2 and is provided with an alternating vertical motion for pushing the quantity 5 of tobacco contained in the corresponding seat 49 downwards, i.e. towards a corresponding tubular casing 2 that is standing still.

As illustrated in FIG. 14, under the base disc 50, a further intermediate disc 56 is arranged, which is interposed between the base disc 50 and the manufacturing drum 9 (i.e. between the seats 49 containing the quantities 5 of tobacco and the seats 12 containing the tubular casings 2); through the intermediate disc 56 groups of through-holes are formed, which are internally lined by means of respective feeding ducts 57 which protrude downwardly towards the outside of the intermediate disc 56. In use, each tubular casing 2, which is housed in a seat 12 of the manufacturing drum 9 and that is standing still in the corresponding filling station S2, is pushed upwards (i.e. towards the intermediate disc 56) by a pusher 58 so as to bring its upper open end in contact with the mouth of the respective feeding duct 57. According to a possible embodiment, the outlet mouth of each feeding duct 57 can be funnel-shaped (i.e. a truncated-conical shape). According to a possible embodiment, the outlet mouth of each feeding duct 57 can be inserted partially inside the open upper end of a corresponding tubular casing 2 when the tubular casing 2 is pushed upward (i.e. towards the intermediate disc 56) by the corresponding pusher 58.

According to a preferred embodiment illustrated in FIG. 14, each seat 49 has a variable axial size (therefore a variable volume) due to a telescopic mechanism: each seat 49 is formed by a through-hole made through the base disc 50 which is lined by means of a tubular liner 59 and by a further tubular liner 60 which is partially arranged around the tubular liner 59 and can slide relative to the tubular liner 59. In use, the tubular liners 60 (together with the underlying intermediate disc 56) can axially slide so as to vary the overall volume of the seats 49.

Immediately below each group 48 of seats 49 a shutter element 61 is arranged, which is provided, for each seat 49, with a plug 62 which is permeable to air (but not to tobacco) and with a through-hole 63 arranged beside the plug 62. Each shutter element 61 is movably mounted so as to move radially under the thrust of an actuator device 64, between a closing position (illustrated in FIG. 14) in which a corresponding plug 62 is arranged below each seat 49 for closing the seat 49 at the bottom and prevent the descent of the tobacco and an opening position, in which a corresponding through-hole 63 is arranged below each seat 49 so as so as to allow the descent of the tobacco. In use, the actuator device 64 keeps each shutter element 61 in the closing position (illustrated in FIG. 14) outside of the filling station S2 and moves the shutter element 61 to the opening position inside the filling station S2 so as to allow the descent of the quantity 5 of tobacco from the seat 49 towards a corresponding tubular casing 2 carried by a seat 12 of the manufacturing drum 9.

In the illustrated embodiment, each plug 62 is permeable to air (but not to tobacco) so as to allow a bottom suction to be applied to the seats 49, which tends to favor the entering of the tobacco into the seats 49; in particular, each plug 62 is permeable to air due to the presence of a plurality of through-holes of a size smaller than the size of the tobacco fibers so that air can pass through said through-holes but not tobacco. In use, during the formation of the quantities 5 of tobacco (i.e. on the outside of the filling station S2) a suction source is connected to the feeding ducts 57, so as to generate a depression inside the feeding ducts 57 that, through the plugs 62 which are permeable to air, is also provided inside the seats 49, thus favoring the entering of the tobacco into the seats 49.

According to a different embodiment, not illustrated, each plug 62 is completely sealed (i.e. it is not permeable to air nor to tobacco).

According to a preferred embodiment, the actuator device 64 controls the sliding of the shutter elements 61 (there is a shutter element 61 for each group 48 of seats 49) independently of the rotation of the tank 46 around the rotation axis 47; in this way it is possible to rotate the tank 46 around the rotation axis 47 without letting the quantities 5 of tobacco descend towards the tubular casings 2 in the corresponding filling station S2. Said possibility (i.e. the rotation of the tank 46 around the rotation axis 47 without the descent of the quantities 5 of tobacco) is used when the manufacturing machine 8 is started, following a stop, so as to allow the formation of an uniform tobacco bed and with an adequate thickness inside the tank 46 before letting the quantities 5 of tobacco descend and when the manufacturing machine 8 is a function and, for some malfunctioning and/or discard, in a filling station S2 there are not (all) of the tubular casings 2.

According to a possible embodiment, the actuator device 64 controls the sliding of the shutter elements 61 so that when the quantities 5 of tobacco are removed from the seats 49 each shutter element 61 (quickly) carries out a succession of strokes between the closing position and the opening position (i.e. opens and closes the seats 49 several times) in order to "shake" the seats 49 and therefore favor the descent of all the tobacco present inside the seats 49.

According to a possible embodiment illustrated in FIGS. 13 and 14, each filling unit 18 comprises a cleaning device 110, which is arranged in a fixed position (i.e. does not rotate with the tank 26) at the filling station S2 so as to perform the cleaning of the air-permeable plugs 62, namely to free the air-permeable plugs 62 from any tobacco residues "stuck" in the through-holes of the plugs 62 before the seats 49 are filled with new quantities 5 of tobacco. In other words, after having emptied the seats 49 of the tank 46 by transferring the corresponding quantities 5 of tobacco from the seats 49 of the tank 46 to the seats 12 of a group 11 that is standing still in the filling station S2 and before starting again the filling of the seats 49 of the tank 46 with other tobacco in order to reform the quantities 5 of tobacco, the air-permeable plugs 62 are cleaned by means of the cleaning device 110 which eliminates any tobacco residues "stuck" in the through-holes of the air-permeable plugs 62. It is important to note that the cleaning device 110 can clean the air-permeable plugs 62 at each cycle, every group of cycles (for example every 3-5 cycles), or occasionally.

According to a preferred embodiment, the cleaning device 110 aims powerful compressed air jets at the air-permeable plugs 62 to free the through-holes of the air-permeable plugs 62 from any foreign objects; consequently, for each air-permeable plug 62 the cleaning device 110 comprises (at least) a corresponding nozzle which aims a compressed air jet at the plug 62. According to a possible embodiment, the cleaning device 110 is arranged beside the seats 49 in order to act on the air-permeable plugs 62 when the plugs 62 are moved away from the seats 49 by the movement of the shutter element 61; in this embodiment, the air-permeable plugs 62 are cleaned by the cleaning device 110 when they are (relatively) far from the seats 49, i.e. when the seats 49 are opened at the bottom to release the corresponding quantities 5 of tobacco. According to an alternative embodiment, the cleaning device 110 is arranged at the seats 49 to act on the air-permeable plugs 62 when the plugs 62 are coupled to the seats 49; obviously this cleaning is done after having extracted the quantities 5 of tobacco from the seats 49 and before starting the entry of new tobacco into the seats 49.

Figure 16:
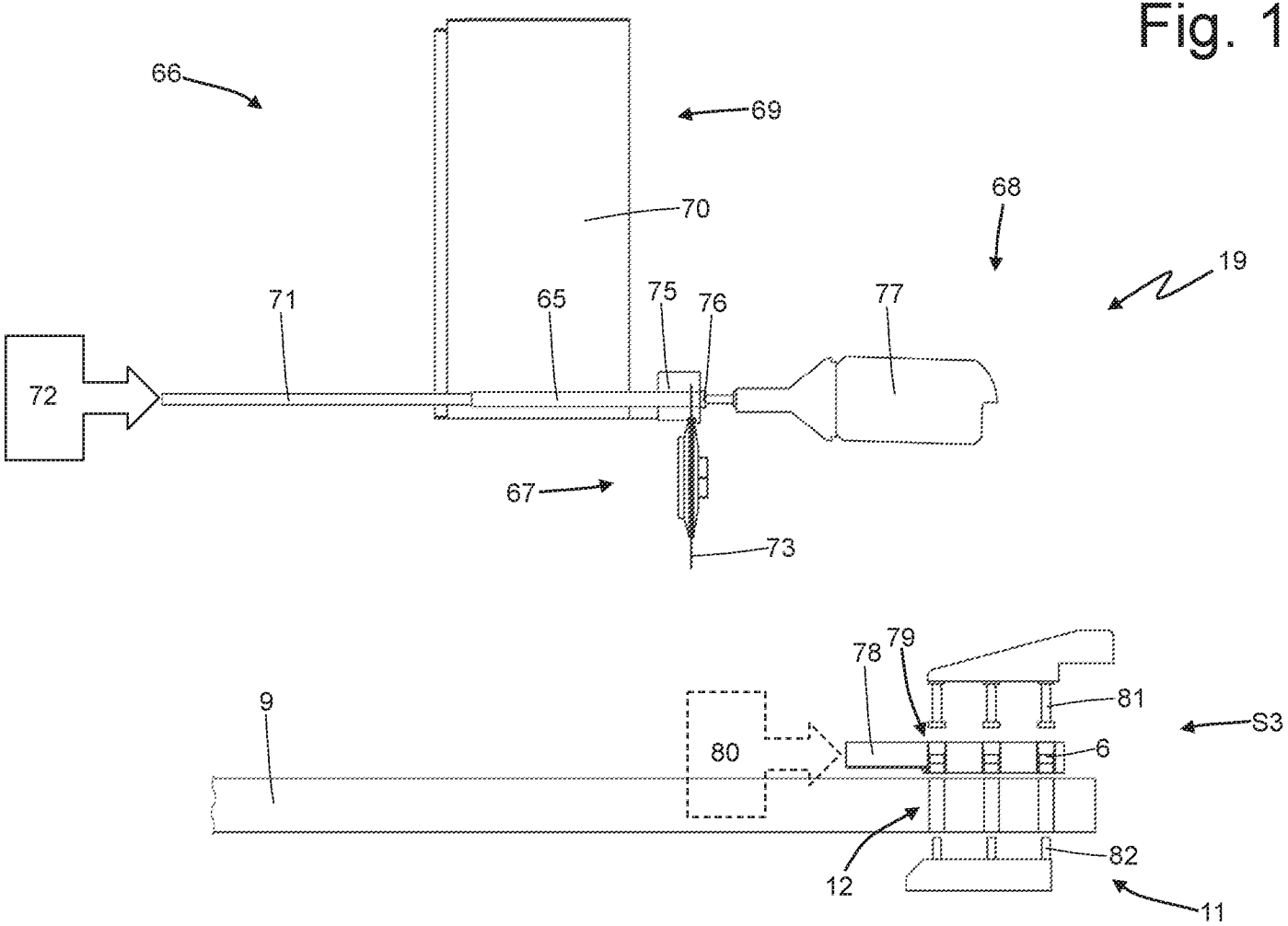
FIGS. 16 and 17 are two schematic side views of the feeding unit of FIG. 15 at two different operating times.
Figure 17:
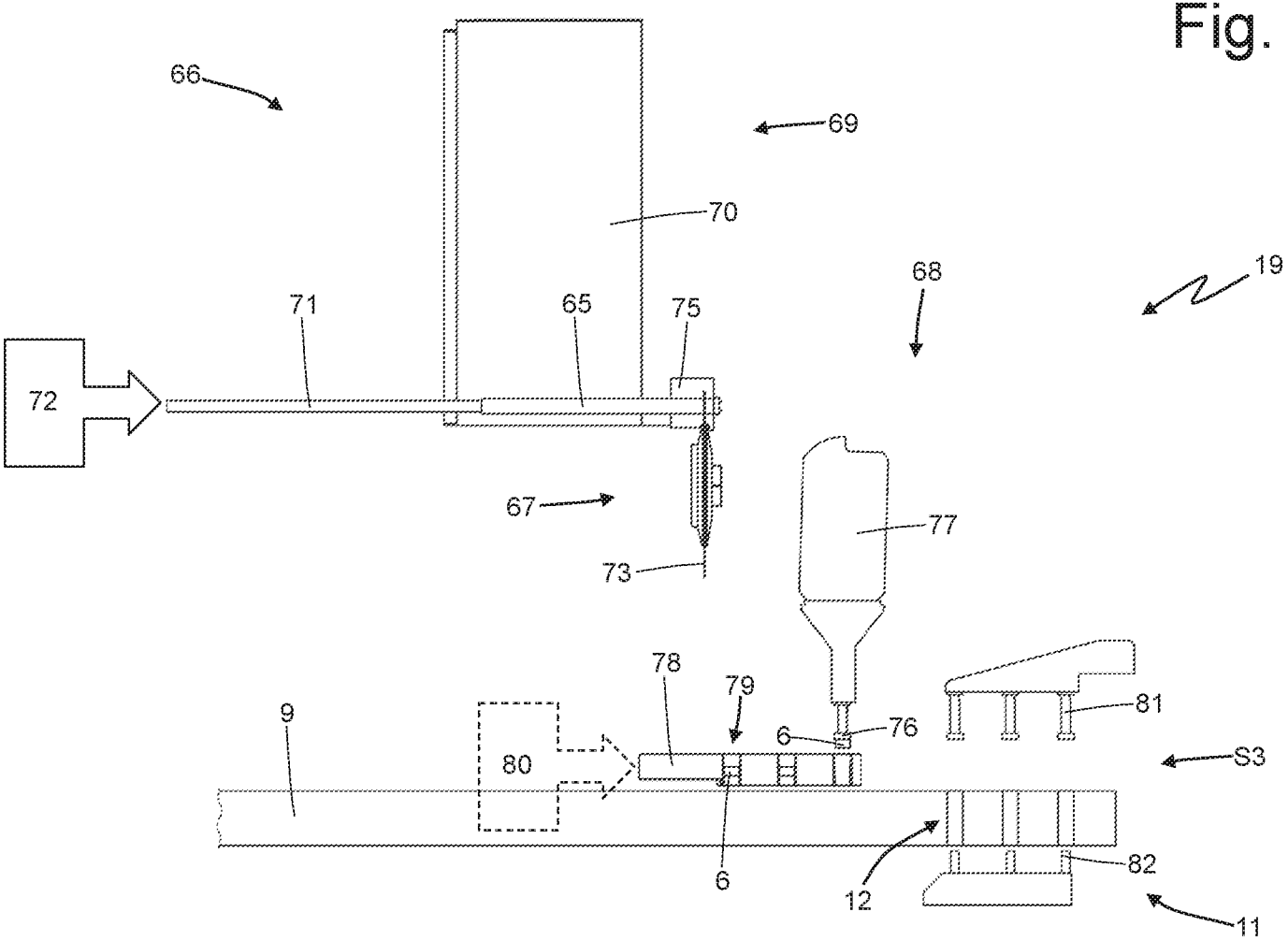

As illustrated in FIGS. 16 and 17, the tabs 6 of filtering material are obtained by means of the transverse cut of corresponding pieces 65 of filtering material; i.e. the pieces 65 of filtering material are "sliced" in order to obtain the tabs 6 of filtering material. In this regard, it is important to note that the axial length of each piece 65 of filtering material is equal to an internal multiple of the axial length of a tab 6 of filtering material; for example, each piece 65 of filtering material could have an axial length of 114 mm and each tab 6 of filtering material has an axial length of 4.75 mm (therefore, from each piece 65 of filtering material, twenty-four tabs 6 of filtering material are obtained).

Figure 15:
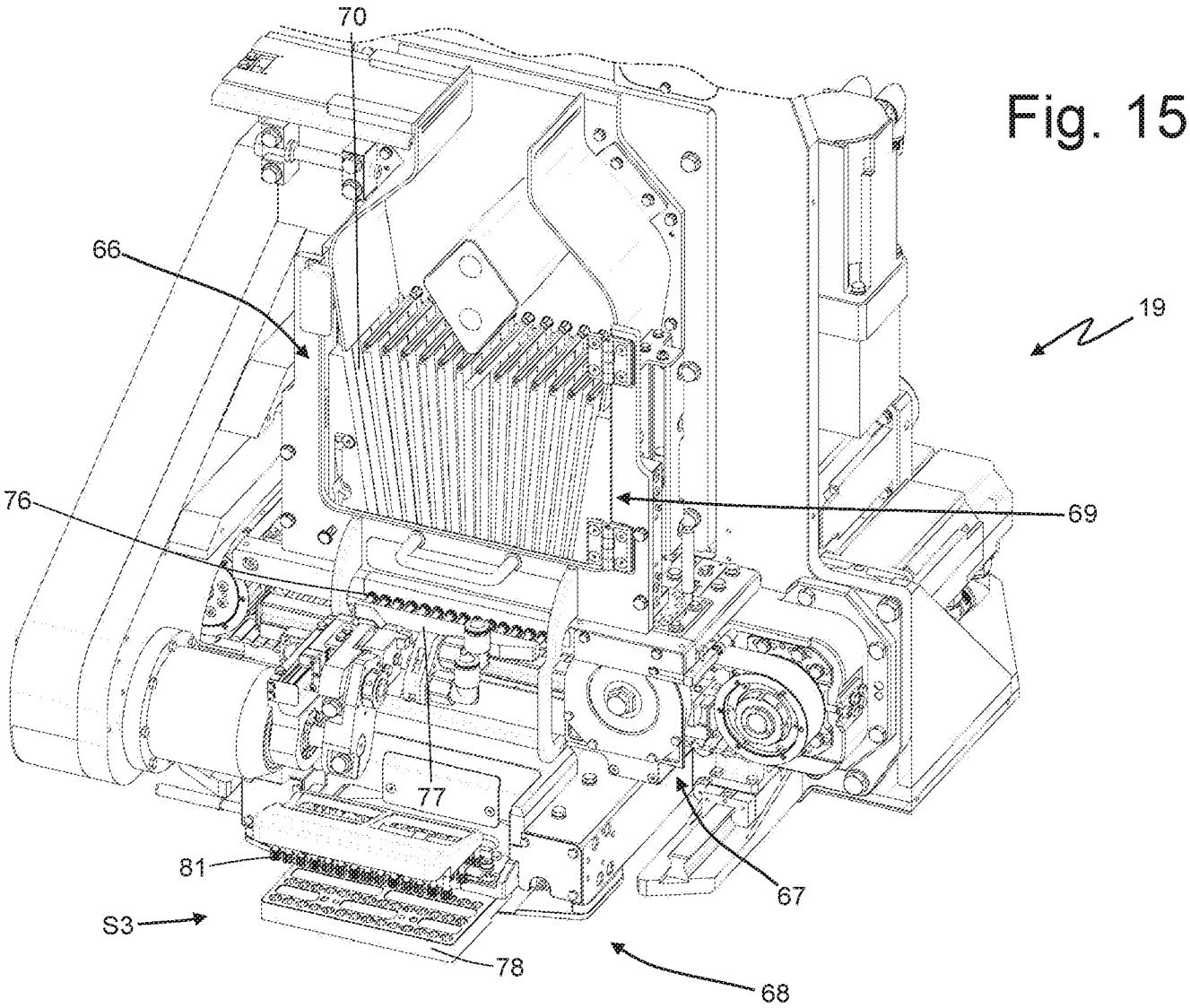
FIG. 15 is a perspective view, and with parts removed for clarity, of a feeding unit of tabs of filtering material of the manufacturing machine of FIG. 2.

The feeding unit 19 (illustrated as a whole in FIG. 15) comprises a supplying device 66 which supplies a group of pieces 65 of filtering material; in the embodiment illustrated in the attached figures, said group comprises fourteen pieces 65 of filtering material, i.e. a number of pieces 65 of filtering material equal to the number of seats 12 in a line of a group 11. Furthermore, the feeding unit 19 comprises a cutting device 67 which cyclically carries out a transverse cut of the group of pieces 65 of filtering material in order to separate a respective group of tabs 6 of filtering material from the group of pieces 65 of filtering material. Finally, the feeding unit 19 comprises a transfer device 68 which picks up the group of tabs 6 of filtering material immediately after the transverse cut and inserts the tabs 6 of filtering material into the corresponding seats 12 of a group 11 that is standing still in the feeding station S3.

The supplying device 66 comprises a hopper 69 (better illustrated in FIG. 18) provided with a group of vertical channels 70 which receive a plurality of pieces 65 of filtering material; along the vertical channels 70 the pieces of filtering material descend by gravity until reaching a lower portion at which the pieces 65 of filtering material are axially extracted from the hopper 69 (i.e. they are axially pushed out of the hopper 69). The supplying device 66 comprises a group of horizontal pushers 71 (only one of which is visible in FIGS. 16 and 17), each engaging a lower portion of a corresponding vertical channel 70 so as to progressively push a piece 65 of filtering material out of the vertical channel 70 and towards the cutting device 67.

According to a preferred embodiment, the pieces 65 of filtering material come from individual distributing devices which are loaded into an upper hopper and then supplied to a deep reaching drum which, by means of a pair of blades mounted on the same axis, removes the end terminals of each filter both for the purpose of obtaining pieces 65 of filtering material of the desired length with a precision of the length higher than the initial one, and of removing the ends which could have dents or wrinkles due to storage and transport. The flow of the trimmed pieces 65 of filtering material is brought to a height and conveyed by means of traditional down-drop inside a vertical chimney which feeds the hopper 69, in which the pieces 65 of filtering material are separated and spaced apart by step to then fall, one row at a time, at the base of the hopper 69 where the horizontal pushers 71 extract the pieces 65 of filtering material.

According to a preferred embodiment, each horizontal pusher 71 has a free end which comes into contact with a corresponding piece 65 of filtering material (i.e. with a base wall of the piece 65 of filtering material opposite to the cutting device 67) and is provided with suction (i.e. is adapted to hold the piece 65 of filtering material by means of suction).

As illustrated in FIGS. 16 and 17, the supplying device 66 comprises an actuator device 72 which imparts to the group of horizontal pusher 71 a work cycle comprising: a first delivery stroke, which brings the pieces 65 of filtering material from the lower portion of the vertical channels 70 to the cutting device 67, a subsequent plurality of second delivery strokes each having a range equal to the axial size of the tab 6 of filtering material, and finally one single return stroke which moves the horizontal pushers 71 away from the cutting device 67 returning the horizontal pushers 71 to the outside of the vertical channels 70. In other words, initially each horizontal pusher 71 is arranged completely outside of the corresponding vertical channel 70 so as to allow the complete descent of a piece 65 of filtering material which then reaches the lower portion of the hopper 69; at this point each horizontal pusher 71 carries out the first delivery stroke during which the horizontal pusher 71 enters the lower portion of the hopper 69 and pushes the piece 65 of filtering material out of the lower portion of the hopper 69 until it reaches the cutting device 67. Once the cutting device 67 has been reached, each horizontal pusher 71 carries out in succession the second delivery strokes in order to allow the cutting device 67 to "slice" the piece 65 of filtering material a little at a time thus obtaining the tabs 6 of filtering material. Once the piece 65 of filtering material has been completely "sliced", each horizontal pusher 71 carries out the return stroke to exit the corresponding vertical channel 70 again, thus allowing the complete descent of a new piece 65 of filtering material and starting the work cycle again.

Preferably, the actuator device 72 comprises its own electric motor which linearly moves the horizontal pushers 71 and individually and independently performs every single second delivery stroke; in this way, the actuator device 72 cannot always make the same error in the length of the second outward strokes and therefore does not "sum" any errors in the length of the second outward strokes, thus preventing the last tabs 6 of filtering material from being excessively thin or excessively thick as they suffer the sum of all errors in the length of the second delivery strokes accomplished in succession during all the second delivery strokes.

Figure 18:
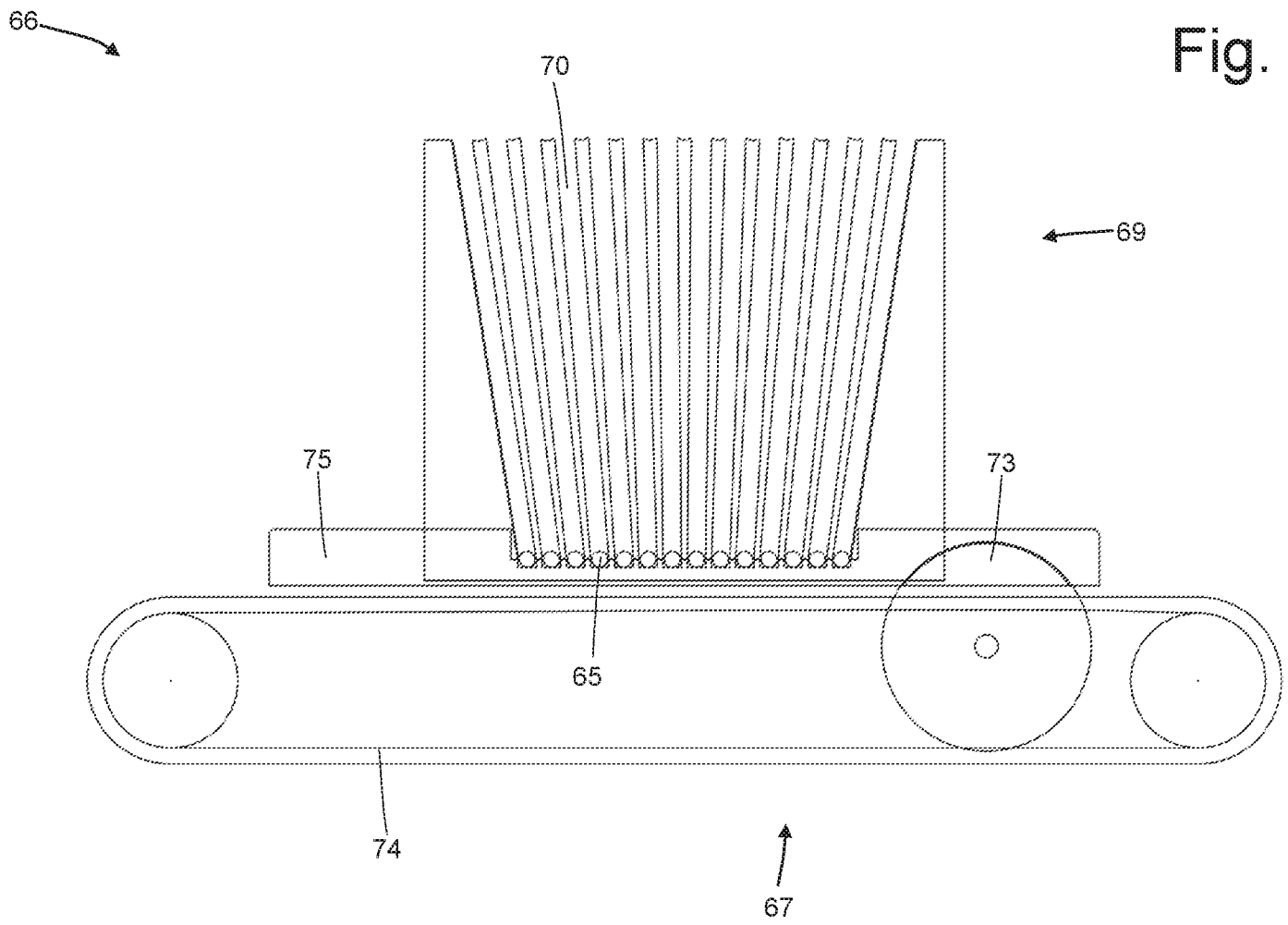
FIG. 18 is a schematic and front view of a hopper and of a cutting device of the feeding unit of FIG. 15.

As illustrated in FIG. 18, the cutting device 67 comprises a rotary blade 73 which is orientated perpendicularly to the pieces 65 of filtering material and is moved forward and backward by a conveyor belt 74; at each stroke of the rotary blade 73 (i.e. at each translation of the blade 73 rotating from one end of the hopper 69 to the opposite end of the hopper 69), the rotary blade 73 carries out the transverse cut of all the pieces 65 of filtering material. The rotary blade 73 operates within an counter element 75 which keeps the pieces 65 of filtering material still and locked during the transverse cut; in particular, the counter element 75 comprises a plurality of cutting channels through which the pieces 65 of filtering material pass with minimal clearance (so that the pieces 65 of filtering material cannot "shake" inside the cutting channels) and a slit open at the bottom through which the rotary blade 73 passes (always with minimal clearance) when it carries out the transverse cut.

According to a preferred embodiment, mechanical safety locks are provided which enable (allow) the opening of the front doors of the hopper 69 (typically for eliminating clogging of the pieces 65 of filtering material) only when the rotary blade 73 (which is very sharp, therefore with highly cutting edges) is arranged all on one side (i.e. outside the area affected by the hopper 69); moreover, further mechanical safety devices are provided which prevent (lock) the displacement of the rotary blade 73 when the front doors of the hopper 69 are open. In this way, an operator when opening the front doors of the hopper 69 is always in safe conditions because it cannot come into contact (even accidentally) with the rotary blade 73.

As illustrated in FIGS. 16 and 17, the transfer device 68 comprises a group of sucking holding heads 76 (only one of which is shown in FIGS. 16 and 17) mounted movable and adapted to engage corresponding tabs 6 of filtering material; obviously the number of holding heads 76 is equal to the number of pieces 65 of filtering material which, as previously said, is equal to the number of seats 12 in a line of a group 11.

Furthermore, the transfer device 68 comprises an actuator device 77 which is adapted to cyclically move each holding head 76 between a gripping position (illustrated in FIG. 16) in which the holding head 76 engages a tab 6 of filtering material at the moment of execution of the transverse cut which separates the tab 6 of filtering material from the corresponding piece 65 of filtering material and a release position (illustrated in FIG. 17) in which the holding head 76 releases a corresponding tab 6 of filtering material. Each holding head 76 can engage a tab 6 of filtering material immediately before or immediately after execution of the transverse cut which separates the tab 6 of filtering material from the corresponding piece 65 of filtering material; in particular, when each holding head 76 engages a tab 6 of filtering material immediately after performing the transverse cut, the holding head 76 is arranged very close to (for example fractions of a millimeter) and, without contact with, the end of the piece 65 of filtering material, before performing the transverse cut, and then "capture" by suction the tab 6 of filtering material by means of suction immediately after the transverse cut. The actuator device 77 comprises an arm, which is mounted movable on a frame of the manufacturing machine 8 to perform a roto-translation movement so as to move between the gripping position (illustrated in FIG. 16) and the release position (illustrated in the FIG. 17).

The transfer device 68 comprises, furthermore, a distributing device 78 which is arranged above the manufacturing drum 9 and is provided with a group of through-delivering channels 79, each crossing the distributing device 78 from side-to-side and adapted to contain a tab 6 of filtering material; the number and the arrangement of the through-delivering channels 79 are the same as the seats 12 of the manufacturing drum 9, therefore forty-two delivering channels 79 are provided, aligned along three straight lines, which are parallel to one another (each of the three straight lines has fourteen delivering channels 79).

Figure 19:
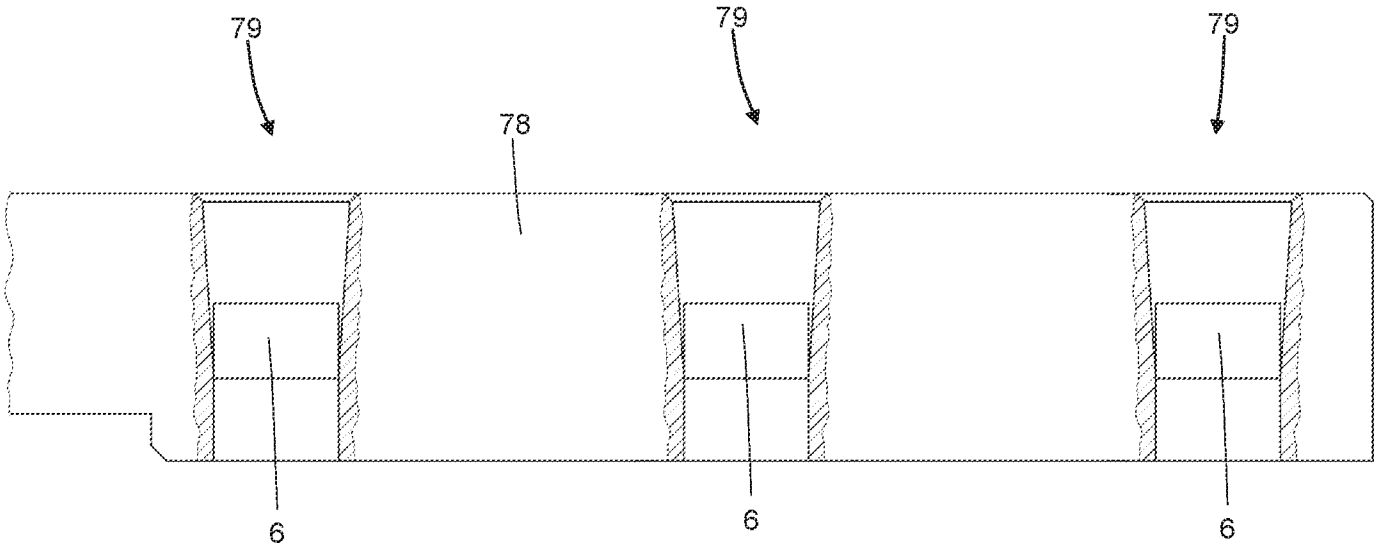
FIG. 19 is a schematic and partially longitudinal section view of a distributing device of the feeding unit of FIG.

As better illustrated in FIG. 19, each delivering channel 79 has an inlet opening (upper, i.e. obtained through an upper wall of the distributing device 78) through which a corresponding tab 6 of filtering material enters the delivering channel 79 and an outlet opening (lower, i.e. obtained through a lower wall of the distributing device 78) which is opposite to the inlet opening and through which a corresponding tab 6 of filtering material exits the delivering channel 79.

According to a preferred embodiment illustrated in FIG. 19, each delivering channel 79 is funnel-shaped, i.e. it has a progressively decreasing cross-section, for transversely compressing a corresponding tab 6 of filtering material during the passage of the tab 6 of filtering material along the delivering channel 79. Accordingly, when a tab 6 of filtering material exits the corresponding delivering channel 79, the tab 6 of filtering material is elastically compressed to have a reduced diameter and therefore being able to easily enter into a corresponding tubular casing 2. The funnel shape of the delivering channels 79 is also used to block the tabs 6 of filtering material inside the delivering channels 79: each holding head 76 inserts a corresponding tab 6 of filtering material inside a delivering channel 79 thus determining a given (elastic) compression of the tab 6 of filtering material and therefore "fitting with interference" the tab 6 of filtering material inside the delivering channel 79; consequently, the tab 6 of filtering material remains still within the delivering channel 79 without the need for any retaining element.

As illustrated in FIGS. 16 and 17, the distributing device 78 is mounted movable; for translating between a receiving position (illustrated in FIG. 17) in which the delivering channels 79 are (relatively) far away from the seats 12 of a group 11 that is standing still in the feeding station S3 and the holding heads 76 insert the tabs 6 of filtering material into the corresponding delivering channels 79, and an insertion position (illustrated in FIG. 16) in which the delivering channels 79 are aligned with the corresponding seats 12 of a group 11 that is standing still in the feeding station S3 so as to insert the tabs 6 of filtering material into the tubular casings 2 carried by the seats 12. In particular, the transfer device 68 comprises an actuator device 80 adapted to cyclically move the distributing device 78 between the receiving position (illustrated in FIG. 17) and the insertion position (illustrated in FIG. 16).

In use, the empty distributing device 78 (i.e. completely devoid of tabs 6 of filtering material) is placed in the receiving position (illustrated in FIG. 17) and therefore the group of holding heads 76 is cyclically moved between the gripping position (illustrated in FIG. 16) in which the holding heads 76 pick-up new tabs 6 of filtering material separated from the corresponding pieces 65 of filtering material and the release position (illustrated in FIG. 17) in which the holding heads 76 release the corresponding tabs 6 of filtering material in the delivering channels 79 of the distributing device 78. In particular, at each insertion cycle the fourteen holding heads 76 insert fourteen tabs 6 of filtering material into fourteen delivering channels 79 which form a line (of three overall lines) of the group of delivering channels 79; consequently, the complete filling of the distributing device 78 requires three successive insertion cycles. According to a preferred embodiment, at the end of an insertion cycle the distributing device 78 is slightly translated by the actuator device 80 in order to arrange a line of fourteen empty delivering channels 79 at the release position (illustrated in FIG. 17) of the holding heads 76; in other words, the holding heads 76 have a single release position (illustrated in FIG. 17) which cannot be modified and therefore the distributing device 78 must be translated each time in order to arrange a line of fourteen empty delivering channels 79 at the release position (illustrated in FIG. 17) of the holding heads 76. To summarize, the actuator device 80 (which is part of the transfer device 68) cyclically moves the distributing device 78 between three distinct receiving positions so as to insert the tabs 6 of filtering material into the delivering channels 79 of three distinct lines of delivering channels 79, respectively.

At the feeding station S3, the transfer device 68 comprises a group of forty-two pushers 81, each aligned in a vertical (longitudinal) manner with a corresponding delivering channel 79 when the distributing device 78 is arranged in the insertion position (illustrated in FIG. 16); in said position, the pushers 81 are movable in a vertical manner (i.e. parallel to the delivering channels 79) to be inserted into the corresponding delivering channels 79 thus pushing the tabs 6 of filtering material out of the delivering channels 79 and then into a corresponding tubular casing 2 carried by the seats 12 of a group 11 that is standing still in the feeding station S3.

According to a preferred embodiment, at the feeding station S3, the transfer device 68 comprises a group of forty-two pushers 82, each opposite to a corresponding pusher 81 (i.e. it is arranged on the opposite side of the corresponding pusher 81 relative to the manufacturing drum 9) and is aligned in a vertical (longitudinal) manner with a corresponding seat 12 of a group 11 that is standing still in the feeding station S3; the pushers 82 are movable in a vertical manner (i.e. parallel to the seats 12) to be inserted inside the seats 12 and to push the tubular casings 2 contained in the seats 12 towards the distributing device 78 and, therefore, towards the corresponding delivering channels 79.

In use, when the distributing device 78 is full, i.e. all the delivering channels 79 of the distributing device 78 contain a corresponding tab 6 of filtering material, the actuator device moves the distributing device 78 into the insertion position (illustrated in FIG. 16) to align the delivering channels 79 with the seats 12 of a group 11 that is standing still in the feeding station S3. At this point, the pushers 82 enter from the bottom into the seats 12 to push the tubular casings 2 carried by the seats 12 towards the distributing device 78 (i.e. substantially in contact with the distributing device 78) while, at the same time, the pushers 81 enter the delivering channels 79 by pushing the corresponding tabs 6 of filtering material out of the delivering channels 79 and therefore into the tubular casings 2. Once the tabs 6 of filtering material have been inserted into the corresponding tubular casings 2, the pushers 81 retract by exiting the delivering channels 79 of the distributing device 78 and the pushers 82 retract by exiting the seat 12; at this point, the manufacturing drum 9 can perform a feed step and the cycle starts again.

Figure 20:
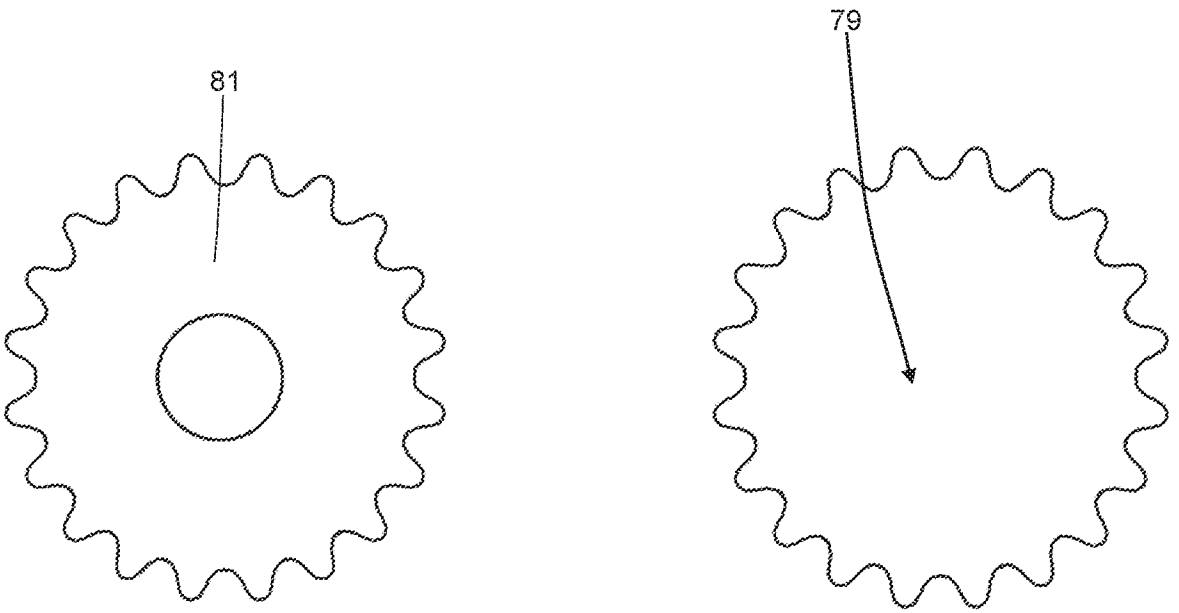
FIG. 20 is a schematic plan view of a pusher and of a corresponding delivering channel of the feeding unit of FIG. 15.

According to a preferred embodiment illustrated in FIG. 20, each delivering channel 79 has an indented (knurled) cross-section and each pusher 81 has a pushing head which has an indented (knurled) cross-section which reproduces, in negative, the indented (knurled) cross-section of the corresponding delivering channel 79. The indented (knurled) shape of the pushers 81 allows the pushers 81 to press not only on the central part of the tabs 6 of filtering material but also, and above all, on the peripheral paper ring which surrounds the central part of the tabs 6 of filtering material; thus avoiding that the pushers 81 tend to extrude the central part of the tabs 6 of filtering material from the peripheral paper ring which surrounds the central part. In other words, the "teeth" of the indentation (knurling) make it possible to maximize the pushing area on the paper to avoid damaging it and the slots between two "teeth" of the indentation (knurling) allow to house the overabundance of paper that is generated in the transverse compression step.

Figure 21:
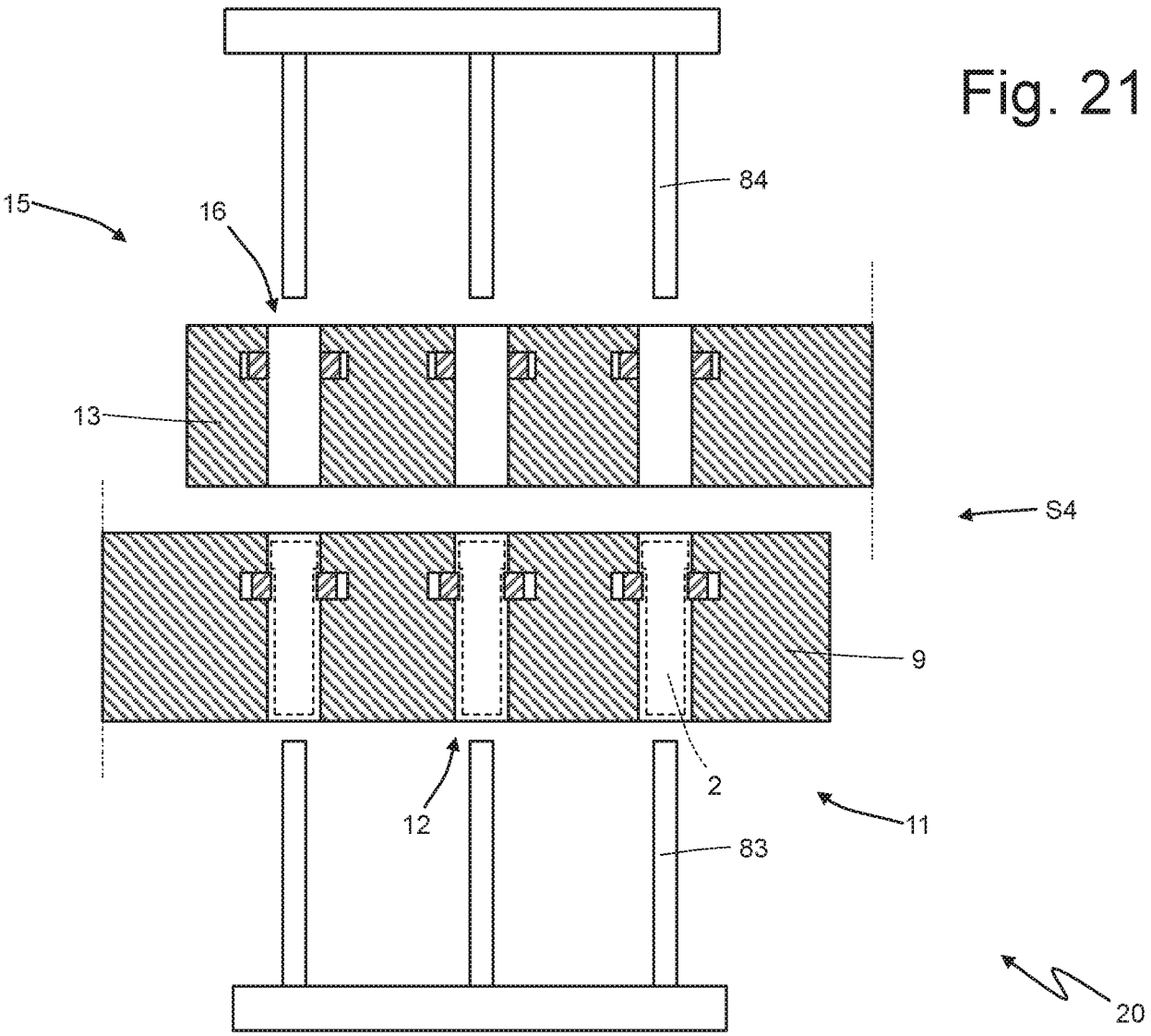
FIG. 21 is a schematic and longitudinal section view of a transfer unit of the manufacturing machine of FIG. 2.

As illustrated in FIG. 21, the seats 12 of a group 11 that is standing still in the transfer station S4 are vertically aligned with the corresponding seats 16 of a group 15 that is standing still in the transfer station S4. The transfer unit comprises a group of (forty-two) pushers 83, which are arranged in the transfer station S4 and are movable in a vertical manner so as to be inserted into the seats 12 of a group 11 that is standing still in the transfer station S4 thus pushing the tubular casings 2 from the seats 12 of a group 11 that is standing still in the transfer station S4 to the seats 16 of a group 15 that is standing still in the transfer station S4; moreover, the transfer unit 20 comprises a group of (forty-two) accompanying elements 84 which are opposite to the pushers 83 and are movable in a vertical manner to accompany the ascent of the tubular casings 2 from the seats 12 of the manufacturing drum 9 to the seats 16 of the manufacturing drum 13.

In other words, in the transfer station S4 each tubular casing 2 is transferred from a seat 12 of a group 11 that is standing still in the transfer station S4 to the overlying seat 16 of a group 15 that is standing still in the transfer station S4 by performing a vertical ascent movement during which the tubular casing 2 is engaged at the bottom by a pusher 83 and at the top by an accompanying element 84 (i.e. by being "pinched" between a pusher 83 arranged at the bottom and by an accompanying element 84 arranged at the top). In this regard it is important to note that the accompanying elements 84 would not be strictly necessary; however, the presence of the accompanying elements 84 allows to impart a controlled movement to the tubular casings 2 which prevents any incorrect positioning or bouncing of the tubular casings 2.

As previously stated, each seat 16 of the manufacturing drum 13 comprises a housing through channel 26 which crosses the manufacturing drum 13 from side-to-side and is adapted to contain a tubular casing 2 and a pair of opposite jaws 27, which are mounted in the housing channel 26 and are movable between a gripping position, in which they engage a tubular casing 2 arranged in the housing channel 26 and a transfer position, in which they do not engage a tubular casing 2 arranged in the housing channel 26. During the entering of a tubular casing 2 into a corresponding seat 16 of the manufacturing drum 13, the two jaws 27 are kept in the transfer position and only when the entering of the tubular casing 2 into the seat 16 has been completed, then, the two jaws 27 are brought into the gripping position.

The feeding unit 21 feeds the sealing rings 7 to the tubular casings 2 carried by the corresponding seats 16 of a group 15 that is standing still at the feeding unit 21 (i.e. that is standing still in the feeding station S5). The feeding unit 21 of the sealing rings 7 is very similar (but not perfectly identical) to the feeding unit 17 of the tubular casings 2 described above.

Figure 22:
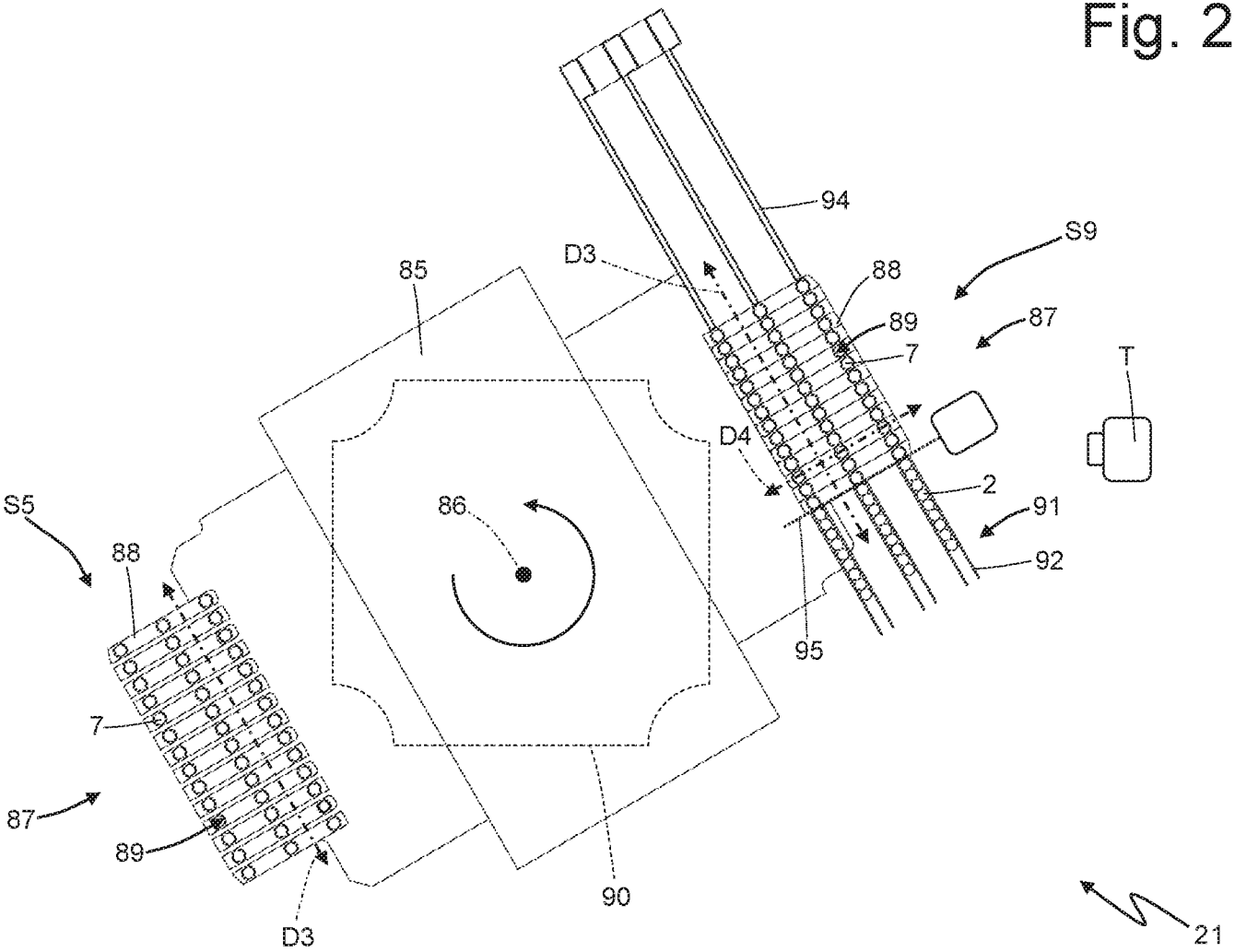
FIG. 22 is a schematic plan view of a feeding unit of the sealing rings of the manufacturing machine of FIG. 2.
Figure 23:
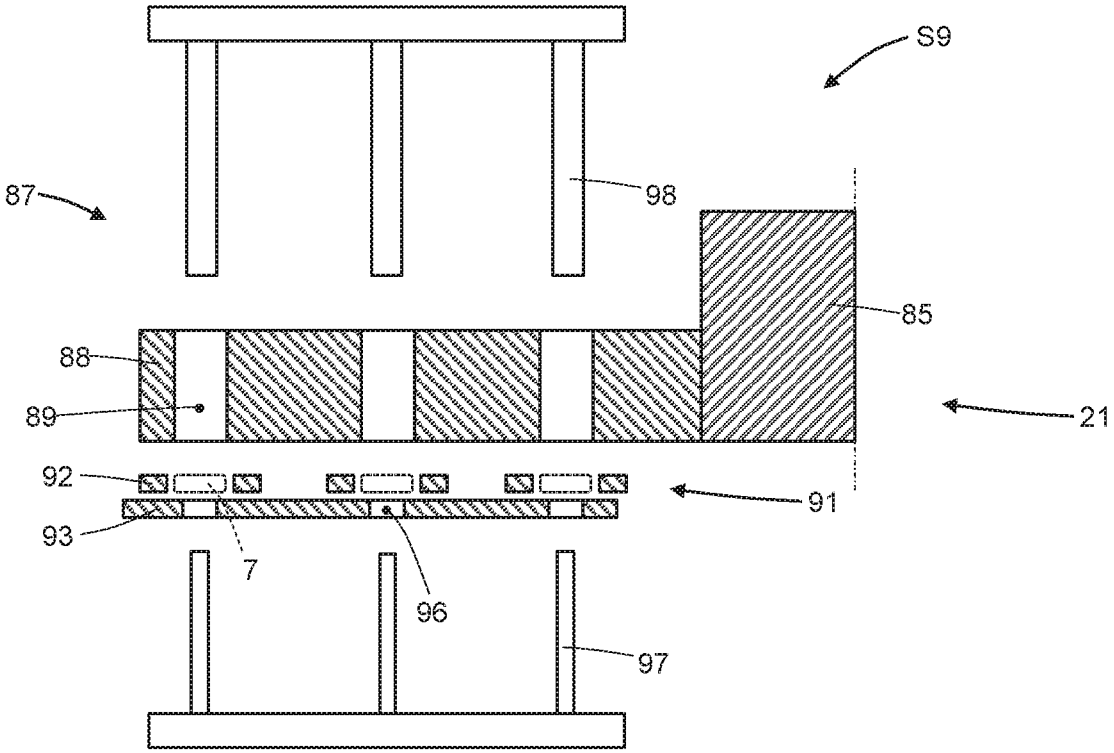
FIG. 23 is a schematic and longitudinal section view of part of the feeding unit of FIG. 22 at an insertion station.
Figure 24:
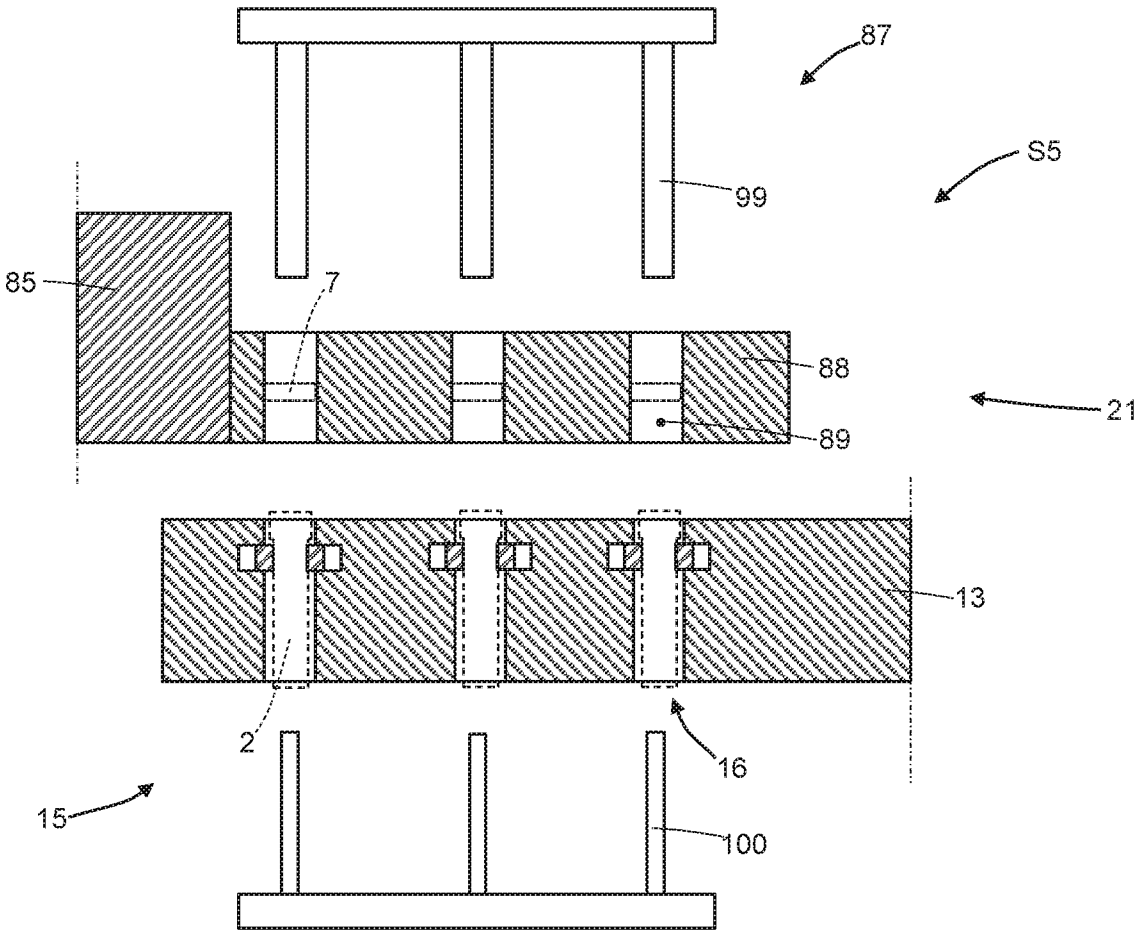
FIG. 24 is a schematic and longitudinal section view of part of the feeding unit of FIG. 22 at a feeding station.

As illustrated in FIG. 22, the feeding unit 21 comprises a feeding drum 85 (having a parallelepiped shape) which is mounted in a rotatable stepwise manner around a rotation axis 86 parallel to the rotation axis 14 of the manufacturing drum 13; the feeding drum 85 supports two groups 87 of opposite fingers 88 (i.e. the two groups 87 are arranged on opposite sides of the rotation axis 85). Each group 87 comprises fourteen fingers 88 which are parallel and next to one another and each finger 88 has three seats 89 each adapted to receive a corresponding sealing ring 7; it is important to note that the number of seats 89 of each finger 88 is equal to the number of lines of each group 15 of seats 16 of the manufacturing drum 13. As illustrated in FIGS. 23 and 24 each seat 89 is formed by a through-hole which is obtained inside the corresponding finger 88, crosses the corresponding finger 88 from side-to-side and is adapted to contain a corresponding sealing ring 7.

Each group 87 of fingers 88 is adapted to receive corresponding sealing rings 7 (in particular forty-two sealing rings 7) in an insertion station S9 and is adapted to release the sealing rings 7 (in particular forty-two sealing rings 7) to the group 15 of seats 16 of the manufacturing drum 13 in the feeding station S5. Furthermore, each finger 88 is mounted on the feeding drum 85 to translate relative to the feeding drum 85 along a spacing direction D3 perpendicular to the rotation axis 86 so as to move away from or closer to the adjacent fingers 88. The feeding drum 85 is provided with an actuator device 90 which moves the fingers 88 along the spacing direction D3 so as to arrange the fingers 88 at a first mutual distance in the insertion station S9 and at a second mutual distance, which is different from the first mutual distance, in the feeding station S5; in the embodiment illustrated in the attached figures, the second mutual distance is greater than the first mutual distance.

In the embodiment illustrated in the attached figures, the fingers 88 of each group 87 move one with respect to the others by means of a translation along the spacing direction D3; according to a different and perfectly equivalent embodiment not illustrated, the fingers 88 of each group 87 move one with respect to the others by a roto-translation or by a rotation which has a component along the spacing direction D3.

The function of the actuator device 90 is to modify the pitch (i.e. the mutual distance) between the sealing rings 7 which, in the embodiment illustrated in the attached figures, have a 9.5 mm pitch in the insertion station S9 and have a 12 mm pitch in the feeding station S5. The increase in the pitch (i.e. the mutual distance) between the sealing rings 7 is clearly visible in FIG. 22 which show the fingers 88 (carrying the seats 89) in the feeding station S5 (pitch equal to 12 mm) and in the insertion station S9 (pitch equal to 9.5 mm). According to a preferred embodiment, the actuator device is a passive one (i.e. it has no sources which autonomously generate a movement) and uses cams which move the fingers 88 by using the rotation movement of the feeding drum 85 around the rotation axis 86; according to a preferred, but non-binding, embodiment, the cam actuator device 90 is of the desmodromic type devoid of elastic elements, i.e. the translation movement of the fingers 88 is always impressed by cams which move the fingers 88 in both directions without using elastic thrust.

It is important to note that, according to different embodiments equivalent to one another, the actuator device 90 can translate the fingers 88 of each group 87 in the feeding station S5 (when the feeding drum 28 is standing still), in the insertion station S9 (when the feeding drum 28 is standing still) or in the path between the feeding station S5 and the insertion station S9 (when the feeding drum 28 is moving).

As illustrated in FIG. 22, the feeding unit 21 comprises three conveying channels 91 which are inclined downwards (but may also be horizontal) and feed by gravity (by using downward inclination) three respective rows of sealing rings 7 towards the insertion station S9; as is evident in FIG. 22, in the insertion station S9 each conveying channel 91 is coupled (aligned) with a corresponding seat 89 in each finger 88. As better illustrated in FIG. 23, each conveying channel 91 is laterally delimited by corresponding sides 92 (which can be singular double, or triple as illustrated in the attached figures) and is delimited, at the bottom, by a support plane 93. The conveying channels 91 can feed the respective rows of sealing rings 7 solely by gravity (by exploiting the downward inclination) or by adding compressed air blowers (blower air conveyor) or vibrations (vibrating conveyor); alternatively, other configurations of the conveying channels 91 are also possible with the only constraint that the conveying channels 91 feed the respective rows of sealing rings 7 towards the insertion station S8.

As illustrated in FIG. 22, the feeding unit 21 also comprises an accompanying element 94 which has three parallel prongs, each of which is coupled to a corresponding conveying channel 91; in particular, the accompanying element 94 is movable within the conveying channels 91 and parallel to the conveying channels 91 to accompany the progressive descent of the sealing rings 7 inside the insertion station S9. Moreover, the feeding unit 21 comprises a gate 95 which is coupled to the conveying channels 91, is arranged immediately upstream of the insertion station S9 (i.e. it delimits the beginning of the insertion station S9) and is movable between an opening position, in which it allows the entering of the sealing rings 7 into the insertion station S9 and a closing position which prevents the entering of the sealing rings 7 into the insertion station S9.

In use, when the insertion station S9 is full (i.e. when in the insertion station S9 there are forty-two sealing rings 7 arranged in three rows of fourteen sealing rings 7 in the three conveying channels 91 as illustrated in FIG. 22), the gate 95 is closed (i.e. is arranged in the closing position) so as to "isolate" the segments of the conveying channels 91 comprised in the insertion station S9 from the remaining parts of the conveying channels 91 and then the forty-two sealing rings 7 present in the insertion station S9 are transferred (with the methods described in the following) from the conveying channels 91 to the seats 89 of the fingers 88 of a group 87 that is standing still in the insertion station S9. When the forty-two sealing rings 7 present in the insertion station S9 have been transferred from the conveying channels 91 to the seats 89 of the fingers 88 of a group 87 that is standing still in the insertion station S9, the insertion station S9 is empty (i.e. completely devoid of sealing rings 7); at this point, the prongs of the accompanying device 94 are fed along the conveying channels 91 until reaching the gate 95 and therefore the gate 95 is opened (i.e. is arranged in the opening position) so as to again allow the sealing rings 7 to enter the insertion station S9 sliding by gravity along the three conveying channels 91; the descent of the sealing rings 7 along the three conveying channels 91 and in the insertion station S9 is not free (i.e. uncontrolled) but is controlled by the three prongs of the accompanying element 94 which rest on the corresponding first three sealing rings 7 to accompany at controlled and predetermined speed the descent of the first three sealing rings 7 (followed by the other sealing rings 7) along the three conveying channels 91. Due to the action of the accompanying element 94, the sealing rings 7 are never "abandoned" and therefore have no possibility of "tipping over" inside the conveying channels 91.

According to a preferred embodiment, the gate 95 comprises for each conveying channel 91 a corresponding wedge-shaped stopping element which is inserted (in the closing position) between two successive sealing rings 7 to prevent further advancement of the sealing ring 7 arranged upstream along the conveying channel 91.

According to a possible embodiment illustrated in FIG. 22, a video camera T is provided which frames the three conveying channels 91 at the gate 95 so as to detect the exact (actual) position of the sealing rings 7 inside the three conveying channels 91; in this way, the movement of the accompanying device 94 inside the conveying channels 91 is controlled based on the actual (exact) position of the sealing rings 7 inside the conveying channels 91 so that the gate 95 can be moved from the opening position to the closing position by enclosing the correct number of sealing rings 7 behind it and without being pressed against the sealing rings 7. In other words, the actual (exact) position of the sealing rings 7 within the three conveying channels 91 is not left the "chance" by means of an open-loop control of the movement of the accompanying element 94, but the actual (exact) position of the sealing rings 7 inside the three conveying channels 91 is guaranteed by a closed-loop control of the movement of the accompanying element 94 (by using, as a feedback variable, the position of the sealing rings 7 inside the three conveying channels 91 detected by the video camera T). In this regard it is important to note that the sealing rings 7 (unlike the tubular casings 2) are elastically deformable and therefore, due to possible elastic deformation, the position of the sealing rings 7 inside the three conveying channels 91 can be (slightly) variable in a substantially unpredictable way; said unpredictability is detected and compensated for by means of the video camera T which is able to accurately determine the actual position of the sealing rings 7 inside the three conveying channels 91 and therefore to control (adapt, correct) accordingly, the movement of the accompanying element 94.

According to a possible embodiment, even or only the movement of the gate 95 (particularly the movement from the opening position to the closing position) is synchronized with the exact position of the sealing rings 7 inside the three conveying channels 91 in order to avoid errors in the maneuvering of the gate 95. In other words, the movement of the gate 95 is controlled according to the exact position of the sealing rings 7 inside each conveying channel 91 detected by the video camera T in combination or alternatively to control the movement of the accompanying element 94 as a function of the exact position of the sealing rings 7 inside each conveying channel 91 detected by the video camera T.

As illustrated in FIG. 23, in the insertion station S9 the seats 89 of the fingers 88 are aligned with the corresponding conveying channels 91 and are arranged under the corresponding conveying channels 91 so that each sealing ring 7 carried by a conveying channel 91 is vertically aligned with a corresponding seat 89 of the fingers 88. As previously stated, the conveying channels 91 comprise a support plane 93 on which the tubular casings 2 rest. In the insertion station S9, the support plane 93 has a plurality of through-holes 96, each smaller than a sealing ring 7; unlike the feeding unit 17, in the feeding unit 21 the support plane 93 is fixed, i.e. it is devoid of moving parts.

As illustrated in FIG. 23, the feeding unit 21 comprises a group of (forty-two) pushers 97 which are arranged in the insertion station S9 and are movable in a vertical manner so as to push the sealing rings 7 from the conveying channel 91 to the seats 89 of the fingers 88 of a group 87 that is standing still in the insertion station S9; moreover, the feeding unit 21 comprises a group of (forty-two) accompanying elements 98 which are opposite to the pushers 97 and are movable in a vertical manner so as to be inserted into the seats 89 of the fingers 88 of a group 87 that is standing still in the insertion station S9 and to accompanying the ascent of the sealing rings 7 from the conveying channel 91 to the seats 89 of the fingers 88. In other words, in the insertion station S9 each sealing ring 7 is transferred from a conveying channel 91 to the overlying seat 89 of a finger 88 of a group 87 that is standing still in the insertion station S9, carrying out a vertical upward movement during which the sealing ring 7 is engaged, at the bottom, by a pusher 97 and, at the top, by an accompanying element 98 (i.e. being "pinched" between a pusher 97 arranged at the bottom, and by an accompanying element 98 arranged at the top). In this regard it is important to note that accompanying elements 98 would not be strictly necessary; however, the presence of the accompanying elements 98 allows to impart a controlled movement to the sealing rings 7 which prevents any incorrect positioning or bouncing of the sealing rings 7.

In the seats 89 of the fingers 88, the sealing rings 7 are held by mechanical interference, i.e. the pushers 97 "fit with interference" the sealing rings 7 inside the seats 89 of the fingers 88 thus causing a (small) elastic deformation of the sealing rings 7. In this regard, the inlet opening (i.e. the lower opening) of each seat 89 can have a flared shape (i.e. a funnel shape, a truncated-conical shape) to allow easy entering of a corresponding sealing ring 7 and then a subsequent gradual compression of the sealing ring as it goes up again into the seat 89.

As illustrated in FIG. 24, the seats 89 of the fingers 88 of a group 87 that is standing still in the feeding station S5 are aligned and overlap the corresponding seats 16 of a group that is standing still in the feeding station S5 so that each sealing ring 7 carried by a seat 89 of the fingers 88 is vertically aligned with a corresponding seat 16 of the manufacturing drum 13. The feeding unit 21 comprises a group of (forty-two) pushers 99 which are arranged in the feeding station S5 and are movable in a vertical manner so as to be inserted into the seats 89 of the fingers 88 of a group 87 that is standing still in the feeding station S5 thus pushing the sealing rings 7 from the seats 89 of the fingers 88 to the seats 16 of a group 15 that is standing still in the feeding station S5. Moreover, the feeding unit 21 comprises a group of (forty-two) pushers 100, each opposite to a corresponding pusher 99 (i.e. is arranged on the opposite side of the corresponding pusher 99 with respect to the manufacturing drum 13) and is aligned in a vertical (longitudinal) manner with a corresponding seat 16 of a group 15 that is standing still in the feeding station S5; the pushers 100 are movable in a vertical manner (i.e. parallel to the seats 16) to be inserted inside the seats 16 and push the tubular casings 2 contained in the seats 16 towards the fingers 88 and, hence, towards the corresponding seats 89.

In other words, in the feeding station S5 each sealing ring 7 is transferred from a seat 89 of a finger 88 of a group 87 that is standing still in the feeding station S5 to the underlying seat 16 of a group 15 that is standing still in the feeding station S5 by performing a vertical downward movement during which the sealing ring 7 is engaged, at the top, by a pusher 99; at the same time, each tubular casing 2 carried by a corresponding seat 16 of a group 15 that is standing still in the feeding station S5 is pushed upwards by a pusher 100 to exit from the seat 16 and approach the corresponding finger 88. When a sealing ring 7 comes into contact with a corresponding tubular casing 2, the sealing ring 7 is fitted around an upper portion of the sealing ring 7 as illustrated in FIG. 1. The main function of the pusher 100 is to lift the tubular casings 2 from the jaws 27 of the seats 16 and "back-up" (i.e. provide a suitable lower support) when the sealing rings 7 are fitted around the corresponding tubular casings 2; therefore in this step the jaws 27 of the seats 16 are in no way mechanically stressed, since the contrast necessary to fit the sealing rings 7 around the corresponding tubular casings 2 is provided solely by the pusher 100.

Figure 25:
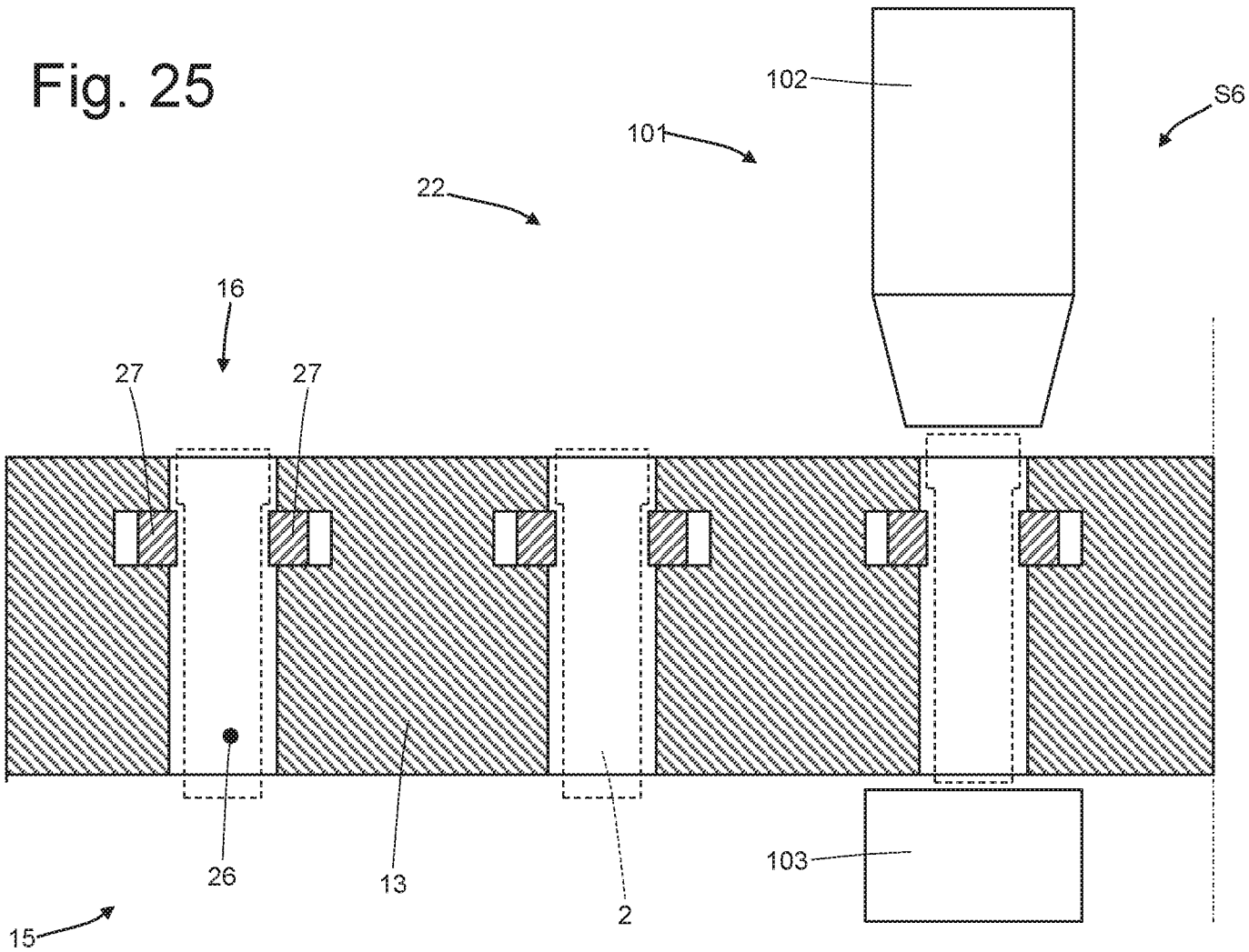
FIG. 25 is a schematic and longitudinal section view of a welding unit of the manufacturing machine of FIG. 2.

As illustrated in FIG. 25, each welding unit 22 comprises a group of ultrasonic welding devices 101 (only one of which is illustrated in FIG. 25) formed by a number of welding devices 101 equal to the number of seats 16 of a same line of seats 16 (i.e. in the embodiment illustrated in the attached figures, fourteen welding devices 101). When a group 15 of seats 16 stops in a welding station S6, all of and only the seats 16 of a same line of seats 16 are coupled to corresponding welding devices 101 which perform an annular welding between each tubular casing 2 and the corresponding sealing ring 7 previously fitted in the feeding station S5. According to a preferred embodiment, each welding device 101 comprises a sonotrode 102 which is placed in contact with an upper end of the corresponding tubular casing 2 carrying the sealing ring 7 and has the function of transmitting the vibrations, in ultrasonic field, to the tubular casing 2 carrying the sealing ring 7; furthermore, each welding device 101 comprises an anvil 103 which is opposite to the sonotrode 102 and is arranged in contact with a lower end of the corresponding tubular casing 2 (i.e. with the bottom wall 3 of the corresponding tubular casing 2) and has both the function of providing a contrast to the sonotrode 102, and of pushing the tubular casing 2 from the bottom towards the sonotrode 102 (i.e. in close contact with the sonotrode 102) while separating the tubular casing 2 from the corresponding jaws 27 of the seat 16. According to a preferred embodiment, the anvils 103 of all the welding devices 101 form an individual monolithic body mounted in a fixed position next to the lower face of the conveying drum 13; moreover, the anvils 103 of all the welding devices 101 are present, at the beginning and at the end, of the inclined planes, so as to progressively make both the ascent of the tubular casings 2 upward (i.e. towards the sonotrodes 102), and the subsequent descent of the tubular casings 2 downward.

It is important to underline that during the welding, each tubular casing 2 must be separated from the corresponding jaws 27 so as to rest only on the corresponding anvil 103, since only the anvils 103 are sufficiently rigid to provide an adequate contrast for the ultrasonic welding.

According to a preferred embodiment, each sonotrode 102 is mounted to the frame by means of the interposition of an elastic element (for example a pneumatic spring) so as to constantly exert a constant pressure on the sealing ring 7 when the corresponding tubular casing 2 is pushed against the sonotrode 102 by the underlying anvil 103. In other words, the anvils 103 always lift the tubular casings 2 with the same stroke and the adjustments to compensate for the constructive tolerances are performed by the sonotrodes 102 which translate in a vertical manner thus compressing the corresponding elastic elements.

For example, each welding device 101 can be made as described in the patent application IT102016000094855 to which reference should be made for further details.

Figure 26:
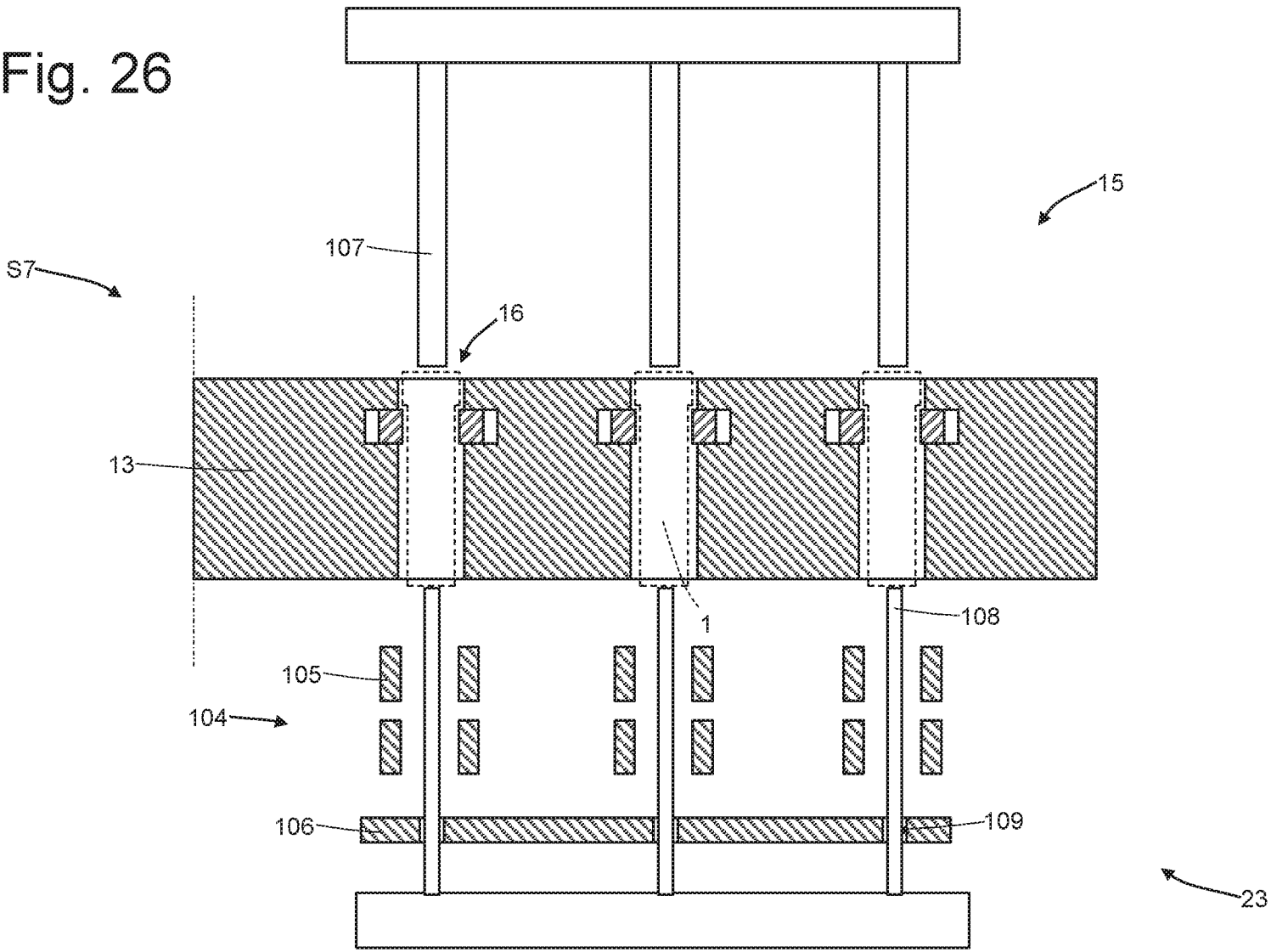
FIG. 26 is a schematic and longitudinal section view of an extraction unit of the manufacturing machine of FIG. 2.

As illustrated in FIG. 26, in the output station S7 the extraction unit 23 transfers the disposable cartridges 1 (i.e. the tubular casings 2 provided with the corresponding quantities 5 of tobacco, tabs 6 of filtering material and sealing rings 7) from the seats 16 of a group 15 that is standing still in the output station S7 to three conveying channels 104 which are inclined downwards and feed, by gravity (by exploiting the downward inclination) three respective rows of disposable cartridges 1 towards the output of the manufacturing machine 1 (passing through an optical control station, a weight control station, and a station for discarding the non-compliant disposable cartridges). As is evident in FIG. 7, each conveying channel 104 is coupled to (aligned with) a corresponding line of seats 16 of a group 15 that is standing still in the output station S7. According to a preferred embodiment illustrated in FIG. 26, each conveying channel 104 is laterally delimited by corresponding sides 105 (which can be double as illustrated in the attached figures, single, or triple) and is delimited, at the bottom, by a support plane 106.

The extraction unit 23 comprises a group of (forty-two) pushers 107 which are arranged in the output station S7 and are movable in a vertical manner so as to push the disposable cartridges 1 from the seats 16 of a group 15 that is standing still in the output station S7 to the corresponding conveying channels 106; moreover, the extraction unit 23 comprises a group of (forty-two) accompanying elements 108 which are opposite to the pushers 107 and are movable in a vertical manner to accompany the descent from the seats 16 of a group that is standing still in the output station S7 to the corresponding conveying channels 106. The support plane 106 of the conveying channels 104 has a plurality of through-holes 109 (smaller than the disposable cartridges 1) through which the accompanying elements 108 can reach, from the bottom, the seats 16 of a group 15 that is standing still in the output station S7.

In other words, in the output station S7 each disposable cartridge 1 is transferred from a seat 16 of a group 15 that is standing still in the output station S7 to an underlying conveying channel 106 thus carrying out a vertical downward movement during which the disposable cartridge 1 is engaged, at the top, by a pusher 107 and, at the bottom, by an accompanying element 108 (i.e. by being "pinched" between a pusher 107 arranged at the top and by an accompanying element 108 arranged at the bottom). In this regard it is important to note that the pushers 107 and the accompanying elements 108 would not be strictly necessary, since the vertical descent movement would in any case be impressed on the disposable cartridges 1 by the force of gravity; however, the presence of the pushers 107 and of the accompanying elements 108 allows to impart a controlled movement to the disposable cartridges 1, which prevents any incorrect positioning or bouncing of the disposable cartridges 1.

Figure 27:
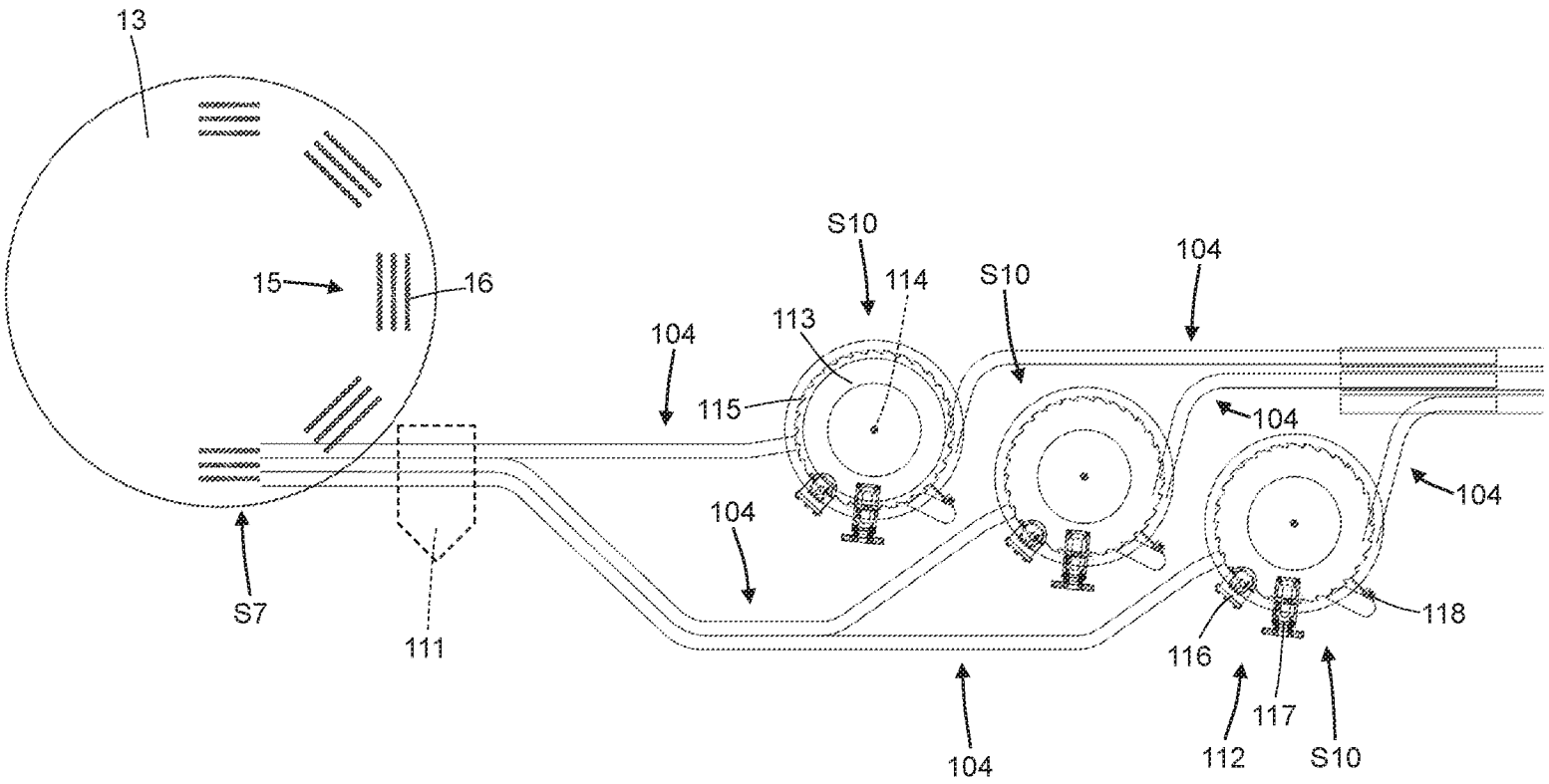
FIG. 27 is a schematic plan view of a control station of the manufacturing machine of FIG. 2.

As illustrated in FIG. 27, a discarding device 111 is arranged along the three conveying channels 104 and downstream of the output station S7 (i.e. downstream of the extraction unit 23 and out of the manufacturing drum 13), which is adapted to extract and discard the disposable cartridges 1 from a corresponding conveying channel 104; for example, the discarding device 111 could be controlled so as to discard a group of fourteen disposable cartridges 1 (i.e. a number of disposable cartridges 1 equal to the number of seats 12 and 16 in each line of each group 11 and 15) from a corresponding conveying channel 104. In particular, for each conveying channel 104 the discarding device 111 comprises a respective motorized deviator element which acts as a "railway exchange" in order to divert the disposable cartridges 1 which advance along the conveying channel 104 towards a discarding direction; preferably, the disposable cartridges 1 diverted by the deviator element are directed towards an underlying collecting container in which they fall by gravity.

The discarding device 111 can be actuated by an operator to extract samples of the disposable cartridges 1, it can be actuated automatically when some problems have been detected during the manufacturing of the disposable cartridges 1 (for example the failure to supply the tubular casings 2, the quantities 5 of tobacco, the tabs 6 of filtering material, or the sealing rings 7 or the failure of the welding devices 101); alternatively, the discarding device 111 can be actuated at the start/stop of the manufacturing machine 8 in order to eliminate the disposable cartridges 1 produced as first/last (therefore potentially incomplete). Alternatively or in addition, the manufacturing machine 8 could comprise control devices (typically optical by means of video cameras) which are arranged at the manufacturing drums 9 and 13 to detect any defects and therefore discard the defective disposable cartridges 1 by means of the discarding device 111 arranged downstream of the manufacturing drums 9 and 13.

As illustrated in FIG. 27, three respective control stations S10 are arranged along the three conveying channels 104; for this purpose the three conveying channels 104 are initially next to one another (i.e. they are beside one another at the output station S7 and at the discarding device 111), they separate from one another (i.e. they move away from one another) to create the space necessary for the corresponding control stations S10, and finally meet again at an output of the manufacturing machine 8 towards a subsequent packing machine.

Each control station S10 comprises a control unit 112 which carries out an external optical control (typically by means of video cameras) and a weight control for each disposable cartridge 1 and therefore discards the disposable cartridges 1 which are not compliant (i.e. showing visible surface defects and/or not having the required weight within a given tolerance). Furthermore, each control station S10 comprises a feeding drum 113 which is interposed along a corresponding conveying channel 104, i.e. locally interrupts the conveying channel 104; in other words, each conveying channel 104 temporarily transfers the disposable cartridges 1 to the corresponding feeding drum 113 from which it receives, again, the disposable cartridges 1 after the controlling and discarding operations.

Each feeding drum 113 is arranged horizontally and is mounted in a rotatable stepwise manner or with continuous motion around a vertical rotation axis 114; in other words, each feeding drum 113 is set into rotation with an intermittent motion, i.e. a non-continuous motion which provides a cyclical alternation of motion steps, in which the feeding drum 113 is moving, and still steps, in which the feeding drum 113 stops, or, according to an alternative embodiment, each feeding drum 113 is set into rotation with a continuous motion which does not provide stops. Each feeding drum 113 has a plurality of peripheral seats 115 (i.e. arranged on the outer periphery of the feeding drum 113 and open towards the outside of the feeding drum 113), each adapted to receive and contain a corresponding disposable cartridge 1 so as to feed the disposable cartridge 1 along a circular path between an input (in which the corresponding conveying channel 104 arrives) and an output (in which the corresponding conveying channel 104 starts again).

Each control unit 112 comprises an optical control device 116 (adapted to capture a complete, i.e. 360°, image of each disposable cartridge 1 through the use of particular optics) and a subsequent microwave control device 117 which measures the weight of the quantity 5 of tobacco contained in each disposable cartridge 1. In particular, the microwave control device 117 uses microwaves to determine the weight of the quantity 5 of tobacco contained in each disposable cartridge 1 since the microwaves are sensitive to water (moisture) of the tobacco. According to a possible embodiment, each optical control device 116 comprises at least one video camera (but two or three video cameras may also be used) coupled to one or more mirrors which allow the video camera to also frame the hidden faces of each disposable cartridge 1; in other words, the video camera can directly see only one part of each disposable cartridge 1, while the remaining unseen part of each disposable cartridge 1 is viewed indirectly through the reflected image in one or more suitably positioned mirrors.

Finally, each control station S10 comprises a discarding device 118 which is coupled to the corresponding feeding drum 113 downstream of the control unit 112 (i.e. downstream of the optical control device 116 and of the microwave control device 117) and is adapted to extract, from the corresponding seat 115, a non-compliant (i.e. defective) disposable cartridge 1 previously detected by the control unit 112.

Figure 28:
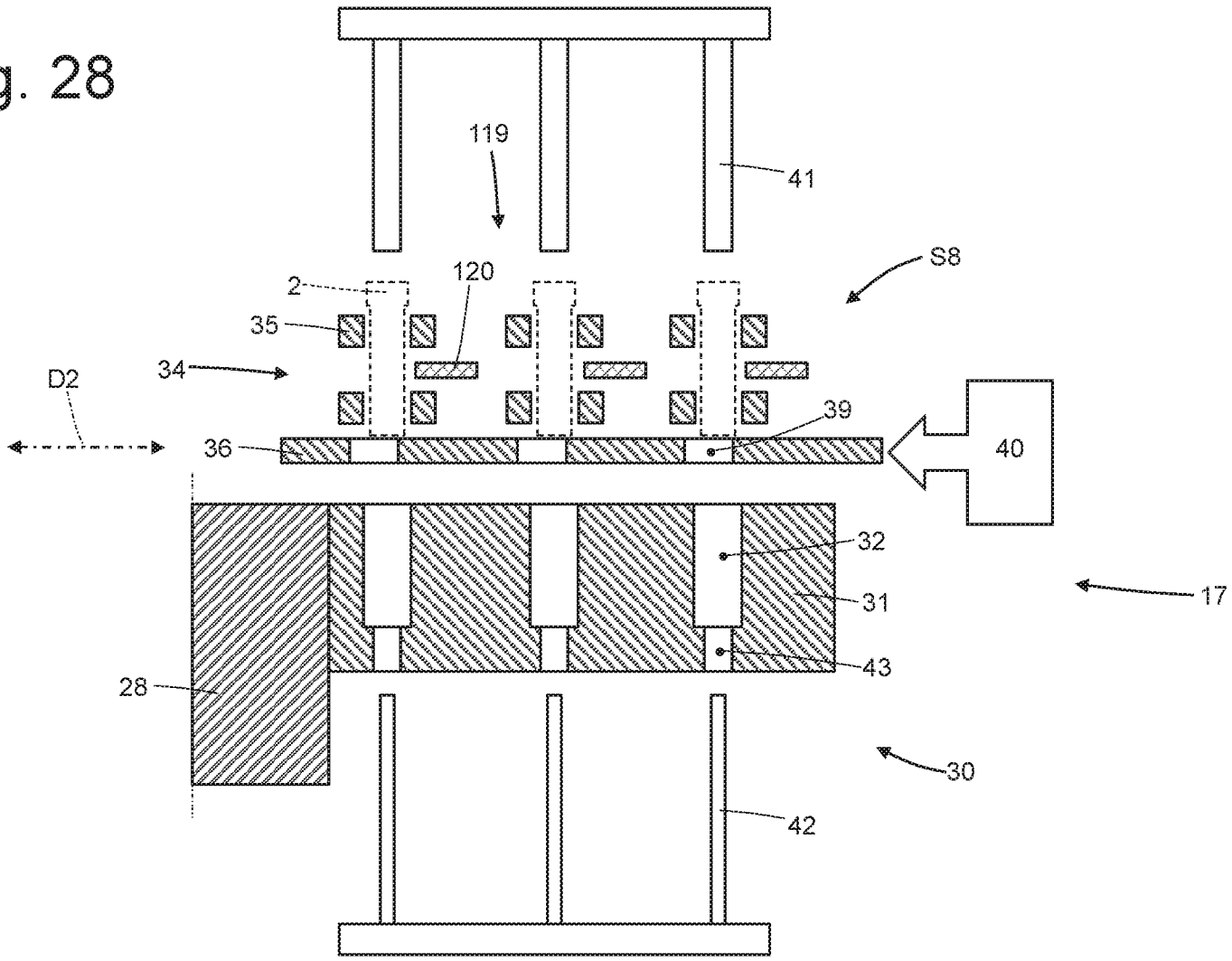
FIGS. 28 and 29 are two schematic and longitudinal section views of an alternative of the feeding unit of FIG. 7 at an insertion station and at two different operating times.
Figure 29:
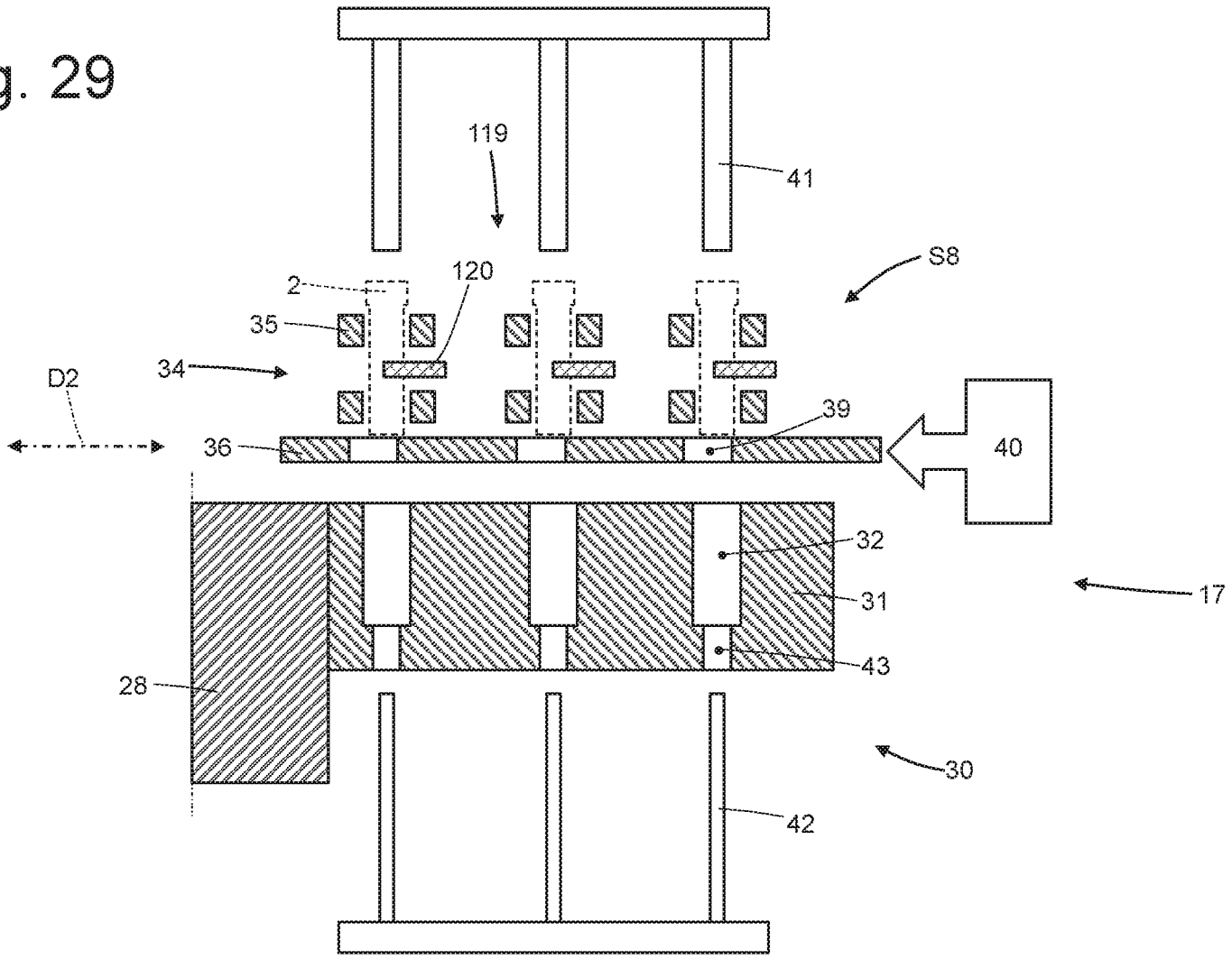
Figure 30:
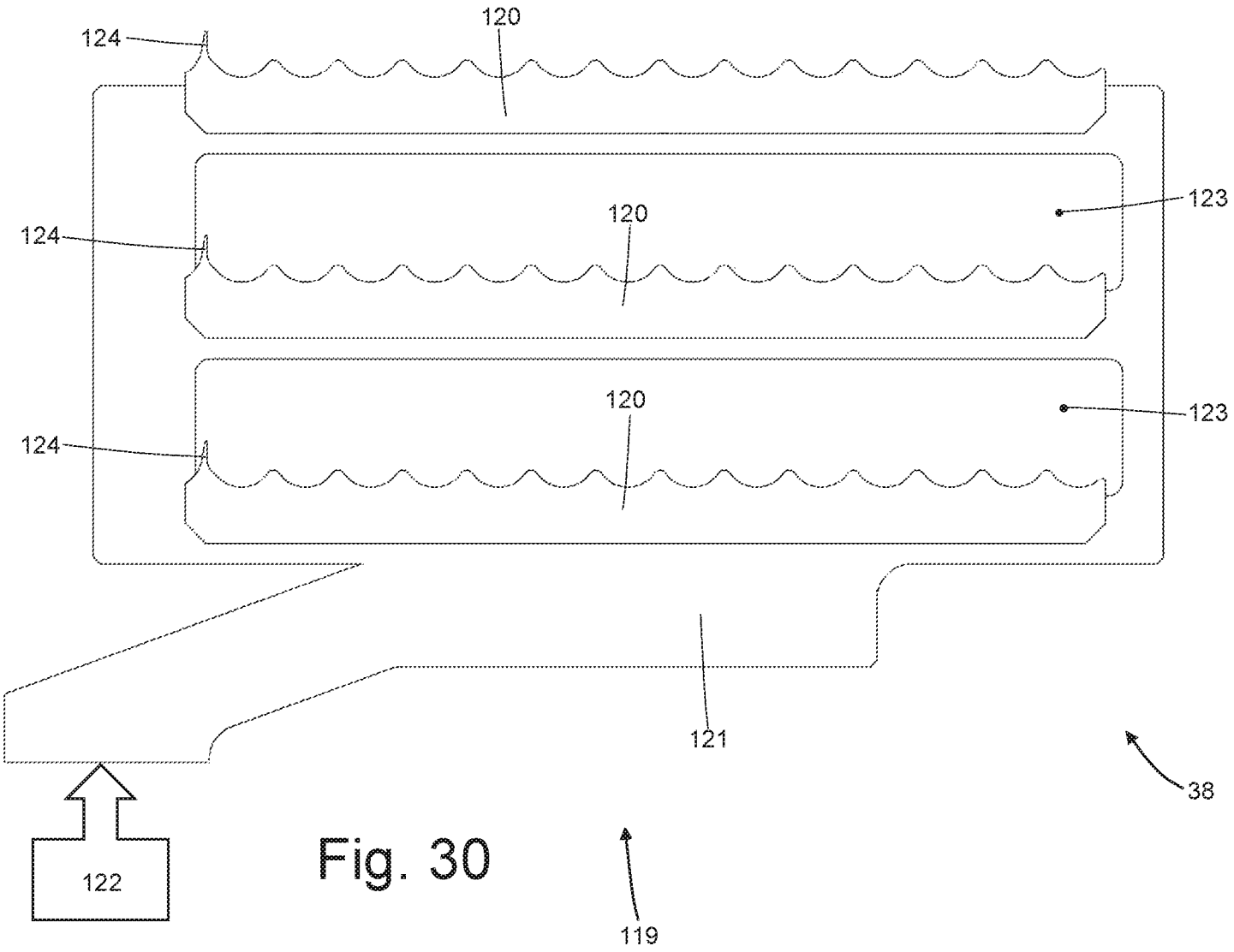
FIG. 30 is a schematic plan view of a centring device of the feeding unit of FIGS. 28 and 29.

According to the alternative embodiment illustrated in FIGS. 28, 29 and 30, the insertion station S8 comprises a centring device 119, which arranges the tubular casings 2 (in particular the forty-two tubular casings 2 arranged in three rows) in the correct position. (i.e. in perfect vertical alignment with the corresponding seats 32 of the underlying fingers 31 of a group 30 that is standing still in the insertion station S8) so as to allow a subsequent precise and smooth transfer of the tubular casings 2 from the conveying channels 34 to the underlying fingers 31 of a group 30 that is standing still in the insertion station S8.

The centring device 119 comprises three centring elements 120 (better illustrated in FIG. 30), each of which is "saw tooth" shaped (i.e. it has fourteen side-by-side seats which reproduce, in negative, part of the outer shape of the tubular casings 2) and is linearly movable between a rest position (illustrated in FIG. 28) and a work position (illustrated in FIG. 29). In the rest position (illustrated in FIG. 28), each centring element 120 is offset (i.e. relatively far) from the tubular casings 2 carried by the corresponding conveying channel 34 and therefore does not interact in any way with the tubular casings 2. In the work position (illustrated in FIG. 29), each centring element 120 is in contact with the tubular casings 2 carried by the corresponding conveying channel 34 and therefore does not "constrain" the tubular casings 2 to assume a predetermined desired position (i.e. a position of perfect vertical alignment with the corresponding seats 32 of the underlying fingers 31 of a group 30 that is standing still in the insertion station S8).

As illustrated in FIG. 30, the centring device 119 comprises a support body 121 which supports the three centring elements 120 and is mounted in a movable manner to linearly translate between the rest position (illustrated in FIG. 28) and the work position (illustrated in FIG. 29). An actuator device 122 (e.g. an electric motor) is coupled to the support body 121, which imparts the linear translation movement to the support body 121. The support body 121 has two through openings 123, at which two centring elements 120 are arranged, while the third centring element 120 is arranged at an outer edge of the support body 121.

According to a preferred but non-binding embodiment, illustrated in FIG. 30, the centring device 119 also integrates the gate 38 (or, from another point of view, the gate 38 also integrates the centring device 119); in other words, the centring device 119 and the gate 38 together form a single aggregate which carries out both tasks. In particular, each centring element 120 is provided with a wedge-shaped stopping element 124 which is inserted (in the closing position) between two successive tubular casings 2 to prevent further advancement of the tubular casing 2 arranged upstream along the corresponding conveying channel 34. In other words, the stopping element 124 of each centring element 120 is movable together with the centring element 120 between the opening position (corresponding to the rest position of the centring element 120) in which it allows the entering of the tubular casings 2 in the insertion station S8 and the closing position (corresponding to the work position of the centring element 120) which prevents the entering of the tubular casings 2 into the insertion station S8.

According to a different embodiment not illustrated, the centring device 119 can be completely separate and independent from the gate 38.

The centring device 119 can be operated to centre the tubular casings 2 in the insertion station S8 immediately before the start of the transfer of the tubular casings 2 or simultaneously with the start of the transfer. Moreover, once the centring has been made (i.e. once the centring device 119 has been placed in the work position), the centring device 119 can be left in the work position until the transfer of the tubular casings 2 is completed, the centring device 119 can be left in the work position only during part of the transfer of the tubular casings 2 (i.e. the centring device 119 is placed in the rest position during the transfer of the tubular casings 2), or the centring device 119 can be arranged immediately after in the rest position (i.e. the centring device 119 is arranged in the rest position before starting the transfer of the tubular casings 2 or coinciding with the start of the transfer of the tubular casings 2).

Figure 31:
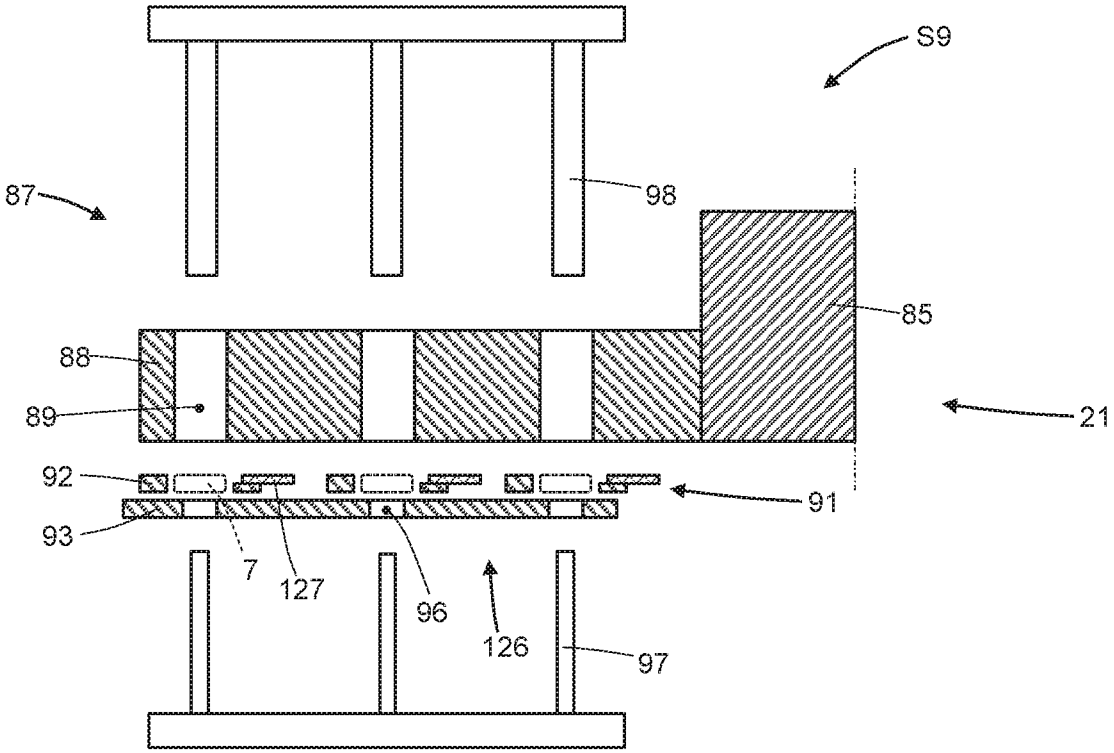
FIGS. 31 and 32 are two schematic and longitudinal section views of an alternative of the feeding unit of FIG. 22 at an insertion station and at two different operating times.
Figure 32:
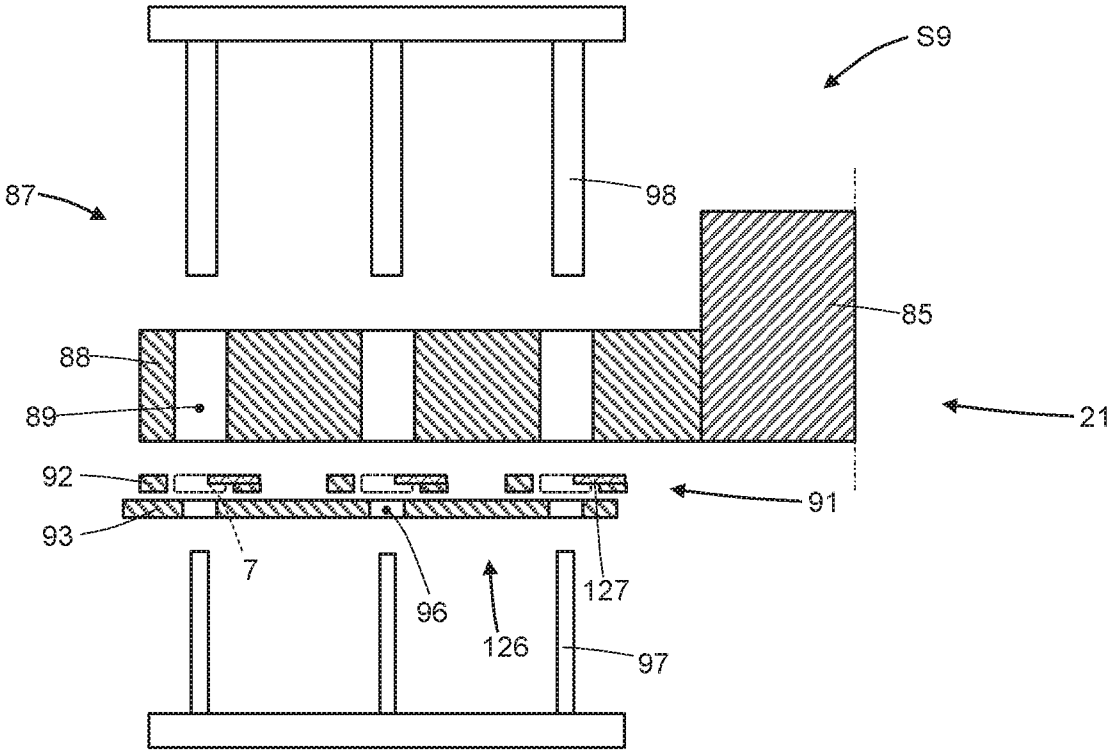

According to the alternative embodiment illustrated in FIGS. 31 and 32, also the insertion station S9 comprises a centring device 126, which arranges the sealing rings 7 (in particular the forty-two sealing rings 7 arranged in three rows) in the correct position (i.e. in perfect vertical alignment with the corresponding seats 89 of the overlying fingers 88 of a group 87 that is standing still in the insertion station S9) so as to allow a subsequent precise and smooth transfer of the sealing rings 7 from the conveying channels 91 to the overlying fingers 88 of a group 87 that is standing still in the insertion station S8.

The centring device 126 of the insertion station S9 is completely identical to the centring device 119 of the insertion station S8 (to which we refer for a detailed description of the centring device 126); consequently, also the centring device 126 comprises three centring elements 127, each "saw tooth" shaped (i.e. it has fourteen side-by-side seats which reproduce, in negative, part of the outer shape of the sealing rings 7), it is linearly movable between a rest position (illustrated in FIG. 31) and a work position (illustrated in FIG. 32), and can integrate the gate 95.

Figure 33:
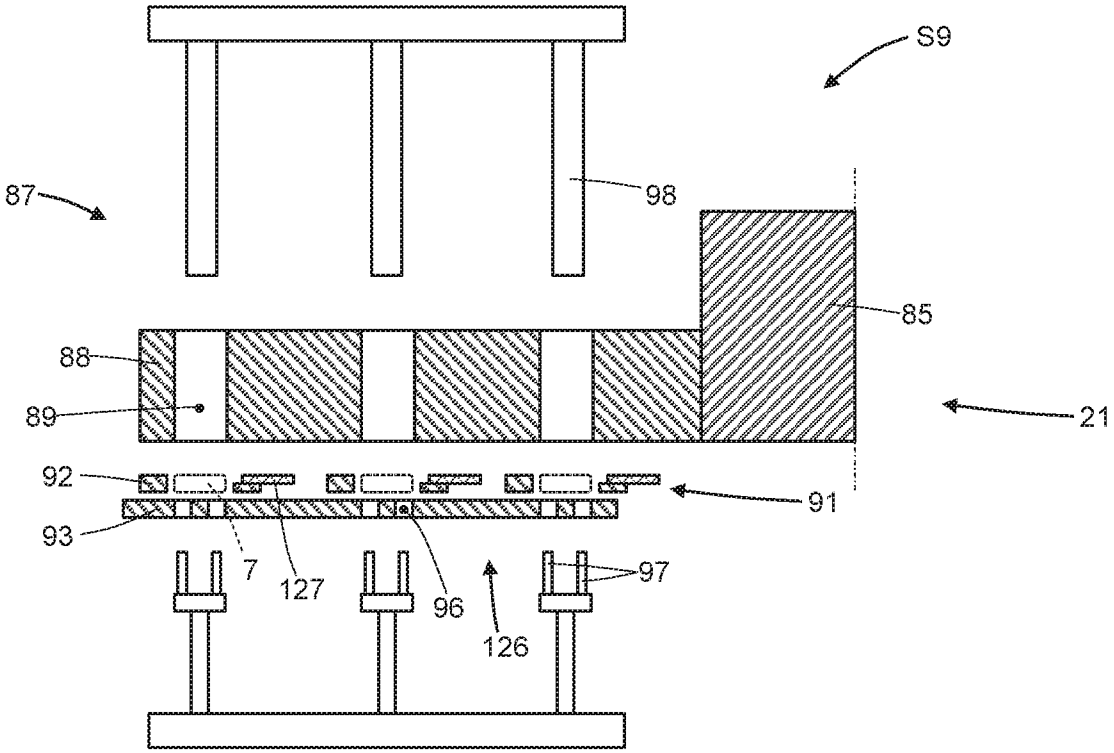
FIG. 33 is a schematic and longitudinal section view of a further alternative of the feeding unit of FIG. 22 at an insertion station.

In the embodiment illustrated in FIGS. 23, 31 and 32, at each conveying channel 91 the support plane 93 comprises a single row of through-holes 96 through which the corresponding pushers 97 are inserted, each having a single point; consequently, in the embodiment illustrated in FIGS. 23, 31 and 32, each pusher 97 centrally engages a corresponding sealing ring 7. In the alternative illustrated in FIG. 33, at each conveying channel 91, the support plane 93 comprises two rows, next to one another, of through-holes 96 through which the corresponding pushers 97 are inserted each having two twin points next to one another; consequently, in the embodiment illustrated in FIG. 33, each pusher 97 laterally engages a corresponding sealing ring 7 (this alternative is preferable as the sealing rings 7 have greater rigidity at the outer edge).

Figure 34:
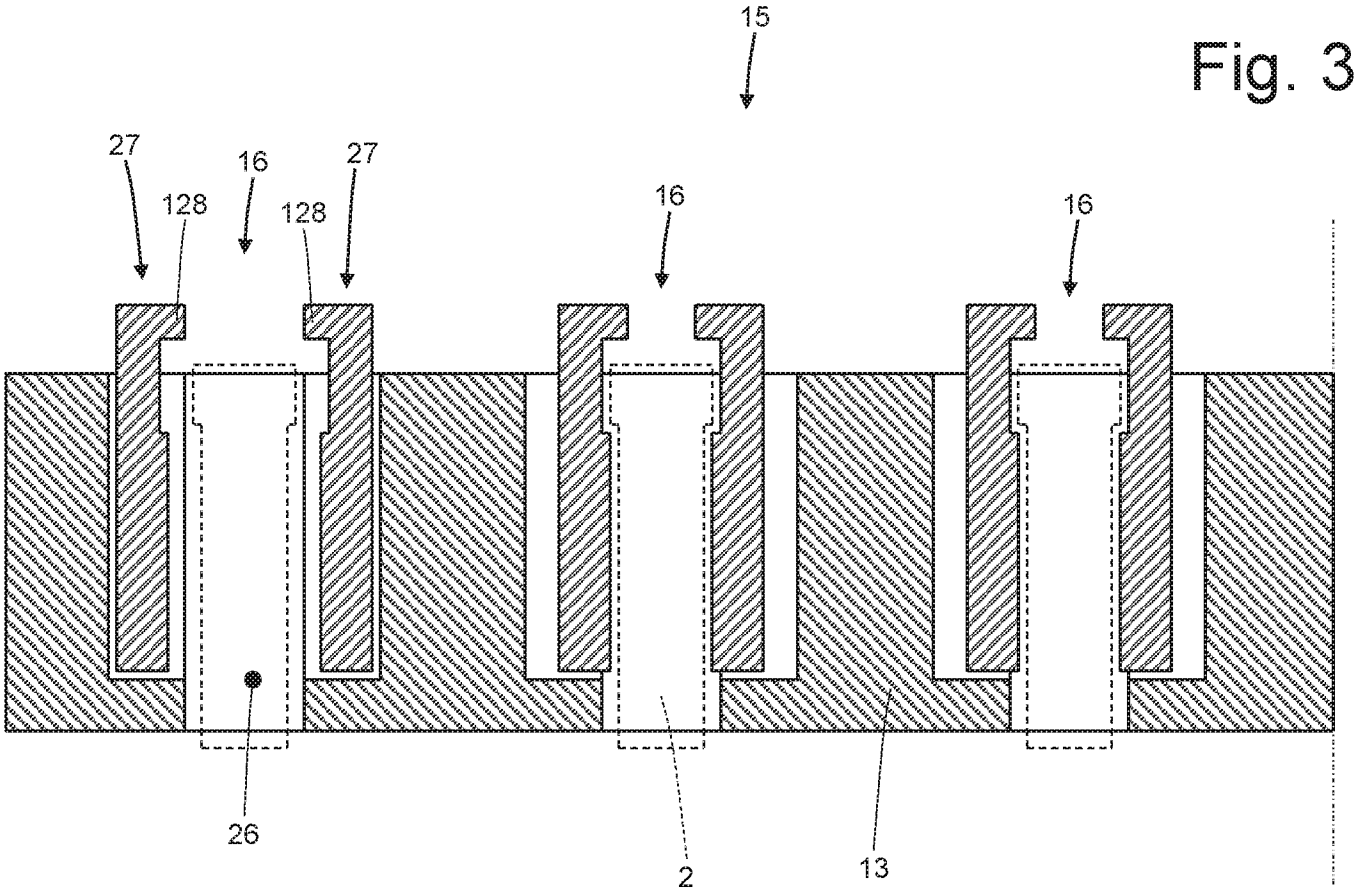
FIG. 34 is a schematic and longitudinal section view of part of a second manufacturing drum in an alternative of the manufacturing machine of FIG. 2.
Figure 36:
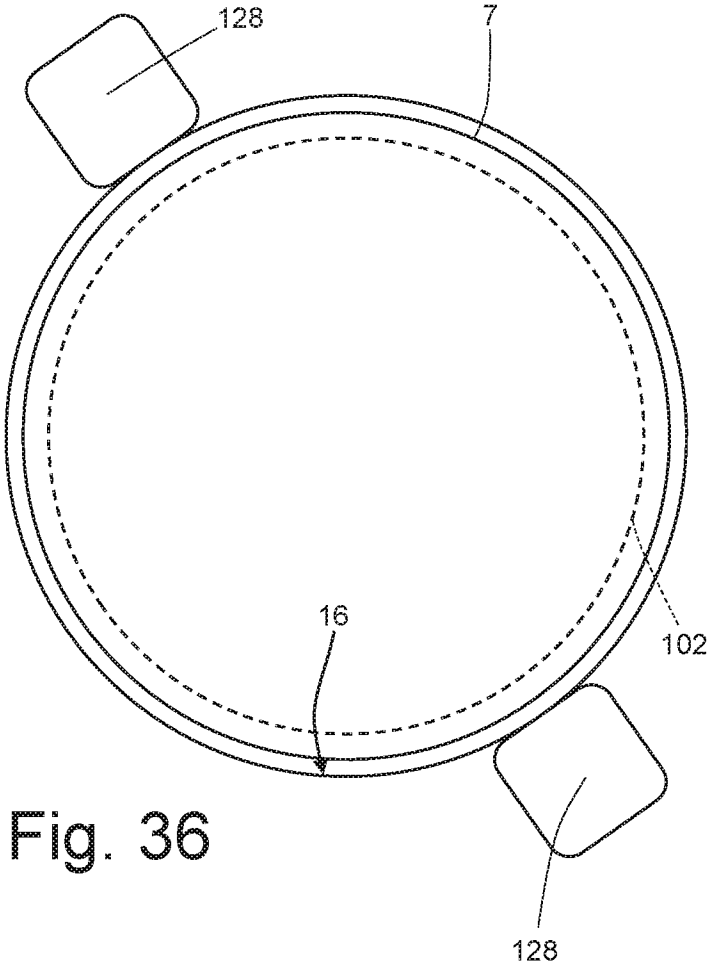
FIGS. 35 and 36 are two schematic top views of a seat of the second manufacturing drum of FIG. 34 with a pair of jaws arranged respectively in a gripping position and in a transfer position.
Figure 35:
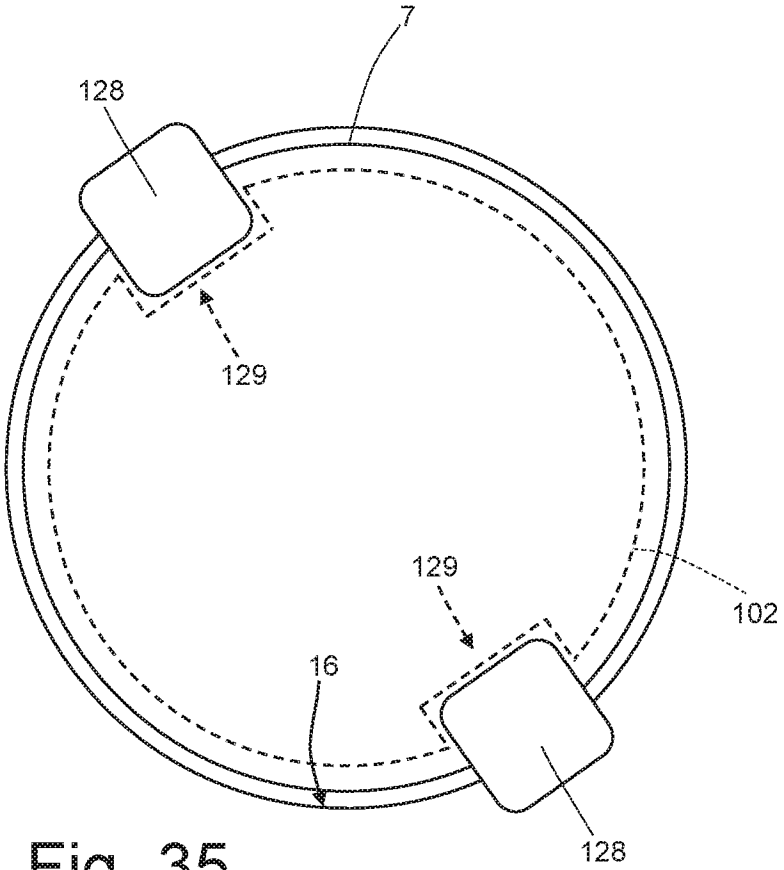

According to the alternative illustrated in FIGS. 34, 35 and 36, the two jaws 27, opposite and coupled to each seat 16 of the manufacturing drum 13, have two respective teeth 128 which have the function of holding a corresponding sealing ring 7 inside the seat 16; for this purpose, the two opposite teeth 128 are arranged on the top of the corresponding jaws 27 and protrude from the corresponding jaws 27 towards the inside (i.e. towards the centre of the seat 16) so that, when the two jaws 27 are arranged in the gripping position (illustrated in the two seats 16 on the right in FIG. 34 and illustrated in FIG. 35), the two teeth 128 hold, from the top, the sealing ring 7 inside the seat 16 (thus preventing the corresponding sealing ring 7 from escaping). In other words, when the two jaws 27 are arranged in the gripping position (illustrated in the two seats 16 on the right in FIG. 34 and illustrated in FIG. 35), the two teeth 128 close (plug), from the top, the seat 16, thus preventing the sealing ring 7 from escaping from the seat 16 and therefore holding the sealing ring 7, from the top, inside the seat 16.

In other words, it has been observed that during the rotation movement of the manufacturing drum 13 around the rotation axis 14, the accelerations/decelerations to which the sealing rings 7 are subjected between the feeding station S5 (in which the sealing rings 7 are resting on the corresponding tubular casings 2 housed in the seats 16 of the manufacturing drum 13) and the corresponding welding station S6 (in which the sealing rings 7 are welded to the corresponding tubular casings 2 housed in the seats 16 of the manufacturing drum 13) may occasionally and accidentally release some sealing rings 7 from the corresponding seat 16; in order to avoid the accidental loss of the sealing rings 7 between the feeding station S5 and the corresponding welding station S6, the two jaws 27 opposite and coupled to each seat 16 of the manufacturing drum 13 are provided with two teeth 128 which prevent the escaping of the sealing ring 7 from the seat 16.

In the embodiment illustrated in the attached figures, both the jaws 27 opposite and coupled to each seat 16 of the manufacturing drum 13 have a respective tooth 128; according to a different embodiment not illustrated, only one of the two jaws 27 opposite and coupled to each seat 16 of the manufacturing drum 13 has a respective tooth 128 while the other jaw 27 has no tooth 128. As previously stated, the teeth 128 of the jaws 27 prevent the passage of the sealing rings 7 and also of the tubular casings 2 when the jaws 27 are in the gripping position (illustrated in the two seats 16 on the right in FIG. 34 and illustrated in FIG. 35); consequently, in the feeding station S5 it is necessary to move the jaws 27 from the gripping position (illustrated in the two seats 16 on the right in FIG. 34 and illustrated in FIG. 35) to the transfer position (illustrated in the seat 16 on the left in FIG. 34 and illustrated in FIG. 36) to initially allow the tubular casings 2 contained in the seats 16 to be raised towards the fingers 88 (and then towards the corresponding seats 89 containing the sealing rings 7) and subsequently allow the descent of the tubular casings 2 coupled to the corresponding sealing rings 7, again, inside the seats 16. Once the tubular casings 2, coupled to the corresponding sealing rings 7, are returned inside the seats 16, the jaws 27 are moved from the transfer position (illustrated in the seat 16 on the left in FIG. 34 and illustrated in FIG. 36) to the gripping position (illustrated in the two seats 16 on the right in FIG. 34 and illustrated in FIG. 35).

In the feeding station S5, the temporary opening of the jaws 27 (i.e. the temporary movement of the jaws 27 from the gripping position to the transfer position) causes a loss of the perfect centring of the tubular casings 2 relative to the seats 16; to overcome this drawback, the pushers 100 are shaped to impart and preserve the perfect centring of the tubular casings 2 relative to the seats 16. In other words, the pushers 100 center and keep the tubular casings 2 centered relative to the seats 16 until the jaws 27 are closed again (i.e. they are moved from the transfer position to the gripping position).

According to a possible embodiment, in the welding station S6 (in which the sealing rings 7 are welded to the corresponding tubular casings 2 housed in the seats 16 of the manufacturing drum 13) the two jaws 27 opposite to one another and coupled to each seat 16 of the manufacturing drum 13 are moved from the gripping position (illustrated on the right in FIG. 34 and illustrated in FIG. 35) to the transfer position (illustrated in seat 16 on the left in FIG. 34 and illustrated in FIG. 36) to allow the sonotrodes 102 of the welding devices 101 to perform a complete annular seal (i.e. without interruptions for 360°) between each tubular casing 2 and the corresponding sealing ring 7 (as illustrated in FIG. 36).

According to an alternative embodiment, in the welding station S6 (in which the sealing rings 7 are welded to the corresponding tubular casings 2 housed in the seats 16 of the manufacturing drum 13) the two jaws 27 opposed to one another and coupled to each seat 16 of the packaging drum 13 are kept in the gripping position (illustrated in the two seats 16 on the right in FIG. 34 and illustrated in FIG. 35) and the sonotrode 102 of each welding device 101 has two recesses 129 which are arranged at the two teeth 128 and reproduce, in negative, the shape of the two teeth 128 (as illustrated in FIG. 35). In this way, the sonotrodes 102 of the welding devices 101 perform an incomplete annular seal (i.e. interrupted in two small opposing zones at the two recesses 129) between each tubular casing 2 and the corresponding sealing ring 7.

According to a different embodiment, not illustrated, the two jaws 27 which are opposed to one another and coupled to each seat 16 of the manufacturing drum 13 have more than two (for example three, four or five) respective teeth 128.

As illustrated in FIG. 22, the feeding unit 21 comprises the feeding drum 85 (having a parallelepiped shape) which is mounted in a rotatable stepwise manner around the rotation axis 86 parallel to the rotation axis 14 of the manufacturing drum 13; the feeding drum 85 supports two groups 87 of opposed fingers 88 (i.e. the two groups 87 are arranged on opposite sides of the rotation axis 85). Each group 87 comprises fourteen fingers 88 which are parallel and next to one another and each finger 88 has three seats 89 each adapted to receive a corresponding sealing ring 7. As illustrated in FIGS. 23 and 24, each seat 89 is formed by a through-hole which is obtained inside the corresponding finger 88, crosses the corresponding finger 88 from side-to-side and is adapted to contain a corresponding sealing ring 7.

Figure 37:
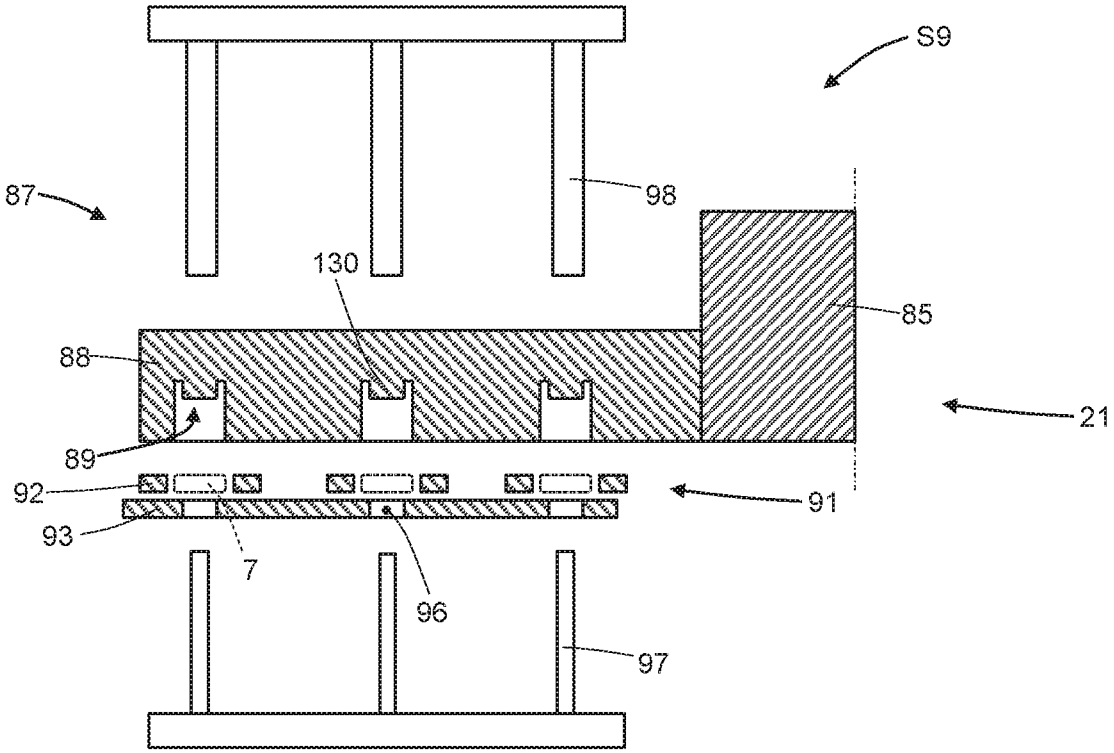
FIG. 37 is a schematic and longitudinal section view of part of an alternative embodiment of the feeding unit of FIG. 22 at an insertion station.
Figure 38:
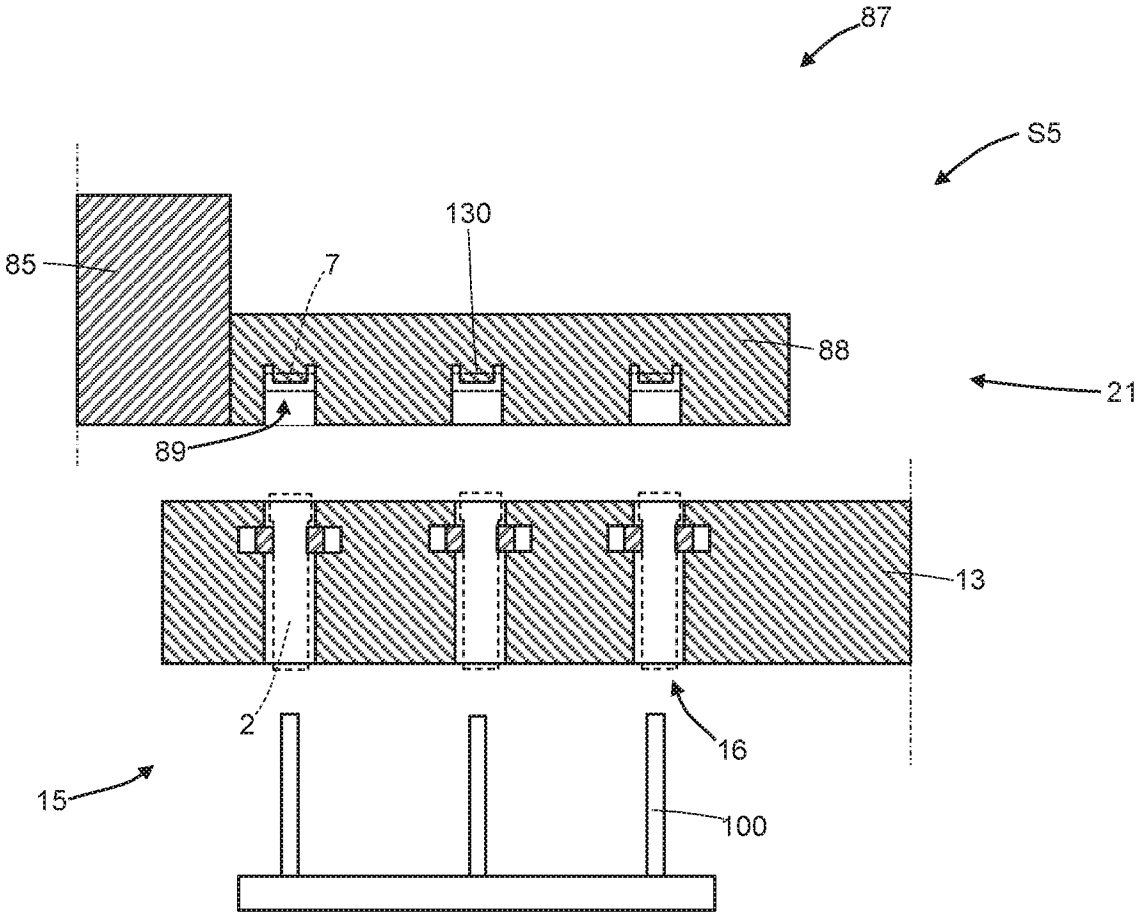
FIG. 38 is a schematic and longitudinal section view of part of the feeding unit of FIG. 37 at a feeding station.
Figure 39:
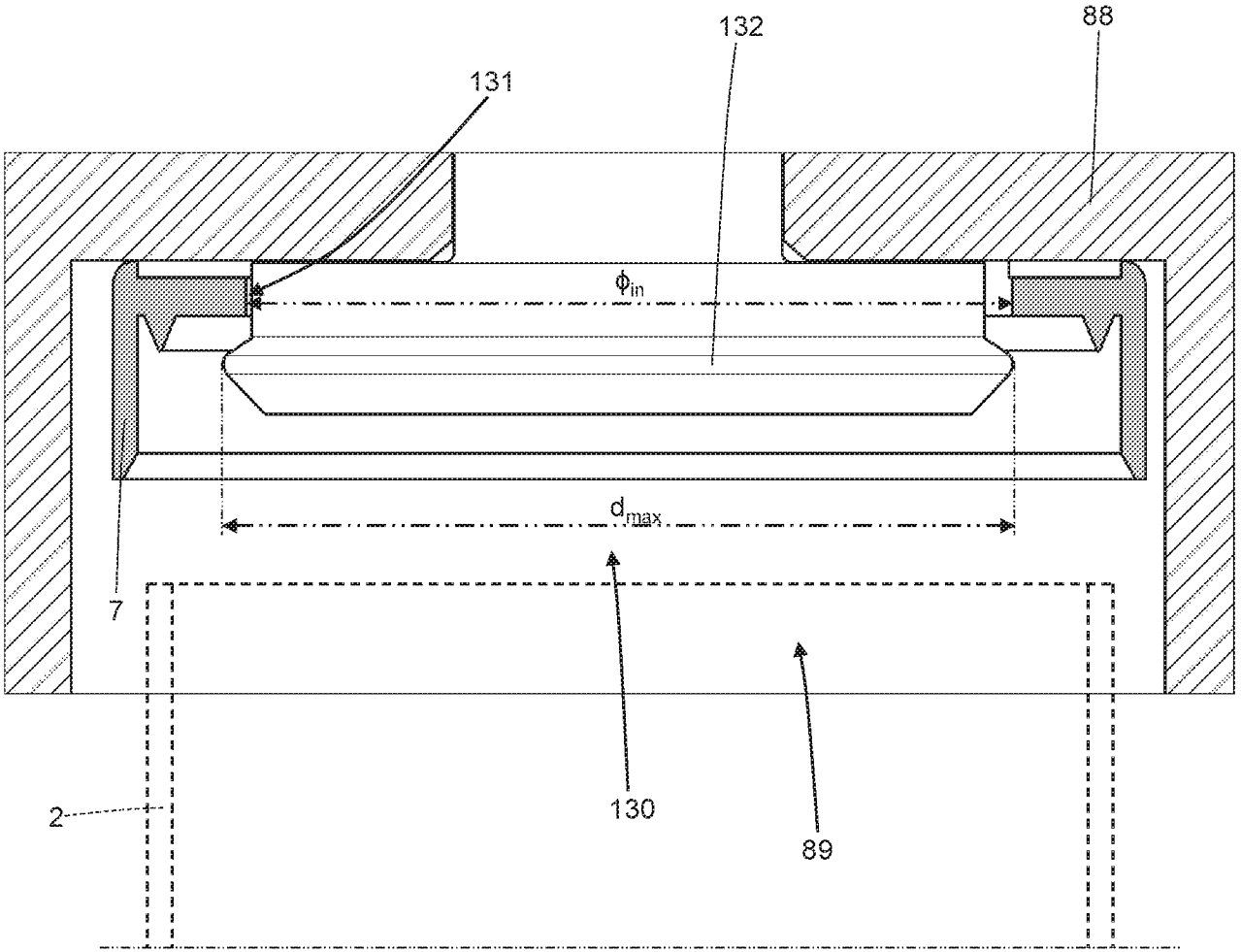
FIG. 39 is a schematic section view and on an enlarged scale, of a detail of the feeding unit of FIG. 37.

In the alternative embodiment illustrated in FIGS. 37-40, each seat 89 comprises a support element 130 (better illustrated in FIGS. 39 and 40) which is integral with the corresponding finger 88 (i.e. does not move relative to the finger 88) and is adapted to receive and hold a sealing ring 7 from the inside by mechanical interlocking. In other words, each seat 89 of the embodiment illustrated in FIGS. 23 and 24 is formed by a cylindrical cavity inside of which a sealing ring 7 is fitted (lodged) which externally touches the cylindrical cavity; therefore, in the embodiment illustrated in FIGS. 23 and 24 each seat 89 engages only and exclusively externally (from the outside) a corresponding sealing ring 7. Instead, each seat 89 of the embodiment illustrated in FIGS. 37-40 is formed by a support element 130 at the outside of which a sealing ring 7 is fitted (lodged) which touches the support element 130 only internally; therefore, in the embodiment illustrated in FIGS. 37 and 38 each seat 89 engages only and exclusively internally (from the inside) a corresponding sealing ring 7, leaving the sealing ring 7 externally free. Being a sealing ring 7 carried by an externally free support element 130 (as the support element 130 engages the sealing ring 7 only and exclusively from the inside), while the sealing ring 7 is engaged by the support element 130 the sealing ring 7 can be fitted around the upper end of a corresponding tubular casing 2 (as illustrated in FIG. 39).

Figure 40:
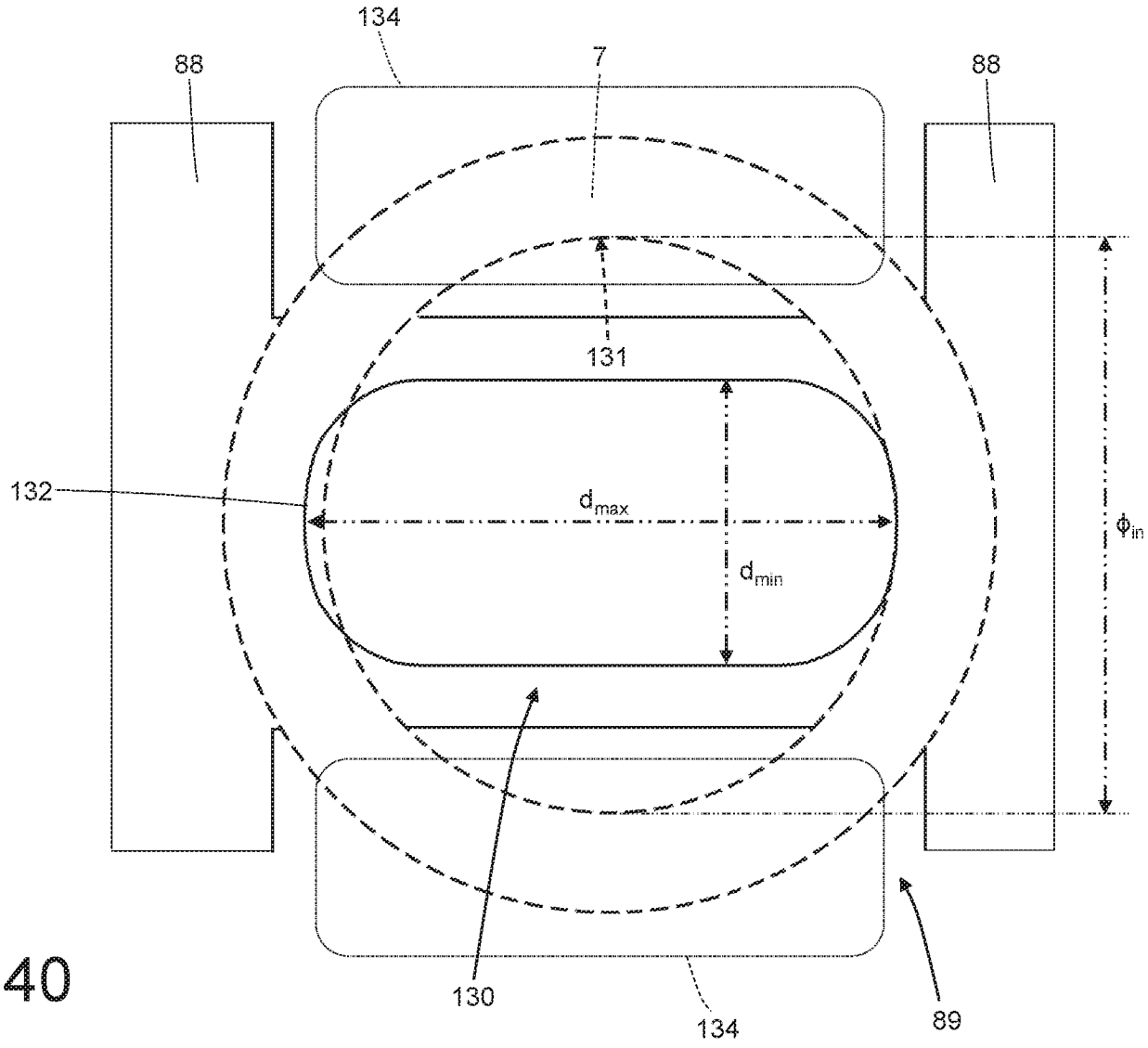
FIG. 40 is a schematic plan view of the detail of FIG. 39.

As better illustrated in FIGS. 39 and 40, each sealing ring 7 has, at the centre, a central through-hole 131 in which the support element 130 is inserted by means of an elastic deformation of the sealing ring 7; in other words, the support element 130 enters the central hole 131 of a sealing ring 7 by means of an elastic deformation of the sealing ring 7.

The support element 130 of each seat 89 has an approximately elliptical shape in plan view (i.e. a shape that is a cross between the elliptical shape and the rectangular shape) having a larger dimension $d_{max}$ according to a major axis which is slightly greater than an inner diameter $\phi_{in}$ of the central hole 131 of a sealing ring 7 and according to a minor axis (perpendicular to the major axis) a smaller dimension $d_{min}$ which is substantially smaller than the inner diameter $\phi_{in}$ of the central hole 131 of a sealing ring 7. According to a preferred embodiment, the largest dimension $d_{max}$ of each support element 130 is comprised between 1.02 and 1.07 times the inner diameter of the central hole 131 of a sealing ring 7 and the smaller dimension $d_{min}$ of each support element 130 is comprised between 0.4 and 0.6 times the inner diameter of the central hole 131 of a sealing ring 7. Consequently, a sealing ring 7 is fitted (lodged) in a support element 130 being elastically deformed so as to elongate along the major axis of the support element 130 and, at the same time, to shorten along the minor axis of the support element 130.

To assist the fitting (lodging) of a sealing ring 7 into a support element 130 (i.e. to favor the entry of the support element 130 into the central hole 131 of the sealing ring 7), the support element 130 has, externally, a truncated-conical shape which, from the bottom upwards, initially progressively increases its size until it reaches a maximum size at a band 132 of maximum width and subsequently gradually decreases its size for a given segment after which the size remains constant.

Figure 41:
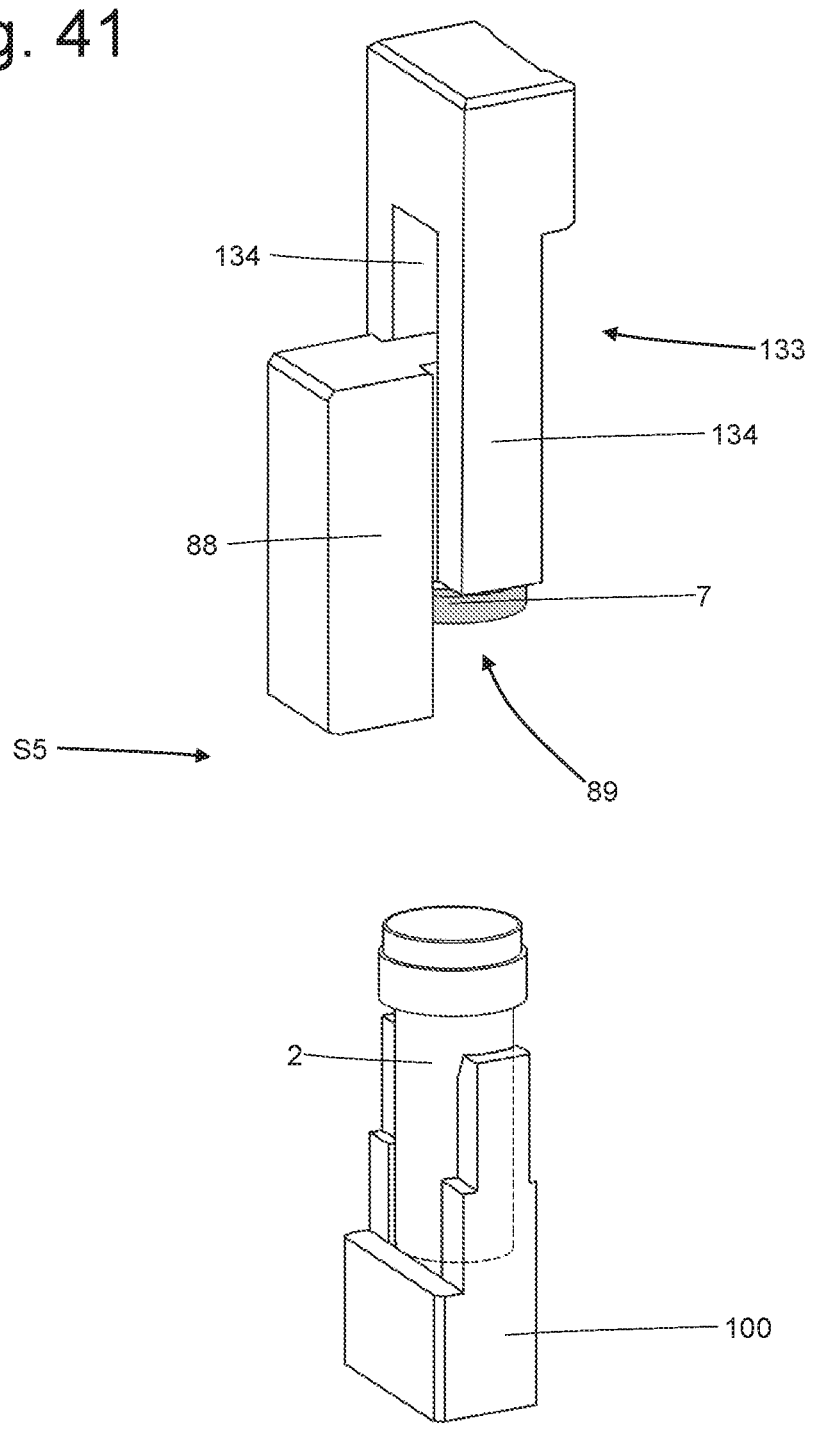
FIGS. 41, 42 and 43 schematically illustrate the coupling of an individual sealing ring to a corresponding tubular casing by means of the feeding unit of FIG. 37.
Figure 42:
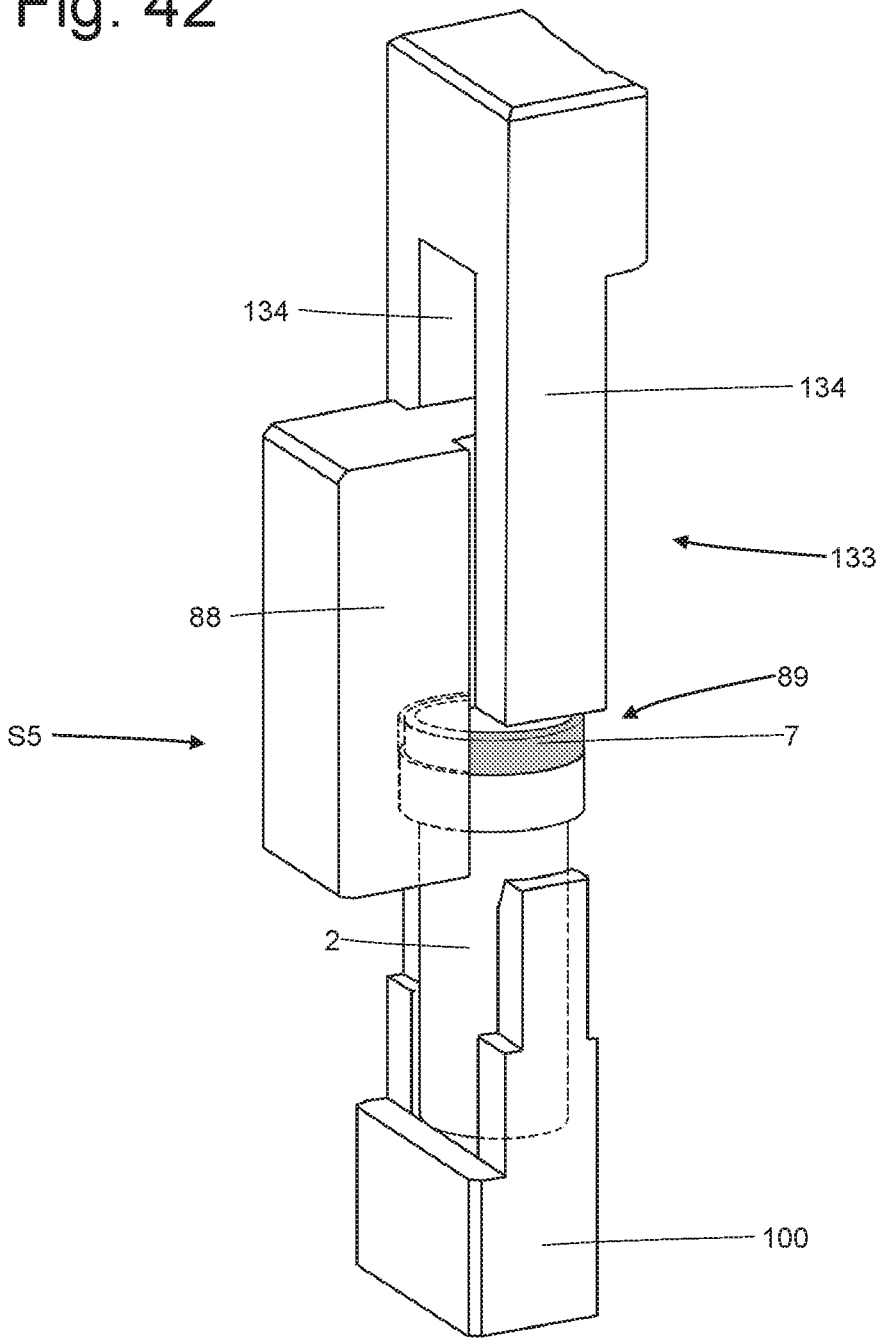
Figure 43:
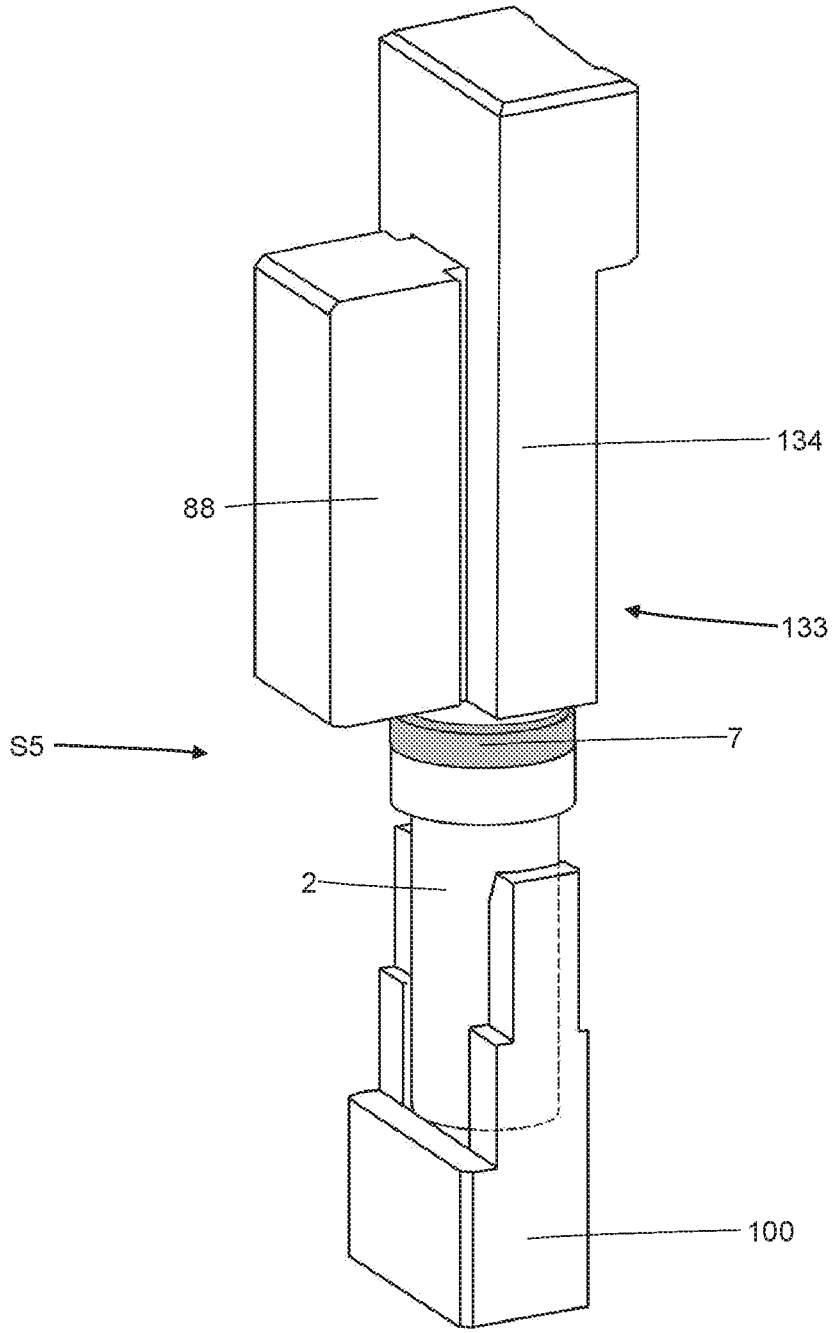

As illustrated in FIGS. 41, 42 and 43, each support element 130 is coupled with a pushing body 133 which is "U"-shaped (or "fork"-like shaped) and has two prongs 134 which are arranged on opposite sides of the support element 130 so that the pushing body 133 can slide laterally to the support element 130 without touching or otherwise interfering with the support element 130 (as schematically illustrated in FIG. 40 where it is shown how the two prongs 134 are arranged sideways with respect to the support element 130).

In use and as illustrated in FIG. 37, in the insertion station S9 each group 87 of fingers 88 is adapted to receive corresponding sealing rings 7 (in particular forty-two sealing rings 7) which are pushed upwards and therefore towards the seats 89 by the action of the (forty-two) pushers 97; in particular, the pushers 97 lodge ("fit with interference") the sealing rings 7 into the support elements 130 of the seats 89, causing a (small) elastic deformation of the sealing rings 7. According to a possible, but non-binding, embodiment, each pusher 97 is "U"-shaped (or "fork"-like shaped) and has two prongs which are arranged on opposite sides of the support element 130. Also in this embodiment, the accompanying elements 98 (which are not indispensable) can be provided, each is "U"-shaped (or "fork"-like shaped) and has two prongs which are arranged on opposite sides of the support element 130 so that the accompanying element 98 can slide laterally to the support element 130 without touching or otherwise interfering with the support element 130.

In use and as illustrated in FIG. 38, in the feeding station S5 each group 87 of fingers 88 is adapted to release corresponding sealing rings 7 (in particular forty-two sealing rings 7), carried by the seats 89, to corresponding tubular casings 2 carried by a group 15 of seats 16 of the manufacturing drum 13.

The seats 89 of the fingers 88 of a group 87 standing still in the feeding station S5 are aligned and overlapping the corresponding seats 16 of a group 15 that is standing still in the feeding station S5 so that each sealing ring 7, carried by a seat 89 of the fingers 88, is vertically aligned with a corresponding tubular casing 2 carried by a seat 16 of the manufacturing drum 13; this situation is illustrated in FIG. 41 with reference, for simplicity, to a single sealing ring 7 and to a single tubular casing 2.

Once the seats 89 of the fingers 88 of a group 87 standing still the feeding station S5 are aligned and overlapping the corresponding seats 16 of a group 15 that is standing still in the feeding station S5, the pushers 100 perform an upwardly forward vertical stroke to fit inside the seats 16 and to push the tubular casings 2 contained in the seats 16 towards the fingers 88 and then towards the corresponding seats 89 until each tubular casing 2 is coupled to a corresponding sealing ring 7 (still lodged into a corresponding support element 130); this situation is illustrated in FIG. 42 with reference, for simplicity, to a single sealing ring 7 and to a single tubular casing 2.

Once the tubular casings 2 have been coupled to the sealing rings 7, the pushers 100 perform a downwardly return vertical stroke to take back the tubular casings 2, provided with the sealing rings 7, to the seats 16 and, at the same time, the pushing bodies 133 perform a downwardly vertical stroke to push the sealing rings 7 out of the support elements 130 (with an elastic deformation of the sealing rings 7) while the sealing rings 7 remain coupled to the tubular casings 2; this situation is illustrated in FIG. 43 with reference, for simplicity, to a single sealing ring 7 and to a single tubular casing 2.

The embodiments described herein can be combined with each other without departing from the scope of protection of the present invention.

The manufacturing machine 8 described above has numerous advantages.

First of all, the manufacturing machine 8 described above allows to achieve high hourly productivity while ensuring a high-quality standard. This result is achieved, among other things, thanks to a particularly gentle, but at the same time very effective and efficient treatment of the sealing rings 7 which are never excessively mechanically stressed and, at the same time, always having a known and given position without the risk that a sealing ring 7 accidentally falls out early from a seat 89 and also without the risk that a sealing ring 7 will not be extracted during extraction from a seat 89 (or is damaged during the extraction from the seat 89).

Moreover, the manufacturing machine 8 is particularly compact and allows an operator in the vicinity of the manufacturing machine 8 to reach all the various parts of the manufacturing machine 8 with his own hands without having to perform unnatural movements.

Finally, the manufacturing machine 8 is relatively simple and inexpensive to manufacture.

The invention claimed is:

1. A manufacturing machine (8) for the production of disposable cartridges (1) for electronic cigarettes; the manufacturing machine (8) comprises:

a manufacturing drum (13), which is mounted in a rotatable stepwise manner around a vertical rotation axis (14) and supports at least one group (15) of seats (16), each of which is adapted to receive a corresponding component (2, 7) of the disposable cartridge (1); and a feeding unit (21), which feeds corresponding components (2, 7) of the disposable cartridges (1) to the seats (16) of a group (15) of seats (16) that is standing still at the feeding unit (21);

wherein each seat (16) comprises a housing through channel (26), which crosses the manufacturing drum (13) from side-to-side and is adapted to contain a component (2, 7);

wherein each seat (16) comprises a pair of opposite jaws (27), which are mounted in the housing channel (26) and are movable between a gripping position, in which they engage a component (2, 7) arranged in the housing channel (24; 26), and a transfer position, in which they do not engage a component (2, 7) arranged in the housing channel (24, 26); and wherein in each pair of jaws (27), at least one jaw (27) comprises a tooth (128), which is arranged at the top of the jaw (27) and projects from the jaw (27) towards the center of the seat (16), so that, when the two jaws (27) are arranged in the gripping position, the tooth (128) holds the component (2, 7) inside the seat (16) at the top.

2. The manufacturing machine (8) according to claim 1, wherein each pair of jaws (27) comprises two teeth (128), which are arranged at the top of the corresponding jaws (27) and project from the corresponding jaws (27) towards the center of the seat (16), so that, when the two jaws (27) are arranged in the gripping position, the two teeth (128) hold the component (2, 7) inside the seat (16) at the top.

3. The manufacturing machine (8) according to claim 1, wherein:

each disposable cartridge (1) comprises a tubular casing (2), which contains a quantity (5) of tobacco with a tab (6) of filtering material on top, and a sealing ring (7), which is applied and welded to the tubular casing (2); and the component (2, 7) that is fed by the feeding unit (21) is the sealing ring (7), which is fed to a seat (16) of the manufacturing drum (13) by being fitted around a tubular casing (2) carried by the seat (16).

4. The manufacturing machine (8) according to claim 3 and comprising at least one welding unit (22), which is arranged in a welding station (S6), carries out the ultrasound welding of each sealing ring (7) to a corresponding tubular casing (2) carried by a seat (16), and comprises a corresponding sonotrode (102), which is arranged in contact with an upper end of the tubular casing (2) carrying the sealing ring (7).

5. The manufacturing machine (8) according to claim 4, wherein, in the welding station (S6), the two jaws (27), which are opposite one another and are coupled to each seat (16), are kept in the gripping position.

6. The manufacturing machine (8) according to claim 5, wherein each sonotrode (102) has at least one recess (129), which is arranged at a respective tooth (128) and reproduces in negative the shape of the tooth (128), so as to carry out, between a tubular casing (2) and the corresponding sealing ring (7), an incomplete annular welding, which is interrupted in at least one region of the recess (129).

7. The manufacturing machine (8) according to claim 5, wherein each sonotrode (102) has two recesses (129), which are arranged at the two teeth (128) and reproduce, in negative, the shape of the two teeth (128), so as to carry out, between a tubular casing (2) and the corresponding sealing ring (7), an incomplete annular welding, which is interrupted in two opposite regions of the two recesses (129).

8. The manufacturing machine (8) according to claim 4, wherein, in the welding station (S6) the two jaws (27), which are opposite one another and are coupled to each seat (16), are moved from the gripping position to the transfer position.

9. The manufacturing machine (8) according to claim 8, wherein each sonotrode (102) carries out a complete annular welding, namely a 360° welding without interruptions, between a tubular casing (2) and the corresponding sealing ring (7).

10. The manufacturing machine (8) according to claim 1 and comprising:

a transfer station (S4) wherein a transfer unit (20) transfers the tubular casings (2) to the seats (16) of the group (15); and a feeding station (S5) wherein the feeding unit (21) feeds a corresponding sealing ring (7) into each tubular casing (2) carried by a seat (16).

11. The manufacturing machine (8) according to claim 10, wherein:

in the feeding station (S5), the jaws (27) are temporarily moved from the gripping position to the transfer position; and the feeding station (S5) comprises pushers (100), which vertically push, from the bottom to the top, the tubular casings (2) carried by the seats (16) towards the sealing rings (7).

12. The manufacturing machine (8) according to claim 11, wherein the pushers (100) are shaped so as to impart and preserve a centring of the tubular casings (2) relative to the seats (16).

13. A manufacturing machine (8) for the production of disposable cartridges (1) for electronic cigarettes; each disposable cartridge (1) comprises a tubular casing (2) and a sealing ring (7) fitted around an upper end of the tubular casing (2); the manufacturing machine (8) comprising:

a manufacturing drum (13), which is mounted in a rotatable stepwise manner around a vertical rotation axis (14) and supports at least one group (15) of first seats (16), each of which is adapted to house a corresponding tubular casing (2); and a feeding unit (21), which couples corresponding sealing rings (7) to the tubular casings (2) carried by the first seats (16) that are standing still at the feeding unit (21);

wherein the feeding unit (21) comprises a plurality of second seats (89), each adapted to house a corresponding sealing ring (7);

wherein the feeding unit (21) comprises a plurality of first pushers (100) arranged in a feeding station (S5), each of which is adapted to lift a corresponding tubular casing (2), which is in a first seat (16) to move the tubular casing (2) towards a sealing ring (7) carried by a second seat (89);

wherein each second seat (89) comprises a support element (130), which engages a sealing ring (7) only and exclusively from the inside; and wherein each first pusher (100) is adapted to lift a corresponding tubular casing (2) until the tubular casing (2) is coupled to a sealing ring (7) while the sealing ring (7) is internally engaged by a support element (130) of a second seat (89).

14. The manufacturing machine (8) according to claim 13, wherein each support element (130) is adapted to be inserted inside a central hole (131) of a sealing ring (7).

15. The manufacturing machine (8) according to claim 13, wherein the feeding unit (21) comprises a plurality of pushing bodies (133), each associated with a corresponding second seat (89) and movable for pushing a sealing ring (7) out of the support element (130).

16. The manufacturing machine (8) according to claim 15, wherein each pushing body (133) is movable to push a sealing ring (7), fitted around a tubular casing (2), out of the support element (130).

17. The manufacturing machine (8) according to claim 15, wherein each pushing body (133) is U-shaped and has two prongs (134) which are arranged on opposite sides of the support element (130) so that the pushing body (133) can slide laterally to the support element (130) without touching the support element (130).

18. The manufacturing machine (8) according to claim 13, wherein each support element (130) has an approximately elliptical shape in plan view having, according to a major axis, a larger dimension (dmax) greater than an inner diameter (ϕin) of a central hole (131) of a sealing ring (7) and, according to a minor axis, a smaller dimension ($d_{min}$) which is smaller than the inner diameter (ϕin) of the central hole (131) of a sealing ring (7).

19. The manufacturing machine (8) according to claim 18, wherein the larger dimension (dmax) of each support element (130) is comprised between 1.02 and 1.07 times the inner diameter (ϕin) of the central hole (131) of a sealing ring (7).

20. The manufacturing machine (8) according to claim 18 or 19, wherein the smaller dimension (dmin) of each support element (130) is comprised between 0.4 and 0.6 times the inner diameter (ϕin) of the central hole (131) of a sealing ring (7).

21. The manufacturing machine (8) according to claim 13, wherein each support element (130) has, on the outside, a truncated-conical shape which progressively increases its size from bottom to top until it reaches a maximum size and, then, decreases its size.

22. The manufacturing machine (8) according to claim 13, wherein the feeding unit (21) comprises a plurality of second pushers (97) arranged in an insertion station (S9), each of which is adapted to lift a corresponding sealing ring (7) to insert the sealing ring (7) into a corresponding support element (130).

23. The manufacturing machine (8) according to claim 22, wherein the feeding unit (21) comprises a plurality of accompanying elements (98) arranged in the insertion station (S9), each "U"-shaped and with two prongs, which are arranged on opposite sides of the support element (130) so that the accompanying element (98) can slide laterally to the support element (130) without touching the support element (130).

* * * * *